US012145020B2

(12) United States Patent
Valente et al.

(10) Patent No.: US 12,145,020 B2
(45) Date of Patent: Nov. 19, 2024

(54) EXERCISE MACHINE CONFIGURATIONS

(71) Applicant: Tonal Systems, Inc., San Francisco, CA (US)

(72) Inventors: Michael Valente, San Francisco, CA (US); Robin Barata, San Francisco, CA (US); David Mallard, Mill Valley, CA (US); Thomas Kroman Watt, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 273 days.

(21) Appl. No.: 17/550,981

(22) Filed: Dec. 14, 2021

(65) Prior Publication Data

US 2022/0212055 A1 Jul. 7, 2022

Related U.S. Application Data

(60) Provisional application No. 63/125,924, filed on Dec. 15, 2020.

(51) Int. Cl.
*A63B 21/00* (2006.01)
*A63B 24/00* (2006.01)

(52) U.S. Cl.
CPC ..... *A63B 21/151* (2013.01); *A63B 24/0021* (2013.01); *A63B 2024/0053* (2013.01)

(58) Field of Classification Search
CPC ..... A63B 21/151; A63B 24/0021; A63B 2024/0053; A63B 21/169; A63B 21/4029; A63B 2210/50; A63B 2225/09; A63B 21/153; A63B 71/0619; A63B 21/156
See application file for complete search history.

(56) References Cited

U.S. PATENT DOCUMENTS 4,471,956 A * 9/1984 Marlo ..... A63B 21/4029 482/106
4,968,028 A 11/1990 Wehrell
6,027,429 A * 2/2000 Daniels ..... A63B 21/00845 482/92
6,312,363 B1 11/2001 Watterson
6,347,290 B1 * 2/2002 Bartlett ..... G06F 1/163 715/863
7,278,958 B2 10/2007 Morgan
7,628,730 B1 * 12/2009 Watterson ..... A63B 71/0622 482/4
7,789,800 B1 * 9/2010 Watterson ..... A63B 22/025
8,029,415 B2 * 10/2011 Ashby ..... A63B 22/0605 482/49

(Continued)

FOREIGN PATENT DOCUMENTS

EP 3202465 8/2017

*Primary Examiner* — Garrett K Atkinson
(74) *Attorney, Agent, or Firm* — Van Pelt, Yi & James LLP

(57) ABSTRACT

An exercise machine is disclosed. A vertically oriented console unit comprises: a first cable; a screen; and a motor providing a controllable tension force on the first cable. An auxiliary pulley that is remote from the console unit is disclosed, wherein the first cable is routable over the auxiliary pulley that is remote from the console unit.

An exercise machine is disclosed. A resistance unit comprises: a first cable; and a motor providing a controllable tension force on a first cable. An adjustable screen unit is disclosed, wherein the adjustable screen unit is at least one of tiltable, rotatable, and translatable.

13 Claims, 85 Drawing Sheets

(56) References Cited

U.S. PATENT DOCUMENTS 8,029,425 B2 10/2011 Bronston
8,821,418 B2 * 9/2014 Meger ..... G16H 50/30 600/595
8,900,099 B1 12/2014 Boyette
8,968,155 B2 * 3/2015 Bird ..... A63B 21/156 482/4
9,028,368 B2 * 5/2015 Ashby ..... A63B 22/0023 482/4
9,101,791 B2 8/2015 Boyette
9,308,417 B2 * 4/2016 Grundy ..... A61B 5/11
9,530,325 B2 * 12/2016 Hall ..... G09B 5/065
9,539,458 B1 1/2017 Ross
9,656,116 B2 * 5/2017 Giannelli ..... A63B 21/4035
9,861,856 B1 * 1/2018 Miller ..... A63B 69/36
10,220,235 B2 * 3/2019 Norris ..... A63B 21/153
10,286,253 B1 * 5/2019 Johnson ..... A63B 21/00192
10,500,442 B2 * 12/2019 Hong ..... A63B 21/156
10,709,925 B2 * 7/2020 Dalebout ..... A63B 23/03541
10,758,767 B2 * 9/2020 Olson ..... A63B 23/1245
10,814,172 B1 * 10/2020 Ilfrey ..... A63B 23/035
11,007,398 B2 5/2021 Neuhaus
11,040,231 B2 * 6/2021 Rubin ..... A63B 71/0622
11,097,148 B2 * 8/2021 Kennington ..... A63B 21/169
2001/0011025 A1 * 8/2001 Ohki ..... H04B 1/385 455/344
2003/0017918 A1 * 1/2003 Webb ..... A63B 21/156 482/99
2004/0254050 A1 * 12/2004 Morgan ..... A63B 21/00065 482/121
2004/0263473 A1 * 12/2004 Cho ..... G06F 3/014 345/156
2007/0117691 A1 * 5/2007 Sechrest ..... A63B 21/0628 482/97
2007/0155587 A1 * 7/2007 Huang ..... A63B 23/12 482/148
2007/0161470 A1 * 7/2007 Berryman ..... A63B 69/3629 482/100
2008/0051256 A1 * 2/2008 Ashby ..... A63B 71/0622 482/1
2009/0270227 A1 * 10/2009 Ashby ..... G16H 20/30 482/8
2011/0071003 A1 * 3/2011 Watterson ..... H04L 67/12 702/160
2011/0112442 A1 * 5/2011 Meger ..... A61B 5/4818 600/595
2012/0220427 A1 * 8/2012 Ashby ..... A63B 71/0622 482/4
2012/0323346 A1 * 12/2012 Ashby ..... A63B 24/0003 700/91
2013/0303334 A1 11/2013 Adhami
2014/0038777 A1 * 2/2014 Bird ..... A63B 23/03525 482/5
2014/0087341 A1 * 3/2014 Hall ..... A63B 71/0622 434/258
2014/0194251 A1 * 7/2014 Reich ..... A63B 21/00178 482/6
2014/0278125 A1 * 9/2014 Balakrishnan ..... G16Z 99/00 702/19
2014/0330186 A1 * 11/2014 Hyde ..... A61F 2/70 602/19
2015/0190667 A1 * 7/2015 Balandis ..... A63B 23/0355 482/5
2015/0238817 A1 * 8/2015 Watterson ..... A63B 23/0476 482/8
2015/0335950 A1 * 11/2015 Eder ..... A63B 22/0605 482/8
2015/0367162 A1 * 12/2015 Mueller ..... A63B 21/154 482/94
2016/0346601 A1 12/2016 Marcandelli
2016/0346617 A1 * 12/2016 Srugo ..... G16H 40/67
2017/0065873 A1 * 3/2017 Hall ..... G09B 15/00
2017/0197103 A1 * 7/2017 Rau ..... A63B 21/0057
2017/0239517 A1 * 8/2017 Jeong ..... A63B 22/04
2017/0246507 A1 * 8/2017 Kennington ..... A63B 21/0087
2017/0266503 A1 * 9/2017 Watterson ..... A63B 21/075
2017/0319905 A1 * 11/2017 O'Connor ..... A63B 21/00181
2017/0361165 A1 * 12/2017 Miller ..... A63B 21/00178
2018/0021622 A1 * 1/2018 Holland ..... A63B 21/0557 482/122
2018/0154240 A1 * 6/2018 Hall ..... A63B 71/0686
2018/0160943 A1 * 6/2018 Fyfe ..... A61B 5/1112
2018/0214729 A1 * 8/2018 Rubin ..... A63B 24/0087
2018/0290001 A1 * 10/2018 Baek ..... A63B 17/04
2018/0296879 A1 10/2018 Blium
2019/0076691 A1 3/2019 Smith
2019/0099633 A1 * 4/2019 Orady ..... A63B 21/0058
2019/0099637 A1 * 4/2019 Valente ..... A63B 21/4047
2019/0099652 A1 * 4/2019 Orady ..... A63B 71/0054
2019/0175072 A1 * 6/2019 Schmidt ..... G16H 40/63
2019/0344123 A1 11/2019 Rubin
2020/0047027 A1 * 2/2020 Ward ..... G06F 3/0346
2020/0047030 A1 * 2/2020 Ward ..... A63B 24/0087
2020/0047053 A1 * 2/2020 Ward ..... A63F 13/213
2020/0047054 A1 * 2/2020 Ward ..... A63F 13/213
2020/0047055 A1 * 2/2020 Ward ..... A63B 21/0058
2020/0054929 A1 * 2/2020 Ward ..... A63B 24/0021
2020/0335211 A1 * 10/2020 Gopalakrishnan ..... A61B 5/24
2021/0111646 A1 4/2021 Rubin
2021/0128978 A1 5/2021 Gilstrom
2021/0236876 A1 8/2021 Gregory
2021/0275107 A1 * 9/2021 Pitters ..... A61B 5/7275
2022/0062738 A1 * 3/2022 Neuhaus ..... A63B 33/002

* cited by examiner

Slide

- Recommend rail system that account for some misalignment
- Example shows V and C tracks

- Spring loaded pins for possible arm locking system

- Constant force spring as alternative for counterbalancing

- Single pivot for each arm
- Arm length ~ 45"

Slide - Single Rail

- Alternative to dual rail system for Slide
- Larger centered single guide rail
- Spring loaded pin at bottom to secure vertical position

EXERCISE MACHINE CONFIGURATIONS

CROSS REFERENCE TO OTHER APPLICATIONS

This application claims priority to U.S. Provisional Patent Application No. 63/125,924 entitled EXERCISE MACHINE CONFIGURATIONS filed Dec. 15, 2020 which is incorporated herein by reference for all purposes.

BACKGROUND OF THE INVENTION

Exercise improves an individual's health. Strength training, also referred to as resistance training or weight lifting, is an important part of any exercise routine. It promotes the building of muscle, the burning of fat, and improvement of a number of metabolic factors including insulin sensitivity and lipid levels. Many users seek a more efficient and safe method of strength training and/or exercise. Machines that provide strength training and/or exercise may be built with a configuration that has its own strengths and challenges when integrating on a premises, for example a home.

BRIEF DESCRIPTION OF THE DRAWINGS

Various embodiments of the invention are disclosed in the following detailed description and the accompanying drawings.

DETAILED DESCRIPTION

Figure 1A:
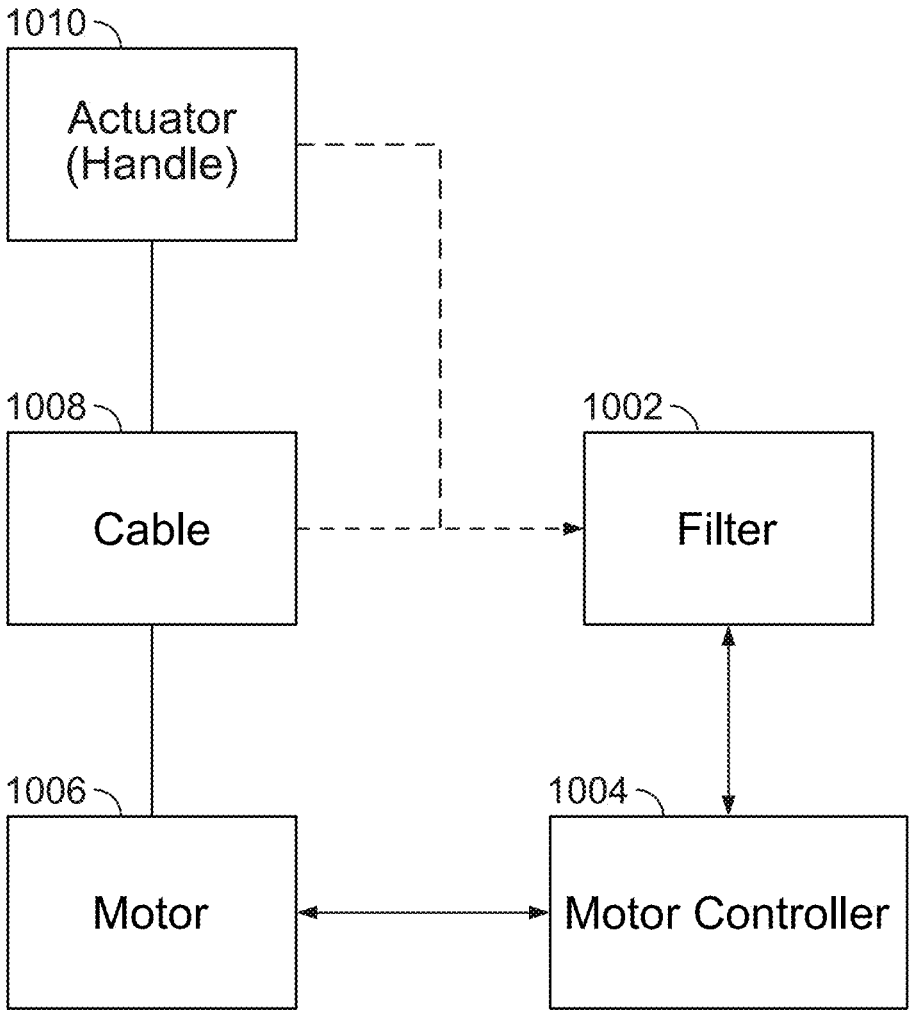
FIG. 1A is a block diagram illustrating an embodiment of an exercise machine.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Configurations of an exercise machine are disclosed. Without limitation, such configurations are shown for a cable-based digital strength trainer, but are generally applicable to any exercise machine. An initial configuration of an exercise machine such as a cable-based digital strength trainer is a wall-mounted, fixed vertically oriented console position, flexible arm-based exertion positioning as described in U.S. Pat. No. 10,335,626 entitled EXERCISE MACHINE WITH PANCAKE MOTOR filed Oct. 2, 2017, which is incorporated herein by reference for all purposes. Without limitation, as described below each configuration may be combined with other configuration to provide yet more alternate configurations.

Another configuration of an exercise machine is a machine with an auxiliary exertion point remote from its console unit. As referred to herein, a 'console unit' is a unit that is sufficient to provide exercise for a user, for example a unit with a display screen and a motor providing tension for a user exercise. As referred to herein, an 'exertion point' is a point in space associated with a user's exertion of the exercise, for example for a cable-based system the point in space where a cable from the exercise machine is located by a pulley before reaching a user's actuator and/or handle. This provides the vector of exertion for a user, for example, a higher exertion point in relation to a user's height may be useful for isometric, concentric, and/or eccentric exercise to a movement such as a lat pulldown. As referred to herein, a 'movement' is any exercise such as a weight training exercise with an established form and/or procedure. As referred to herein, being 'remote' from a console unit includes being in a physical space other than within the console unit or being directly attached to the console unit.

The auxiliary pulley and/or auxiliary exertion point may be on a plate such as a platform that a user may stand on near the console, to allow movements with a lower exertion point such as a bicep curl movement. In one embodiment, the plate may be a vibrational plate providing lower frequency whole body vibration for a user's health benefit. The auxiliary pulley/auxiliary exertion point may be on a bench such as a bench-press or rowing bench near the console, to allow exercise with a bench-based exertion point such as a bench press exercise or bent-over row exercise. The plate may be coupled to the vertically oriented console unit.

In one embodiment, a plate may be a modular system that permits user added counterweight, to reduce the chance of tipping at a maximum worst case pull direction. In one embodiment, a sensor detects tilt and/or pressure to warn a user close to tipping the machine. In one embodiment, a flooring workout mat and/or carpet cover are provided that are functional, attractive and/or may help the standing exercise machine from rotating and stabilizing the base plate from impulse movements. Examples may include velcro anchoring to carpets, rubbery or double sided adhesives to hard floors, suction, and/or small carpet nails. A mat/cover may be angled on the edges to avoid users tripping on it. An air suction effect of the mat/cover may help resist fast impulse movements. In one embodiment, a motor controlled gyroscopic system may be used as a counterforce to stabilize the exercise machine.

In one embodiment, the exertion point may involve mechanical advantage, for example with a cable-based system a block-and-tackle arrangement using one or more pulleys to provide a mechanical tradeoff between cable speed and force presented to the user. In one embodiment, the exertion point may involve a 'traveler' subunit, as referred to herein as a movable exertion point to provide a passive, damped, unstable and/or active regulation of the exertion point in relation to the user's position, user's motion, and/or user's exercise.

Another configuration of an exercise machine is a machine with a console unit that includes a resistance unit and an adjustable screen unit. As referred to herein, a 'resistance unit' is a unit providing user resistance to exercise, for example for a cable-based system the resistance unit provides a controllable tension force on the cable that the user exerts against at some point with their actuator/handle. As referred to herein, a 'screen unit' is a unit providing information to a user during exercise, for example to provide to the user exercise metrics such as stroke cadence and power, instructions on newer exercises, feedback on user form, encouragement to the user, and/or group exercise communications/standings. Having an adjustable screen unit via tilt, rotation, and translation improves the exercise machine by providing better visibility to the user and/or audience. In one embodiment, the adjustable screen unit is itself curved to provide better visibility to the typical location of a user's gaze. In one embodiment, the adjustable screen unit is foldable into the console, for example such that it is hidden and/or stowed at least in part when the exercise machine is not in use, and tiltable when in use.

Another configuration of an exercise machine is a machine that is freestanding. As referred to herein, a 'freestanding' machine is one that is not particularly mounted or secured to a wall. For example, for a cable-based system that has a low-profile in depth, a freestanding machine may stand on the floor. An advantage of a freestanding machine is that it may be more portable, more stowable, and/or may be moved relatively easily without tools. In one embodiment, a sensor is used to provide indication of current quality and/or 'early warning' for an installation, for example to indicate when a mounting is beginning to fail, or when a machine is beginning to tilt. In one embodiment, a sensor detects a distance between the console unit and the wall.

In one embodiment, install improvements that reduce installation errors may include removing drywall for an inset mounting, a secondary tether, using a mechanical set of washer/bolts that change color at the correct torque, to confirm an installation is done correctly, using an electronic set of sensors to detect if a machine is installed correctly/holding using pressure sensing washers.

In one embodiment, a wall-mounted system rests on the floor and/or has a low center of gravity, for example by having the resistance unit on the floor, to provide lower force on a wall mounting, making in nearly freestanding. In one embodiment, a wall-mounted system is mountable in a room's corner, wherein a corner mount provides additional structural benefit and/or lower mechanical/installation requirements. In one embodiment, the plate is coupled to the vertically oriented console unit, and/or the vertically oriented console unit is coupled to the plate via one or more stands, and the exercise machine is freestanding.

In one embodiment, a corner mount/stand positions the exercise machine at 45 degrees in the corner where two walls meet at 90 degrees. Improvements from a corner mount include a space saving design for users, while leaving room for a good workout space in front of it. A wall-based corner mount may use both walls and mount at 45 degrees between them. A floor-based corner stand may use a 90 degree clown foot stand or quarter circle metal plate, stabilized and/or attached to the wall. A corner mount may have an additional improvement of reducing a lot of use cases for pull direction that would cause tipping on a full free stand. Sensors may be used to confirm that these stands are touch or attached to the wall and not setup inappropriately. In one embodiment, small additional bolting into wall or floorboards are used to get improved stability, and the corner mount may slightly adjust angles if a room is not precisely 90 degrees.

Another configuration of an exercise machine is a machine that has an alternate exertion point positioning. A particular exertion point positioning may have a tradeoff between materials cost, robustness, complexity, degrees of freedom, range of positioning, and/or ease of use. Alternate exertion point positioning may include an increased number of 'arms', referred to herein as a rigid and/or semi-rigid structure that provides the exertion point positioning, for example using four arms instead of two arms. Alternate exertion point positioning may include an increased number of motors, for example using two motors with two arms instead of one motor with two arms via a differential, or for example using two motors with four arms and two differentials. In one embodiment, a cage-like structure may be used instead of arms.

Another configuration of an exercise machine is a machine that has enhanced sensors. In one embodiment, the exercise machine has compartments for stowable accessories, such as handle/actuators, a device charging station, a water bottle, or towel. A sensor may be used to indicate to the exercise machine which particular accessory is being used currently by the user, for example if the rowing handle is not in the compartment. In one embodiment, the exercise machine has a sensor in an associated platform that can indicate where and/or how the user is positioning themselves and may be used to provide further feedback on a user's form and/or indicate when a dangerous situation may arise such as user exhaustion, falls, or trips.

An Initial Exercise Machine Configuration. Traditionally, the majority of strength training methods and/or apparatuses fall into the following categories:

- Body Weight: Nothing in addition to the gravitational force of body weight is used to achieve resistance training. Pull-ups are a good example of this. Some systems such as TRX provide props that may help one better achieve this;
- Free weights: A traditional example are dumbbells, which also operate using gravity as a force. The tension experienced by a user throughout a range of motion, termed throughout this specification as an "applied tension curve", varies depending on the angle of movement and/or the direction of gravity. For some motion, such as a bicep curl, the applied tension curve is particularly variable: for a bicep curl it starts at near zero when the arm is at full extension, peaks at 90 degrees, and reduces until the arm reaches full curl at near zero again;
- Fixed-track machine: Machines that use weights, for example plates of metal comprising a weight stack, coupled by a cable attached to a cam joined to a mechanism running on a pivot and/or track. These often have a fixed applied tension curve, though some systems such as Nautilus have used oddly shaped cams in order to achieve non-linear applied tension curves. Often a weight setting is selected for a weight stack by using a pin inserted associated with a desired plate; and
- Cable-machines: Also known as gravity-and-metal based cable-machines, these are a cross between free weights and fixed track machines. They comprise a weight stack attached to a cable, often via a pulley system which may be adjustable in height or direction. Fixed-track machines have historically been criticized by some for overly isolating a single muscle. Free weights on the other hand have historically been criticized by some for activating too many small stabilizer muscles, meaning that a user's workout may be limited by these small muscles before the large ones have even gotten a good workout. Cables do not run on a track, and thus still require some use of stabilizer muscles, but not as much as free weights because the direction of pull is strictly down the cable. The effective applied tension curves varies if the angle of attack between a user's hand and the cable changes throughout the range of motion.

While gravity is the primary source of tension and/or resistance in all of the above, tension has also been achieved using springs and/or flexing nylon rods as with Bowflex, elastics comprising rubber bands/resistance bands as with TheraBand, pneumatics, and hydraulics. These systems have various characteristics with their own applied tension curve.

Electronic Resistance. Using electricity to generate tension/resistance may also be used, for example, as described in U.S. patent application Ser. No. 15/655,682 entitled DIGITAL STRENGTH TRAINING filed Jul. 20, 2017, which is incorporated herein by reference for all purposes. Examples of electronic resistance include using an electromagnetic field to generate tension/resistance, using an electronic motor to generate tension/resistance, and using a three-phase brushless direct-current (BLDC) motor to generate tension/resistance. The techniques discussed within the instant application are applicable to other traditional exercise machines without limitation, for example exercise machines based on pneumatic cylinders, springs, weights, flexing nylon rods, elastics, pneumatics, hydraulics, and/or friction.

Low Profile. A strength trainer using electricity to generate tension/resistance may be smaller and lighter than traditional strength training systems such as a weight stack, and thus may be placed, installed, or mounted in more places for example the wall of a small room of a residential home. Thus, low profile systems and components are preferred for such a strength trainer. A strength trainer using electricity to generate tension/resistance may also be versatile by way of electronic and/or digital control. Electronic control enables the use of software to control and direct tension. By contrast, traditional systems require tension to be changed physically/manually; in the case of a weight stack, a pin has to be moved by a user from one metal plate to another.

Such a digital strength trainer using electricity to generate tension/resistance is also versatile by way of using dynamic resistance, such that tension/resistance may be changed nearly instantaneously. When tension is coupled to position of a user against their range of motion, the digital strength trainer may apply arbitrary applied tension curves, both in terms of position and in terms of phase of the movement: concentric, eccentric, and/or isometric. Furthermore, the shape of these curves may be changed continuously and/or in response to events; the tension may be controlled continuously as a function of a number of internal and external variables including position and phase, and the resulting applied tension curve may be pre-determined and/or adjusted continuously in real time.

FIG. 1A is a block diagram illustrating an embodiment of an exercise machine. The exercise machine includes the following:

- a controller circuit (1004), which may include a processor, inverter, pulse-width-modulator, and/or a Variable Frequency Drive (VFD);
- a motor (1006), for example a three-phase brushless DC driven by the controller circuit;
- a spool with a cable (1008) wrapped around the spool and coupled to the spool. On the other end of the cable an actuator/handle (1010) is coupled in order for a user to grip and pull on. The spool is coupled to the motor (1006) either directly or via a shaft/belt/chain/gear mechanism. Throughout this specification, a spool may be also referred to as a "hub";
- a filter (1002), to digitally control the controller circuit (1004) based on receiving information from the cable (1008) and/or actuator (1010);

optionally (not shown in FIG. 1A) a gearbox between the motor and spool. Gearboxes multiply torque and/or friction, divide speed, and/or split power to multiple spools. Without changing the fundamentals of digital strength training, a number of combinations of motor and gearbox may be used to achieve the same end result. A cable-pulley system may be used in place of a gearbox, and/or a dual motor may be used in place of a gearbox;

one or more of the following sensors (not shown in FIG. 1A):

a position encoder; a sensor to measure position of the actuator (1010) or motor (100). Examples of position encoders include a hall effect shaft encoder, grey-code encoder on the motor/spool/cable (1008), an accelerometer in the actuator/handle (1010), optical sensors, position measurement sensors/methods built directly into the motor (1006), and/or optical encoders. In one embodiment, an optical encoder is used with an encoding pattern that uses phase to determine direction associated with the low resolution encoder. Other options that measure back-EMF (back electromagnetic force) from the motor (1006) in order to calculate position also exist;

a motor power sensor; a sensor to measure voltage and/or current being consumed by the motor (1006);

a user tension sensor; a torque/tension/strain sensor and/or gauge to measure how much tension/force is being applied to the actuator (1010) by the user. In one embodiment, a tension sensor is built into the cable (1008). Alternatively, a strain gauge is built into the motor mount holding the motor (1006). As the user pulls on the actuator (1010), this translates into strain on the motor mount which is measured using a strain gauge in a Wheatstone bridge configuration. In another embodiment, the cable (1008) is guided through a pulley coupled to a load cell. In another embodiment, a belt coupling the motor (1006) and cable spool or gearbox (1008) is guided through a pulley coupled to a load cell. In another embodiment, the resistance generated by the motor (1006) is characterized based on the voltage, current, or frequency input to the motor.

In one embodiment, a three-phase brushless DC motor (1006) is used with the following:

a controller circuit (1004) combined with filter (1002) comprising:

a processor that runs software instructions;

three pulse width modulators (PWMs), each with two channels, modulated at 20 kHz;

six transistors in an H-Bridge configuration coupled to the three PWMs;

optionally, two or three ADCs (Analog to Digital Converters) monitoring current on the H-Bridge; and/or optionally, two or three ADCs monitoring back-EMF voltage;

the three-phase brushless DC motor (1006), which may include a synchronous-type and/or asynchronous-type permanent magnet motor, such that:

the motor (1006) may be in an "out-runner configuration" as described below;

the motor (1006) may have a maximum torque output of at least 60 Nm and a maximum speed of at least 300 RPMs;

optionally, with an encoder or other method to measure motor position;

a cable (1008) wrapped around the body of the motor (1006) such that entire motor (1006) rotates, so the body of the motor is being used as a cable spool in one case. Thus, the motor (1006) is directly coupled to a cable (1008) spool. In one embodiment, the motor (1006) is coupled to a cable spool via a shaft, gearbox, belt, and/or chain, allowing the diameter of the motor (1006) and the diameter of the spool to be independent, as well as introducing a stage to add a set-up or step-down ratio if desired. Alternatively, the motor (1006) is coupled to two spools with an apparatus in between to split or share the power between those two spools. Such an apparatus could include a differential gearbox, or a pulley configuration; and/or an actuator (1010) such as a handle, a bar, a strap, or other accessory connected directly, indirectly, or via a connector such as a carabiner to the cable (1008).

In some embodiments, the controller circuit (1002, 1004) is programmed to drive the motor in a direction such that it draws the cable (1008) towards the motor (1006). The user pulls on the actuator (1010) coupled to cable (1008) against the direction of pull of the motor (1006).

One purpose of this setup is to provide an experience to a user similar to using a traditional cable-based strength training machine, where the cable is attached to a weight stack being acted on by gravity. Rather than the user resisting the pull of gravity, they are instead resisting the pull of the motor (1006).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (1010) coupled to a cable (1008) coupled to a motor (1006). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (1006) may be converted into linear force by multiplying it by radius r.

If the virtual/perceived "weight stack" is moving away from the ground, motor (1006) rotates in one direction. If the "weight stack" is moving towards the ground, motor (1006) rotates in the opposite direction. Note that the motor (1006) is pulling towards the cable (1008) onto the spool. If the cable (1008) is unspooling, it is because a user has overpowered the motor (1006). Thus, note a distinction between the direction the motor (1006) is pulling, and the direction the motor (1006) is actually turning.

If the controller circuit (1002, 1004) is set to drive the motor (1006) with, for example, a constant torque in the direction that spools the cable, corresponding to the same direction as a weight stack being pulled towards the ground, then this translates to a specific force/tension on the cable (1008) and actuator (1010). Calling this force "Target Tension", this force may be calculated as a function of torque multiplied by the radius of the spool that the cable (1008) is wrapped around, accounting for any additional stages such as gear boxes or belts that may affect the relationship between cable tension and torque. If a user pulls on the actuator (1010) with more force than the Target Tension, then that user overcomes the motor (1006) and the cable (1008) unspools moving towards that user, being the virtual equivalent of the weight stack rising. However, if that user applies less tension than the Target Tension, then the motor (1006) overcomes the user and the cable (1008) spools onto and moves towards the motor (1006), being the virtual equivalent of the weight stack returning.

BLDC Motor. While many motors exist that run in thousands of revolutions per second, an application such as fitness equipment designed for strength training has different requirements and is by comparison a low speed, high torque type application suitable for certain kinds of BLDC motors configured for lower speed and higher torque.

In one embodiment, a requirement of such a motor (1006) is that a cable (1008) wrapped around a spool of a given diameter, directly coupled to a motor (1006), behaves like a 200 lbs weight stack, with the user pulling the cable at a maximum linear speed of 62 inches per second. A number of motor parameters may be calculated based on the diameter of the spool.

| User Requirements | |
|---|---|
| Target Weight | 200 lbs |
| Target Speed | 62 inches/sec = 1.5748 meters/sec |

Motors may also be "direct drive", meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor torque is more appropriate for fitness equipment/strength training systems. This would normally lead to the selection of an induction type motor for which direct control of torque is simple. Although BLDC motors are more directly able to control speed and/or motor position rather than torque, torque control of BLDC motors can be made possible with the appropriate methods when used in combination with an appropriate encoder.

| Requirements by Spool Size | | | | | | |
|---|---|---|---|---|---|---|
| | Diameter (inches) | | | | | |
| | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements. 395 RPM is slower than most motors available, and 68 Nm is more torque than most motors on the market as well.

Hub motors are three-phase permanent magnet BLDC direct drive motors in an "out-runner" configuration: throughout this specification out-runner means that the permanent magnets are placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style". As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As described herein, a pancake motor is between 15 and 60 centimeters in diameter, for example 22 centimeters in diameter, with a depth between 6 and 15 centimeters, for example a depth of 6.7 centimeters.

Figure 1B:
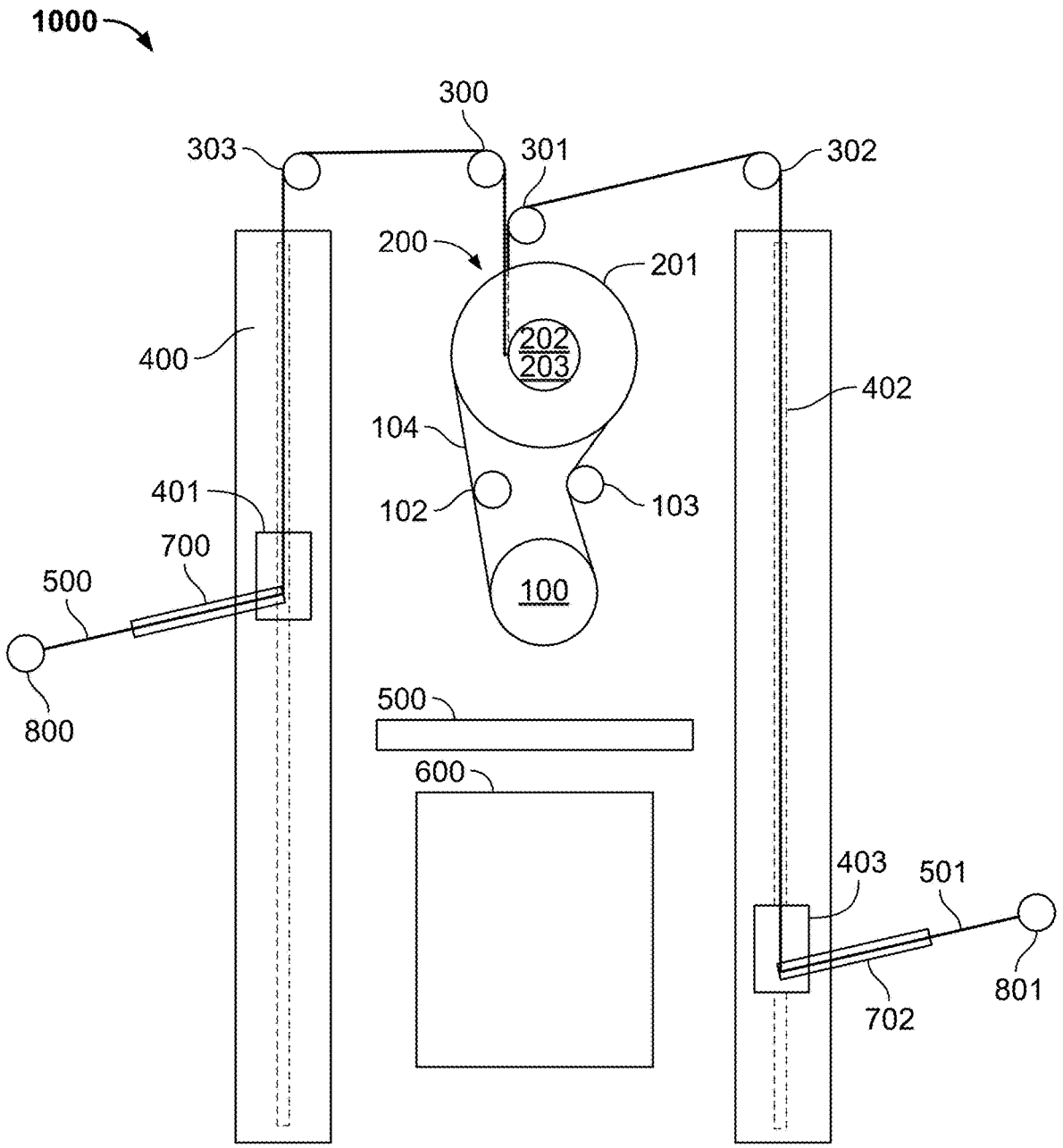
FIG. 1B illustrates a front view of one embodiment of an exercise machine.

Reference Design. FIG. 1B illustrates a front view of one embodiment of an exercise machine. An exercise machine (1000) comprising a pancake motor (100), a torque controller (600) coupled to the pancake motor, and a high resolution encoder coupled to the pancake motor (102) is disclosed. As described herein, a "high resolution" encoder is any encoder with 30 degrees or lower of electrical angle. Two cables (500) and (501) are coupled respectively to actuators (800) and (801) on one end of the cables. The two cables (500) and (501) are coupled directly or indirectly on the opposite end to the motor (100). While an induction motor may be used for motor (100), a BLDC motor is a preferred embodiment for its cost, size, weight, and performance. A BLDC motor is more challenging than an induction motor to control torque and so a high resolution encoder assists the system to determine position of the BLDC motor.

Sliders (401) and (403) may be respectively used to guide the cable (500) and (501) respectively along rails (400) and (402). The exercise machine in FIG. 1B translates motor torque into cable tension. As a user pulls on actuators (800) and/or (801), the machine creates/maintains tension on cable (500) and/or (501). The actuators (800, 801) and/or cables (500, 501) may be actuated in tandem or independently of one another.

In one embodiment, electronics bay (600) is included and has the necessary electronics to drive the system. In one embodiment, fan tray (500) is included and has fans that cool the electronics bay (600) and/or motor (100).

Motor (100) is coupled by belt (104) to an encoder (102), an optional belt tensioner (103), and a spool assembly (200). Motor (100) is preferably an out-runner, such that the shaft is fixed and the motor body rotates around that shaft. In one embodiment, motor (100) generates torque in the counter-clockwise direction facing the machine, as in the example in FIG. 1B. Motor (100) has teeth compatible with the belt integrated into the body of the motor along the outer circumference. Referencing an orientation viewing the front of the system, the left side of the belt (104) is under tension, while the right side of the belt is slack. The belt tensioner (103) takes up any slack in the belt. An optical rotary encoder (102) coupled to the tensioned side of the belt (104) captures all motor movement, with significant accuracy because of the belt tension. In one embodiment, the optical rotary encoder (102) is a high resolution encoder. In one embodiment, a toothed belt (104) is used to reduce belt slip. The spools rotate counter-clockwise as they are spooling cable/taking cable in, and clockwise as they are unspooling/releasing cable out.

Spool assembly (200) comprises a front spool (203), rear spool (202), and belt sprocket (201). The spool assembly (200) couples the belt (104) to the belt sprocket (201), and couples the two cables (500) and (501) respectively with front spool (203) and rear spool (202). Each of these components is part of a low profile design in depth. In one embodiment, a dual motor configuration not shown in FIG. 1B is used to drive each cable (500) and (501). In the example shown in FIG. 1B, a single motor (100) is used as a single source of tension, with a plurality of gears configured as a differential are used to allow the two cables/actuators to be operated independently or in tandem. In one embodiment, spools (202) and (203) are directly adjacent to sprocket (201), thereby minimizing the profile of the machine in FIG. 1B.

As shown in FIG. 1B, two arms (700, 702), two cables (500, 501) and two spools (202, 203) are useful for users with two hands, and the principles disclosed without limitation may be extended to three, four, or more arms (700) for quadrupeds and/or group exercise. In one embodiment, the plurality of cables (500, 501) and spools (202, 203) are driven by one sprocket (201), one belt (104), and one motor (100), and so the machine (1000) combines the pairs of devices associated with each user hand into a single device.

In one embodiment, motor (100) should provide constant tension on cables (500) and (501) despite the fact that each of cables (500) and (501) may move at different speeds. For example, some physical exercises may require use of only one cable at a time. For another example, a user may be stronger on one side of their body than another side, causing differential speed of movement between cables (500) and (501). In one embodiment, a device combining dual cables (500) and (501) for single belt (104) and sprocket (201), should retain a low profile, in order to maintain the compact nature of the machine, which can be mounted on a wall.

In one embodiment, pancake style motor(s) (100), sprocket(s) (201) and spools (202, 203) are manufactured and arranged in such a way that they physically fit together within the same space, thereby maximizing functionality while maintaining a low profile.

As shown in FIG. 1B, spools (202) and (203) are respectively coupled to cables (500) and (501) that are wrapped around the spools. The cables (500) and (501) route through the system to actuators (800) and (801), respectively.

The cables (500) and (501) are respectively positioned in part by the use of "arms" (700) and (702). The arms (700) and (702) provide a framework for which pulleys and/or pivot points may be positioned. The base of arm (700) is at arm slider (401) and the base of arm (702) is at arm slider (403).

The cable (500) for a left arm (700) is attached at one end to actuator (800). The cable routes via arm slider (401) where it engages a pulley as it changes direction, then routes along the axis of rotation of track (400). At the top of track (400), fixed to the frame rather than the track is pulley (303) that orients the cable in the direction of pulley (300), that further orients the cable (500) in the direction of spool (202), wherein the cable (500) is wound around spool (202) and attached to spool (202) at the other end.

Similarly, the cable (501) for a right arm (702) is attached at one end to actuator (601). The cable (501) routes via slider (403) where it engages a pulley as it changes direction, then routes along the axis of rotation of track (402). At the top of the track (402), fixed to the frame rather than the track is pulley (302) that orients the cable in the direction of pulley (301), that further orients the cable in the direction of spool (203), wherein the cable (501) is wound around spool (203) and attached to spool (203) at the other end.

One important use of pulleys (300, 301) is that they permit the respective cables (500, 501) to engage respective spools (202, 203) "straight on" rather than at an angle, wherein "straight on" references being within the plane perpendicular to the axis of rotation of the given spool. If the given cable were engaged at an angle, that cable may bunch up on one side of the given spool rather than being distributed evenly along the given spool.

Figure 1C:
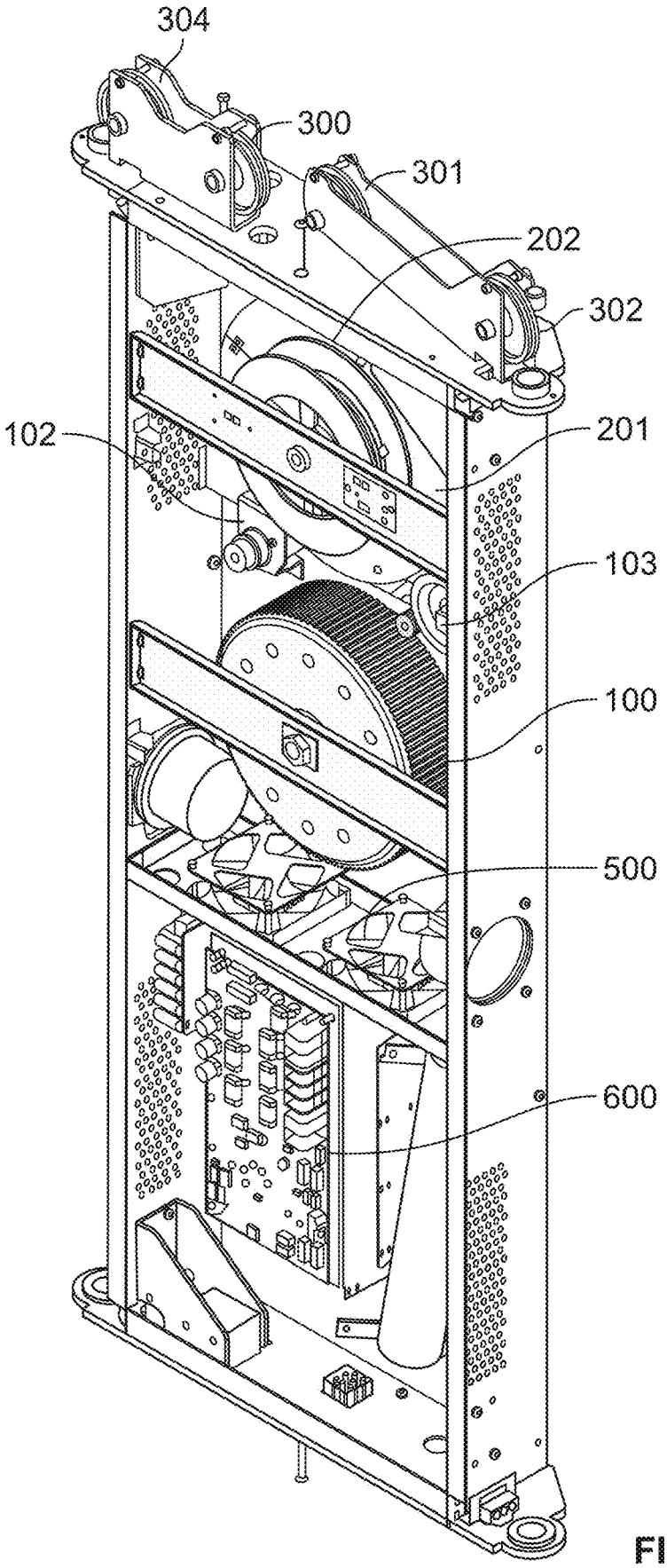
FIG. 1C illustrates a perspective view of the system of FIG. 1B wherein for clarity arms, cables, and belts are omitted.
Figure 1D:
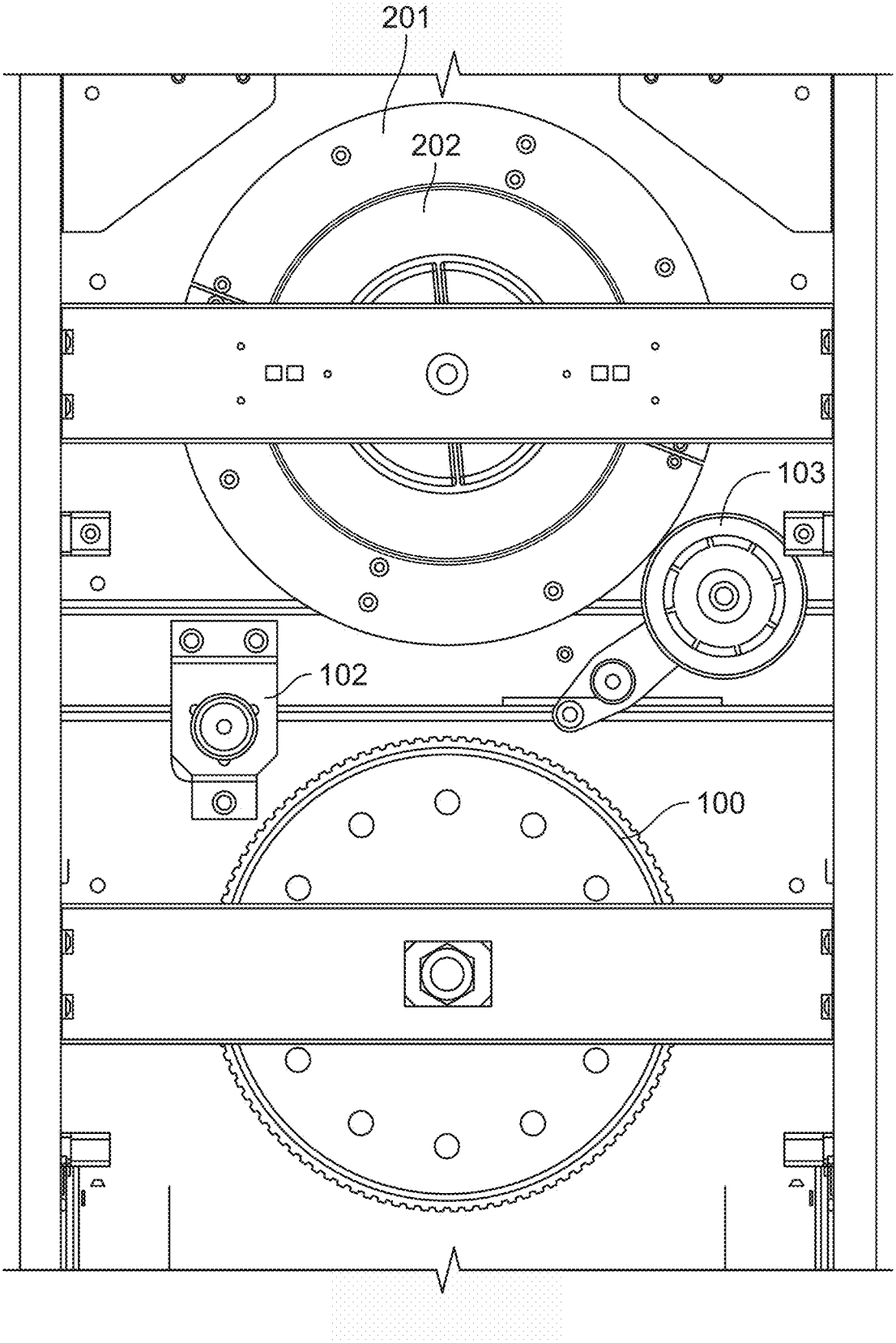
FIG. 1D illustrates a front view of the system of FIG. 1B.
Figure 1E:
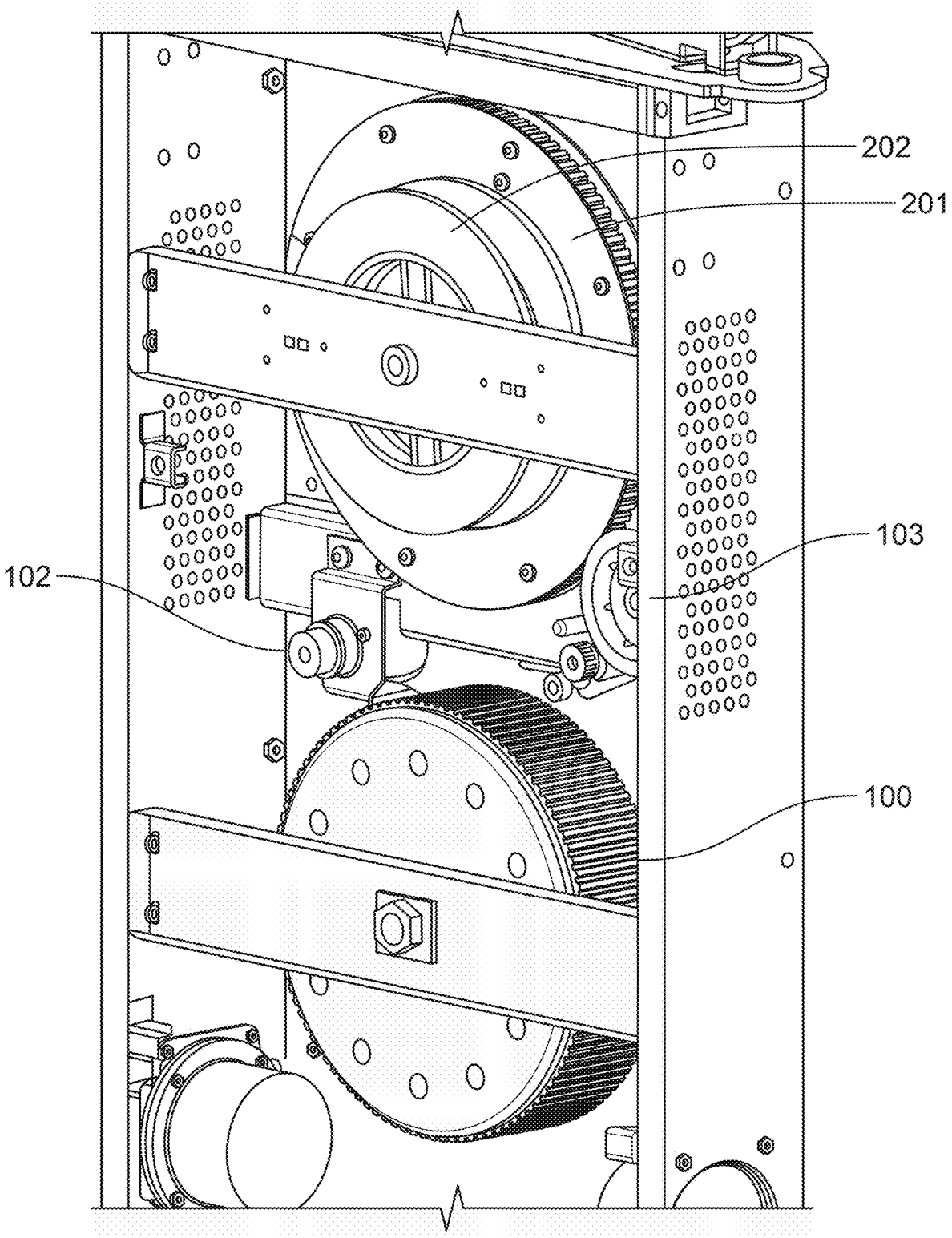
FIG. 1E illustrates a perspective view of the drivetrain of FIG. 1B.

In the example shown in FIG. 1B, pulley (301) is lower than pulley (300). This is not necessary for any functional reason but demonstrates the flexibility of routing cables. In a preferred embodiment, mounting pulley (301) lower leaves clearance for certain design aesthetic elements that make the machine appear to be thinner. FIG. 1C illustrates a perspective view of the system of FIG. 1B wherein for clarity arms, cables, and belts are omitted. FIG. 1D illustrates a front view of the system of FIG. 1B. FIG. 1E illustrates a perspective view of the drivetrain of FIG. 1B.

Figure 2A:
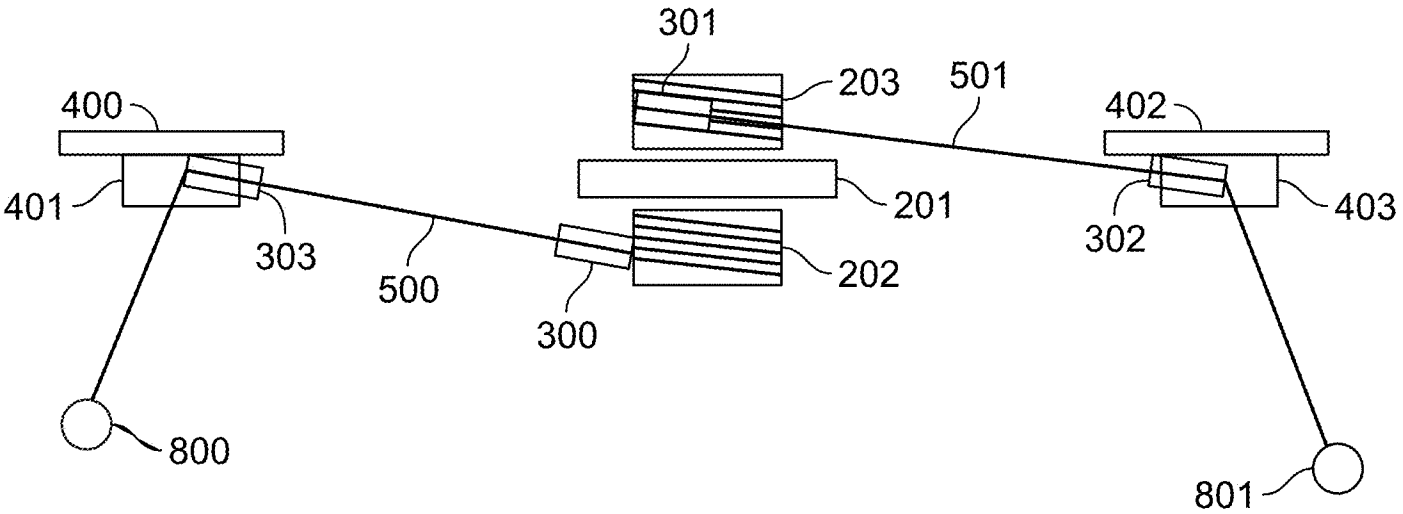
FIG. 2A illustrates a top view of one embodiment of an exercise machine.

FIG. 2A illustrates a top view of one embodiment of an exercise machine. In one embodiment, the top of view of FIG. 2A is that of the system shown in FIG. 1B. As long as motor torque is in the counter-clockwise direction, a cable is under tension. The amount of tension is directly proportional to the torque generated by the motor, based on a factor that includes the relative diameters of the motor (100), sprocket (201), and spools (202) and (203). If the force pulling on a cable overcomes the tension, the respective spool will unspool releasing cable, and hence the spool will rotate clockwise. If the force is below the tension, then the respective spool will spool take in cable, and hence the spool will rotate counter-clockwise.

When the motor is being back-driven by the user, that is when the user is retracting the cable, but the motor is resisting, and the motor is generating power. This additional power may cause the internal voltage of the system to rise. The voltage is stabilized to prevent the voltage rising indefinitely causing the system to fail or enter an unsafe state. In one embodiment, power dissipation is used to stabilize voltage, for example to burn additional power as heat.

Figure 2B:
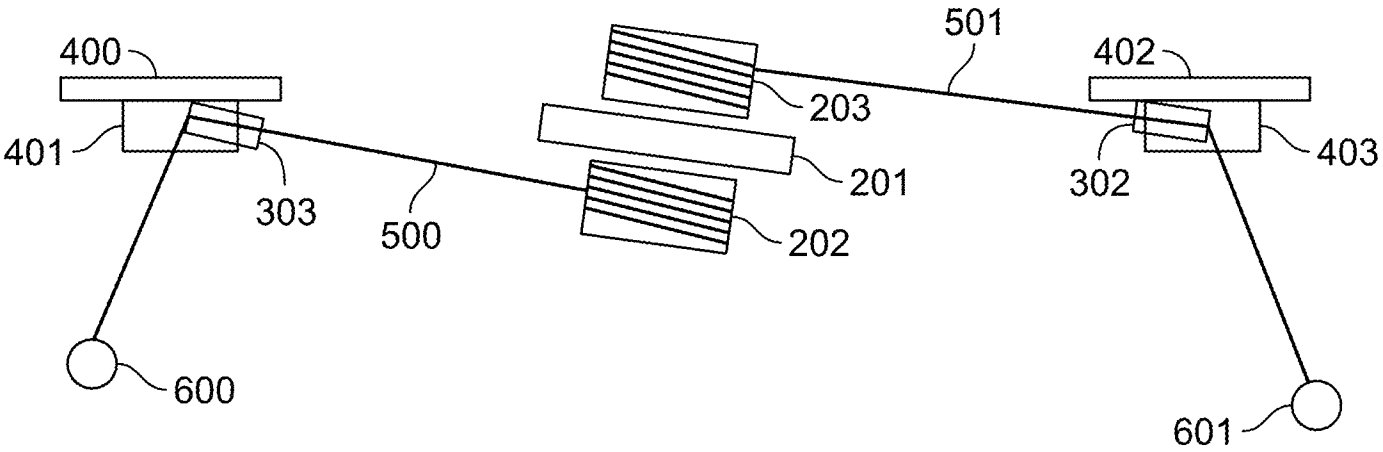
FIG. 2B illustrates a top view of an alternate embodiment of an exercise machine.

FIG. 2B illustrates a top view of an alternate embodiment of an exercise machine. As shown in FIG. 2B, pulleys (300) and (301) may be eliminated by rotating and translating the dual-spool assembly. The ideal location of the dual-spool assembly would be placed such that the cable route from both spools to the respective pulleys (302) and (303) is straight-on. Eliminating these pulleys both reduces system friction and reduces cost with the tradeoff of making the machine (1000) thicker, that is, less shallow from front to back.

Figure 3A:
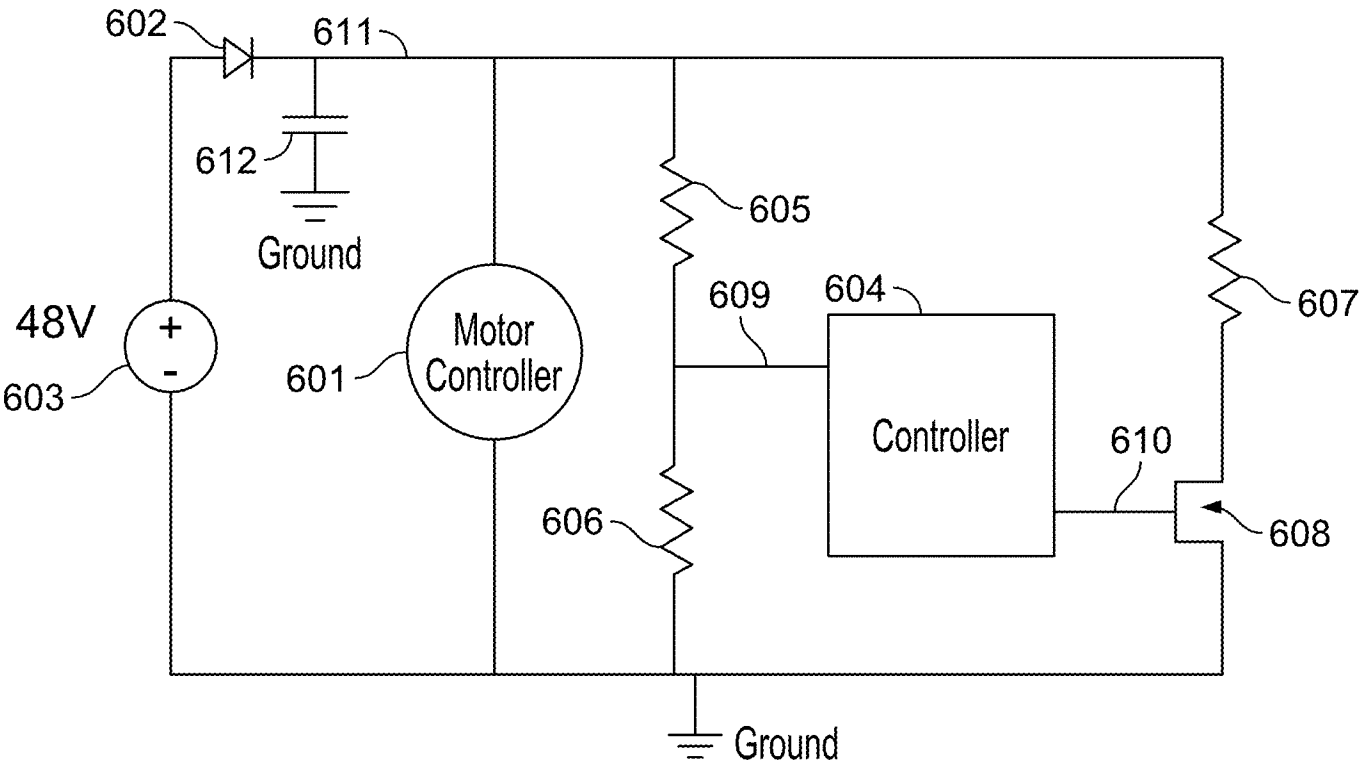
FIG. 3A is a circuit diagram of an embodiment of a voltage stabilizer.

Voltage Stabilization. FIG. 3A is a circuit diagram of an embodiment of a voltage stabilizer. The stabilizer includes a power supply (603) with protective element (602) that provides system power. Such a system may have an intrinsic or by-design capacitance (612). A motor controller (601), which includes the motor control circuits as well as a motor that consumes or generates power is coupled to power supply (603). A controller circuit (604) controls a FET transistor (608) coupled to a high-wattage resistor (607) as a switch to stabilize system power. A sample value for resistor (607) is a 300 W resistor/heater. A resistor divider utilizing a resistor network (605) and (606) is arranged such that the potential at voltage test point (609) is a specific fraction of system voltage (611). When FET (608) is switched on, power is burned through resistor (607). The control signal to the gate of FET (610) switches it on and off. In one embodiment, this control signal is pulse width modulated (PWM) switching on and off at some frequency. By varying the duty cycle and/or percentage of time on versus off, the amount of power dissipated through the resistor (607) may be controlled. Factors to determine a frequency for the PWM include the frequency of the motor controller, the capabilities of the power supply, and the capabilities of the FET. In one embodiment, a value in the range of 15-20 KHz is appropriate.

Controller (604) may be implemented using a micro-controller, micro-processor, discrete digital logic, any programmable gate array, and/or analog logic, for example analog comparators and triangle wave generators. In one embodiment, the same microcontroller that is used to implement the motor controller (601) is also used to implement voltage stabilization controller (604).

In one embodiment, a 48 Volt power supply (603) is used. The system may be thus designed to operate up to a maximum voltage of 60 Volts. In one embodiment, the Controller (604) measures system voltage, and if voltage is below a minimum threshold of 49 Volts, then the PWM has a duty cycle of 0%, meaning that the FET (610) is switched off. If the motor controller (601) generates power, and the capacitance (612) charges, causing system voltage (611) to rise above 49 Volts, then the controller (601) will increase the duty cycle of the PWM. If the maximum operating voltage of the system is 60 Volts, then a simple relationship to use is to pick a maximum target voltage below the 60 Volts, such as 59 Volts, so that at 59 Volts, the PWM is set to a 100% duty cycle. Hence, a linear relationship of PWM duty cycle is used such that the duty cycle is 0% at 49 Volts, and 100% at 59 Volts. Other examples of relationships include: a non-linear relationship; a relationship based on coefficients such as one representing the slope of a linear line adjusted by a PID loop; and/or a PID loop directly in control of the duty cycle of the PWM.

In one embodiment, controller (604) is a micro-controller such that 15,000 times per second an analog to digital converter (ADC) measures the system voltage, invokes a calculation to calculate the PWM duty cycle, then outputs a pulse with a period corresponding to that duty cycle.

Figure 3B:
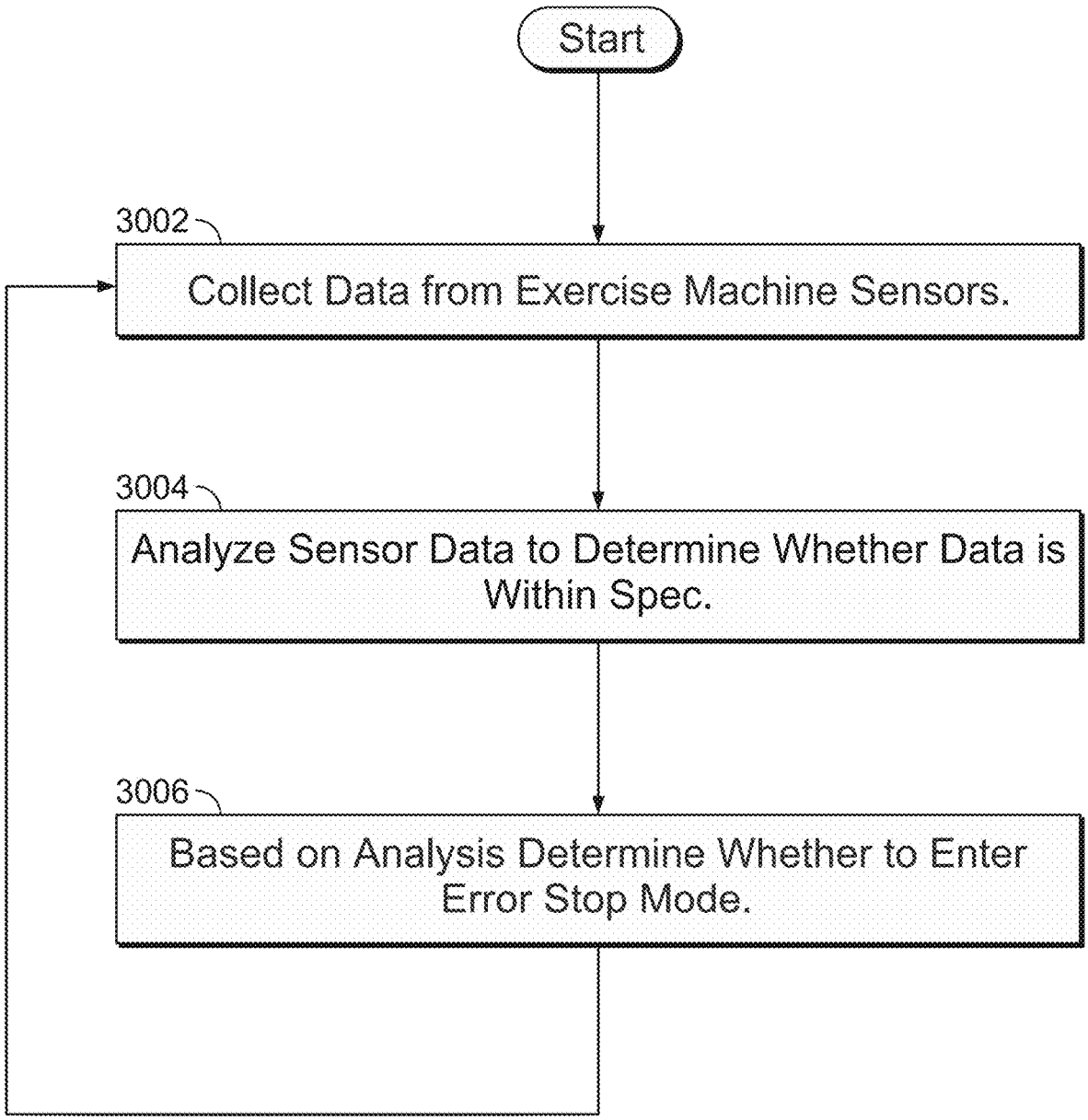
FIG. 3B is a flowchart illustrating an embodiment of a process for a safety loop for an exercise machine.

Safety. Safety of the user and safety of the equipment is important for an exercise machine. In one embodiment, a safety controller uses one or more models to check system behavior, and place the system into a safe-stop, also known as an error-stop mode or ESTOP state to prevent or minimize harm to the user and/or the equipment. A safety controller may be a part of controller (604) or a separate controller (not shown in FIG. 3A). A safety controller may be implemented in redundant modules/controllers/subsystems and/or use redundancy to provide additional reliability. FIG. 3B is a flowchart illustrating an embodiment of a process for a safety loop for an exercise machine.

Depending on the severity of the error, recovery from ESTOP may be quick and automatic, or require user intervention or system service.

In step 3002, data is collected from one or more sensors, examples including:

1) Rotation of the motor (100) via Hall sensors within the motor;
2) Rotation of the motor (100) via an encoder (103) coupled to the belt;
3) Rotation of each of the two spools (202, 203);
4) Electrical current on each of the phases of the three-phase motor (100);
5) Accelerometer mounted to the frame;
6) Accelerometer mounted to each of the arms (400, 402);
7) Motor (100) torque;
8) Motor (100) speed;
9) Motor (100) voltage;
10) Motor (100) acceleration;
11) System voltage (611);
12) System current; and/or
13) One or more temperature sensors mounted in the system.

In step 3004, a model analyzes sensor data to determine if it is within spec or out of spec, including but not limited to:

1) The sum of the current on all three leads of the three-phase motor (100) should equal zero;
2) The current being consumed by the motor (100) should be directly proportional to the torque being generated by the motor (100). The relationship is defined by the motor's torque constant;
3) The speed of the motor (100) should be directly proportional to the voltage being applied to the motor (100). The relationship is defined by the motor's speed constant;
4) The resistance of the motor (100) is fixed and should not change;
5) The speed of the motor (100) as measured by an encoder, back EMF voltage, for example zero crossings, and Hall sensors should all agree;
6) The speed of the motor (100) should equal the sum of the speeds of the two spools (202, 203);
7) The accelerometer mounted to the frame should report little to no movement. Movement may indicate that the frame mount has come loose;
8) System voltage (611) should be within a safe range, for example as described above, between 48 and 60 Volts;
9) System current should be within a safe range associated with the rating of the motor;
10) Temperature sensors should be within a safe range;
11) A physics model of the system may calculate a safe amount of torque at a discrete interval in time continuously. By measuring cable speed and tension, the model may iteratively predict what amount of torque may be measured at the motor (100). If less torque than expected is found at the motor, this is an indication that the user has released one or more actuators (800,801); and/or 12) The accelerometer mounted to the arms (400, 402) should report little to no movement. Movement would indicate that an arm has failed in some way, or that the user has unlocked the arm.

In step 3006, if a model has been determined to be violated, the system may enter an error stop mode. In such an ESTOP mode, depending on the severity, it may respond with one or more of:

1) Disable all power to the motor;
2) Disable the main system power supply, relying on auxiliary supplies to keep the processors running;
3) Reduce motor torque and/or cable tension to a maximum safe value, for example the equivalent of torque that would generate 5 lbs of motor tension; and/or
4) Limit maximum motor speed, for example the equivalent of cable being retracted at 5 inches per second.

Figure 4:
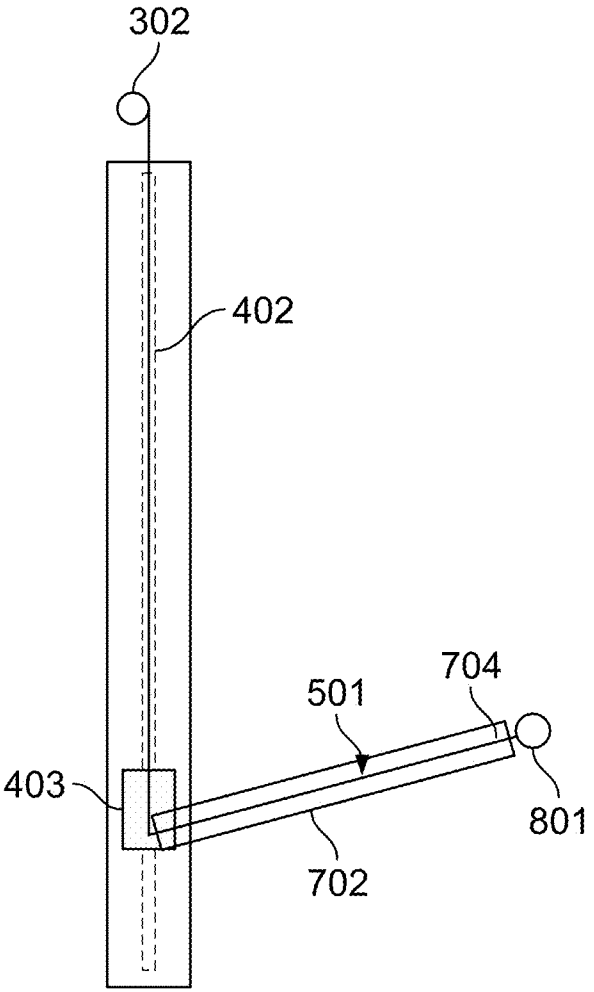
FIG. 4 is an illustration of arms in one embodiment of an exercise machine.

Arms. FIG. 4 is an illustration of arms in one embodiment of an exercise machine. An exercise machine may be convenient and more frequently used when it is small, for example to fit on a wall in a residential home. As shown in FIG. 4, an arm (702) provides a way to position a cable (501) to provide a directional resistance for a user's exercise, for example if the arm (702) positions the cable user origination point/exertion point (704) near the ground, by pulling up on actuator (801) the user may perform a bicep curl exercise or an upright row exercise. Likewise, if the arm (702) positions cable user origination point/exertion point (704) above the user, by pulling down on actuator (801) the user may perform a lat pulldown exercise.

Traditionally, exercise machines utilize one or more arms pivoting in the vertical direction to offer adjustability in the vertical direction. However, to achieve the full range of adjustability requires long arms. If a user wishes to have 8 feet of adjustment such that the tip of the arm may be above the user 8 feet off the ground, or at a ground position, then a 5 foot arm may be required to be practical. This is inconvenient because it requires more space to pivot the arm, and limits the number of places where such a machine can be placed. Furthermore, a longer arm undergoes higher lever-arm forces and increases the size and complexity of the joint in order to handle those larger forces. If arms could be kept under three feet in length, a machine may be more conveniently placed and lever-arm forces may be more reasonable.

FIG. 4 shows arm (702) connected to slider (403) on track (402). Without limitation, the following discussion is equally applicable to arm (700) connected to slider (401) and track (400) in FIG. 1B. Note that as shown in FIG. 4, cable (501) travels within arm (702). For clarity, cable (501) is omitted from some of the following figures and discussion that concern the arm (702) and its movement.

An arm (702) of an exercise machine capable of moving in different directions and ways is disclosed. Three directions and ways include: 1) translation; 2) vertical pivot; and 3) horizontal pivot.

Translation. In one embodiment, as shown in FIG. 4, arm (702) is capable of sliding vertically on track (402), wherein track (402) is between 24 and 60 inches, for example 42 inches in height. Arm (702) is mounted to slider (403) that slides on track (402). This is mirrored on the other side of the machine with slider (401) on track (400).

Figure 5B:
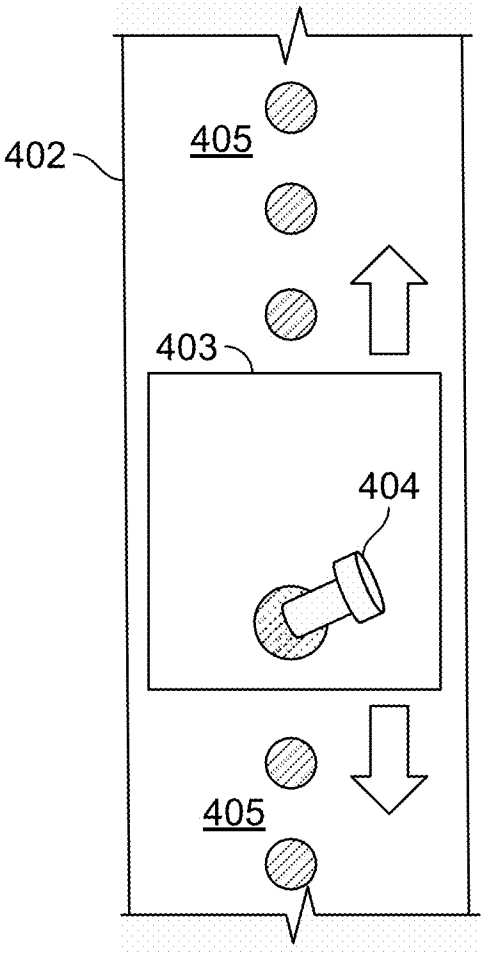
FIG. 5B is an illustration of an unlocked position for an arm.
Figure 5A:
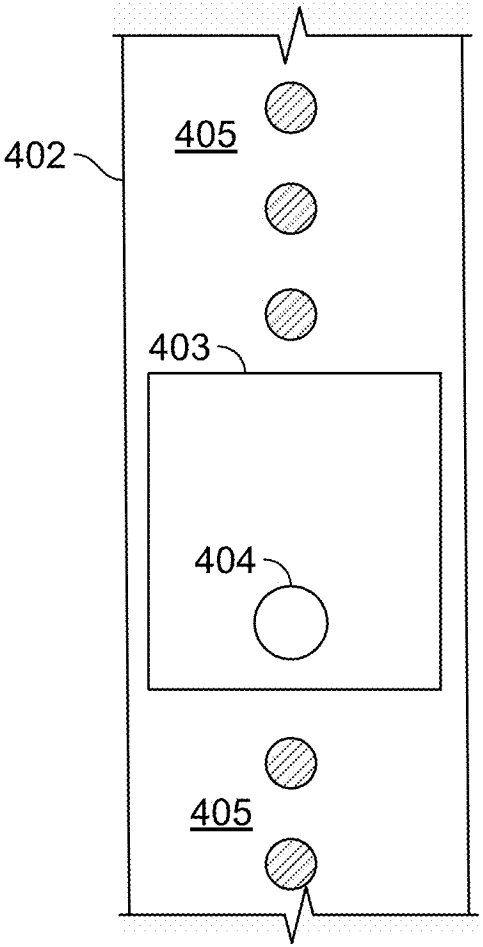
FIG. 5A is an illustration of a locked position for an arm.

As shown in FIG. 1B, slider (401) is at a higher vertical position than right slider (403), so the base of arm (700) is higher than that of arm (702). FIGS. 5A and 5B show how an arm (702) can be moved up and down in a vertical direction.

FIG. 5A is an illustration of a locked position for an arm. In FIG. 5A, pin (404), within slider (403), is in a locked position. This means that the end of pin (404) is located within one of a set of track holes (405). Pin (404) may be set in this position through different means, including manual pushing, spring contraction, and electrically driven motion.

FIG. 5B is an illustration of an unlocked position for an arm. In FIG. 5B, pin (404) has been retracted for track holes (405). This enables slider (403) to move up or down track (402), which causes arm (702) to move up or down. In one embodiment, the user manually moves slider (403). In an alternate embodiment, the motor uses cable tension and gravity to move sliders up and down to desired positions.

Sliding the slider (403) up and down track (402) physically includes the weight of the arm (702). The arm (702), being between 2 and 5 feet long, for example 3 feet long, and for example made of steel, may weigh between 6 and 25 lbs, for example 10 lbs. This may be considered heavy by some users to carry directly. In one embodiment, motor (100) is configured to operate in an 'arm cable assist' mode by generating a tension matching the weight of the arm (702) on the slider (403), for example 10 lbs on cable (501), and the user may easily slide the slider (403) up and down the track without perceiving the weight of the arms.

The exercise machine is calibrated such that the tension on the cable matches the weight of the slider, so the user perceives none of the weight of the arm. Calibration may be achieved by adjusting cable tension to a level such that the slider (403) neither rises under the tension of the cable (501), or falls under the force of gravity. By increasing or reducing motor torque as it compares to that used to balance gravity, the slider may be made to fall lower, or raise higher.

Placing the motor (100) and dual-spool assembly (200) near the top of the machine as shown in FIG. 1B is disclosed. An alternate design may place heavy components near the bottom of the machine, such that cables (500) and (501) are routed from the bottom to the sliders which would conceal cables and pulleys from the user. By placing heavier components near the top of the machine, routing cables from the top of the machine and columns down to the slider allows cable tension to offset the effect of gravity. This allows motor torque to be utilized to generate cable tension that allows the user to not perceive the weight of the arms and slider without an additional set of pulleys to the top of a column. This also allows motor torque to be utilized to move the slider and arms without the intervention of the user.

Vertical Pivot. In addition to translating up and down, the arms may pivot up and down, with their bases in fixed position, to provide a great range of flexibility in positioning the user origination point of a given arm. Keeping arm (702) in a fixed vertically pivoted position may require locking arm (702) with slider (403).

Figure 6:
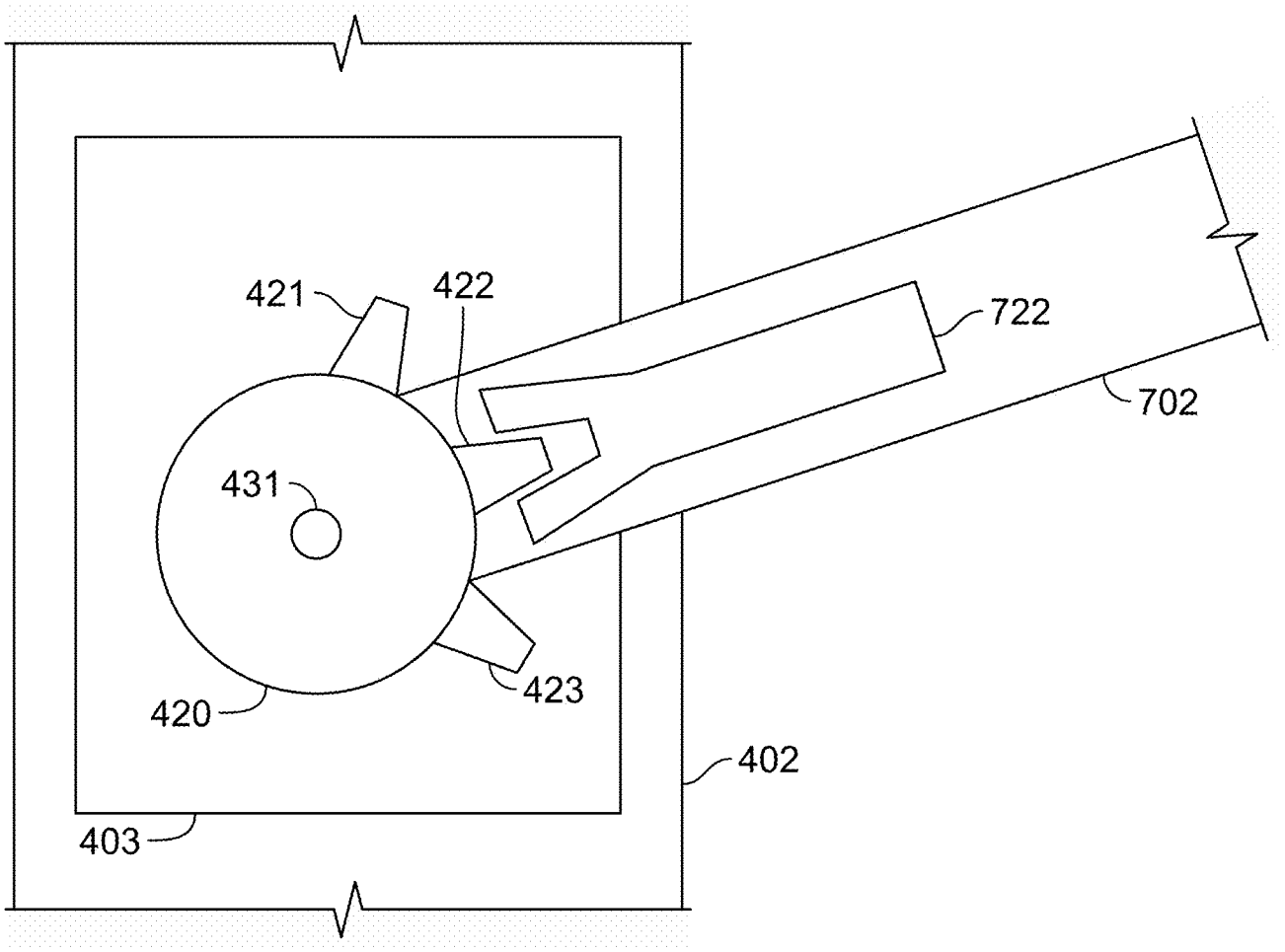
FIG. 6 is an illustration of an embodiment of a vertical pivot locking mechanism.

FIG. 6 is an illustration of an embodiment of a vertical pivot locking mechanism. In FIG. 6, slider (403) includes a part (420) that has teeth (422). Teeth (422) match female locking member (722) of arm (702).

Using trapezoidal teeth for locking is disclosed. The teeth (422) and matching female locking member (722) use a trapezoidal shape instead of a rectangular shape because a rectangular fitting should leave room for the teeth to enter the female locking member. Using a rectangular tooth causes "wiggle" in the locking joint, and this wiggle is leveraged at the end of arm (702). A trapezoidal set of teeth (422) to enter female locking mechanism (722) makes it simpler for the two members to be tightly coupled, minimizing joint wiggle.

Using a trapezoidal set of teeth increases the risk of the joint slipping/back-drive while under the stress of high loads. Empirically a slope of between 1 and 15 degrees, for example 5 degrees, minimizes joint slippage while maximizing ease of entry and tightening. The slope of the trapezoid is set such that the amount of back-drive force is lower than the amount of friction of the trapezoidal surfaces on one another.

Figure 7A:
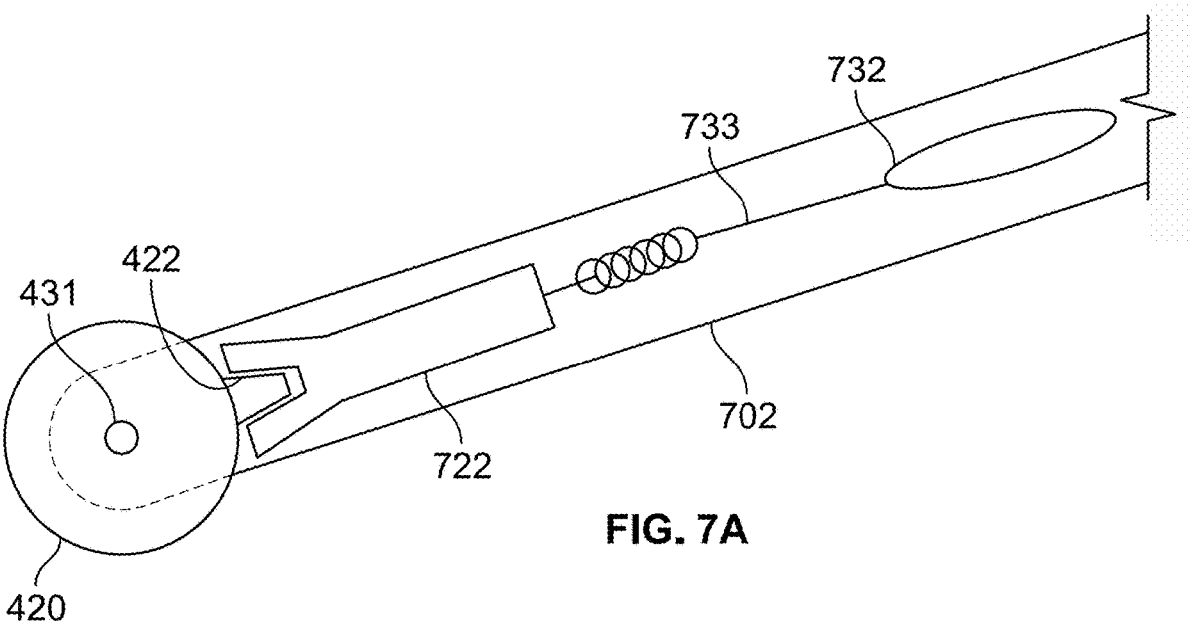
FIGS. 7A and 7B illustrate locking and unlocking for arm vertical pivoting.
Figure 7B:
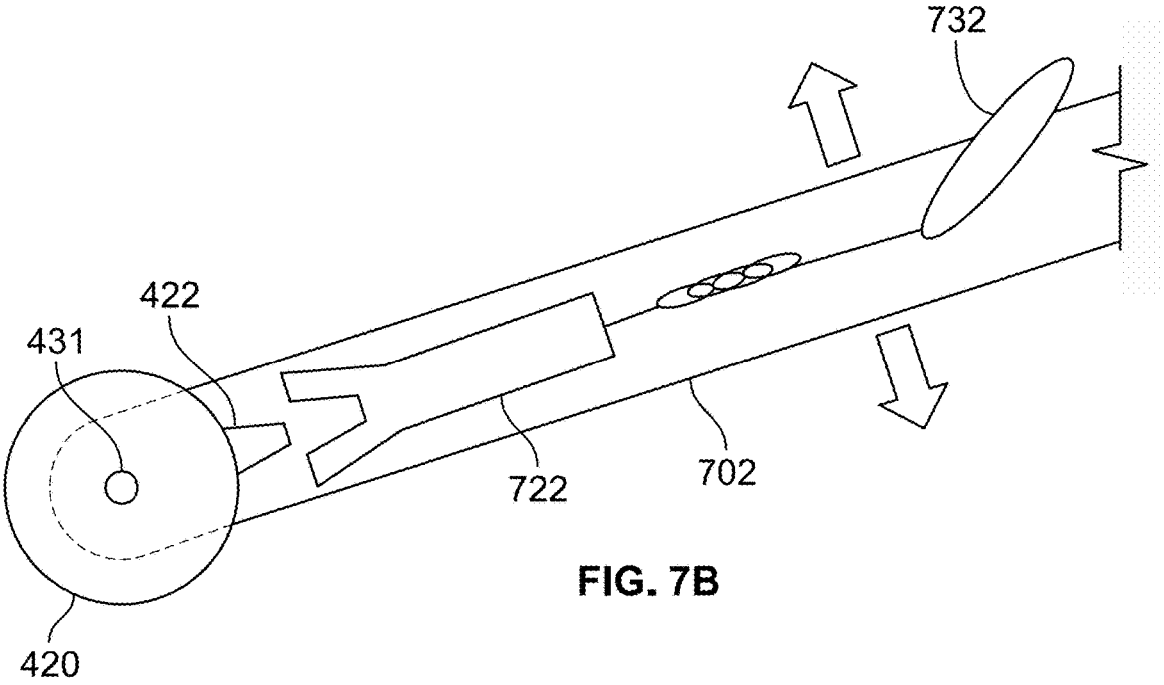

FIGS. 7A and 7B illustrate locking and unlocking for arm vertical pivoting. In FIG. 7A, arm (702) is locked into slider part (420). As shown in FIG. 7A, teeth (422) and female member (722) are tightly coupled. This tight coupling is produced by the force being produced by compressed spring (733).

In FIG. 7B a user unlocks arm (702). When the user pulls up on lever (732) of arm (702), this causes spring (733) to release its compression, thus causing female locking member (722) to pull backward, disengaging from teeth (422). With arm (702) thus disengaged, the user is free to pivot arm (702) up or down around hole (451). To lock arm (702) to a new vertically pivoted position, the user returns lever (732) to the flat position of FIG. 7A.

Alternate Vertical Pivot. In one embodiment, a rod-based lever and/or a squared tooth-gear geometry is used for teeth (422), at least in part to reduce a chance of getting "hung up" wherein the tooth (422) and locking member (722) do not completely interlock. A squared tooth-gear geometry may be used with other systems that reduce this chance including: a rod for user signal of tooth position, and a ball locking system.

Figure 7C:
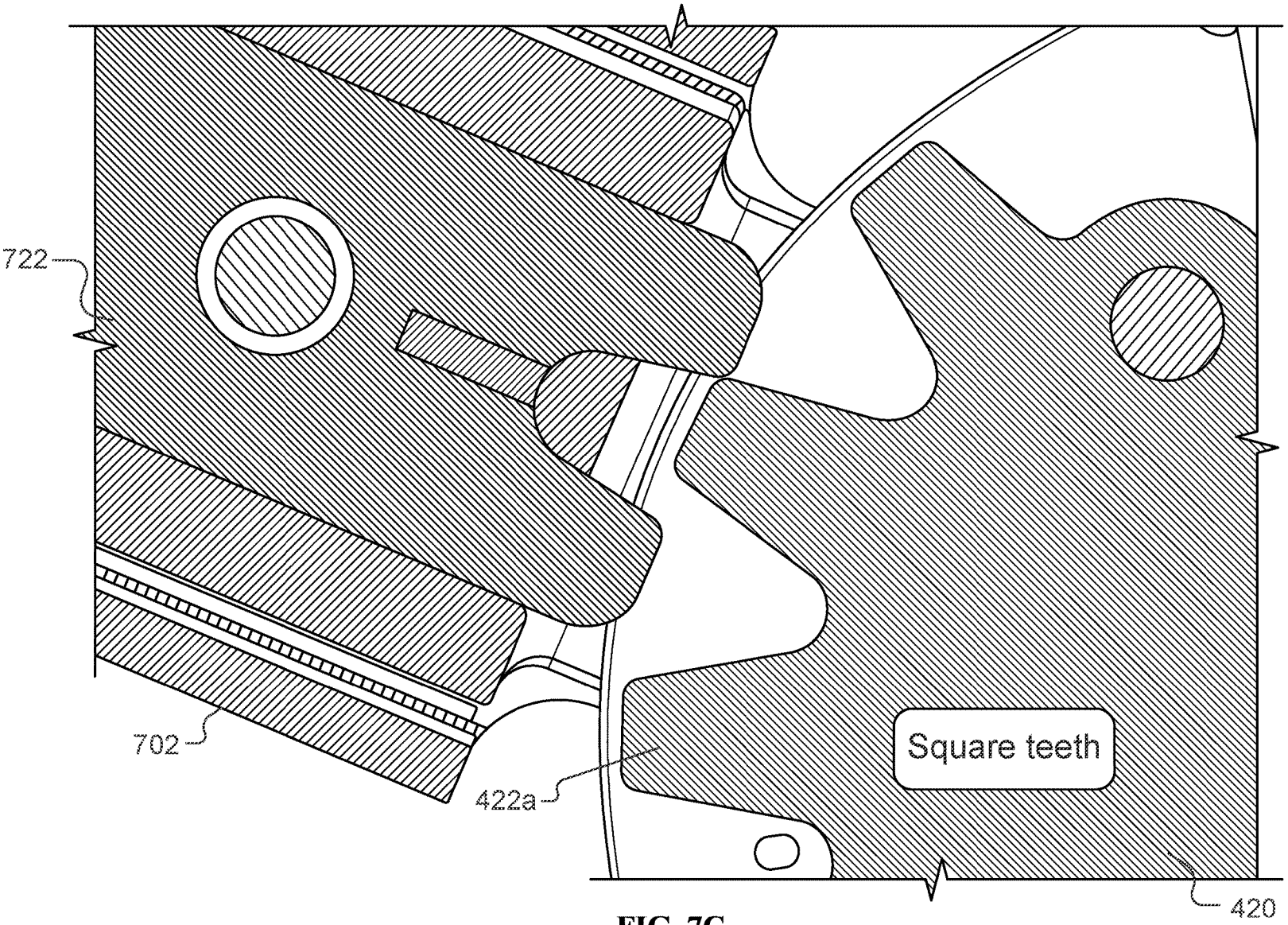
FIG. 7C illustrates squared tooth-gear geometry for arm vertical pivoting.

FIG. 7C illustrates squared tooth-gear geometry for arm vertical pivoting. In FIG. 7C, arm (702) is locked into a vertical pivot position at least in part as squared teeth (422*a*) and female member (722) are tightly coupled. In some cases, a shape of gear to rounded tooth interfaces (422) as shown in FIG. 7A provide roll-in lead-ins, which may afford a smooth sliding feeling when going into a vertical pivot position. The arm tooth (422) may rest on edges and the weight of the arm (702) may keep the spring from driving the tooth forward and/or arm angle up, and this may be more prevalent at upper angles.

The alternate use of squared teeth (422*a*) over the rounded teeth (422) reduces and/or removes lead-in geometries on tooth and gear. This reduces surface affordances for getting "hung up", and the tooth action is more "binary"; it is either completely in or completely out.

Figure 7D:
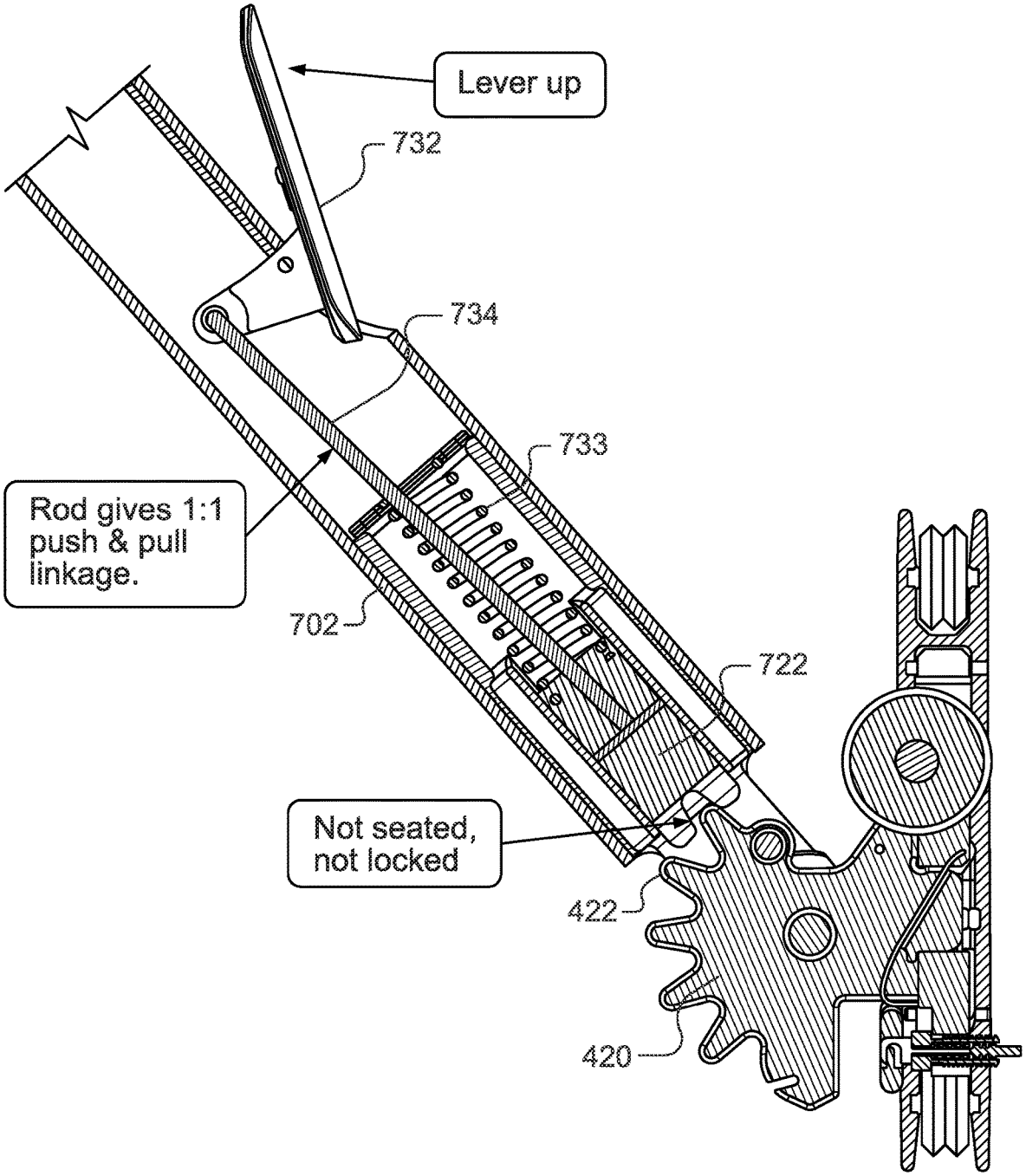
FIG. 7D illustrates a rod-based lever system for arm vertical pivoting.

FIG. 7D illustrates a rod-based lever system for arm vertical pivoting. In FIG. 7D, the arm (702) is shown in an unlocked position, where a rod (734) couples female locking member (722) and spring (733) with lever (732).

When the user pulls up on lever (732) of arm (702), the rod (734) pulls on spring (733) to release its compression, thus causing female locking member (722) to pull backward, disengaging from teeth (422) and slider (420). In one embodiment, squared teeth (422*a*) are used instead of the rounded teeth (422) shown in FIG. 7D.

With arm (702) thus disengaged, the user is free to pivot arm (702) up or down. To lock arm (702) to a new vertically pivoted position, the user positions the arm (702) until the teeth (422) mesh with member (722), the spring (733) compresses, and the rod (734) is pushed the lever (732) down in line with the arm (702). Because the rod (734) is a one-to-one push and pull linkage, the user has a physical cue that the arm is locked because the lever is down and inline with the arm (702).

Figure 7E:
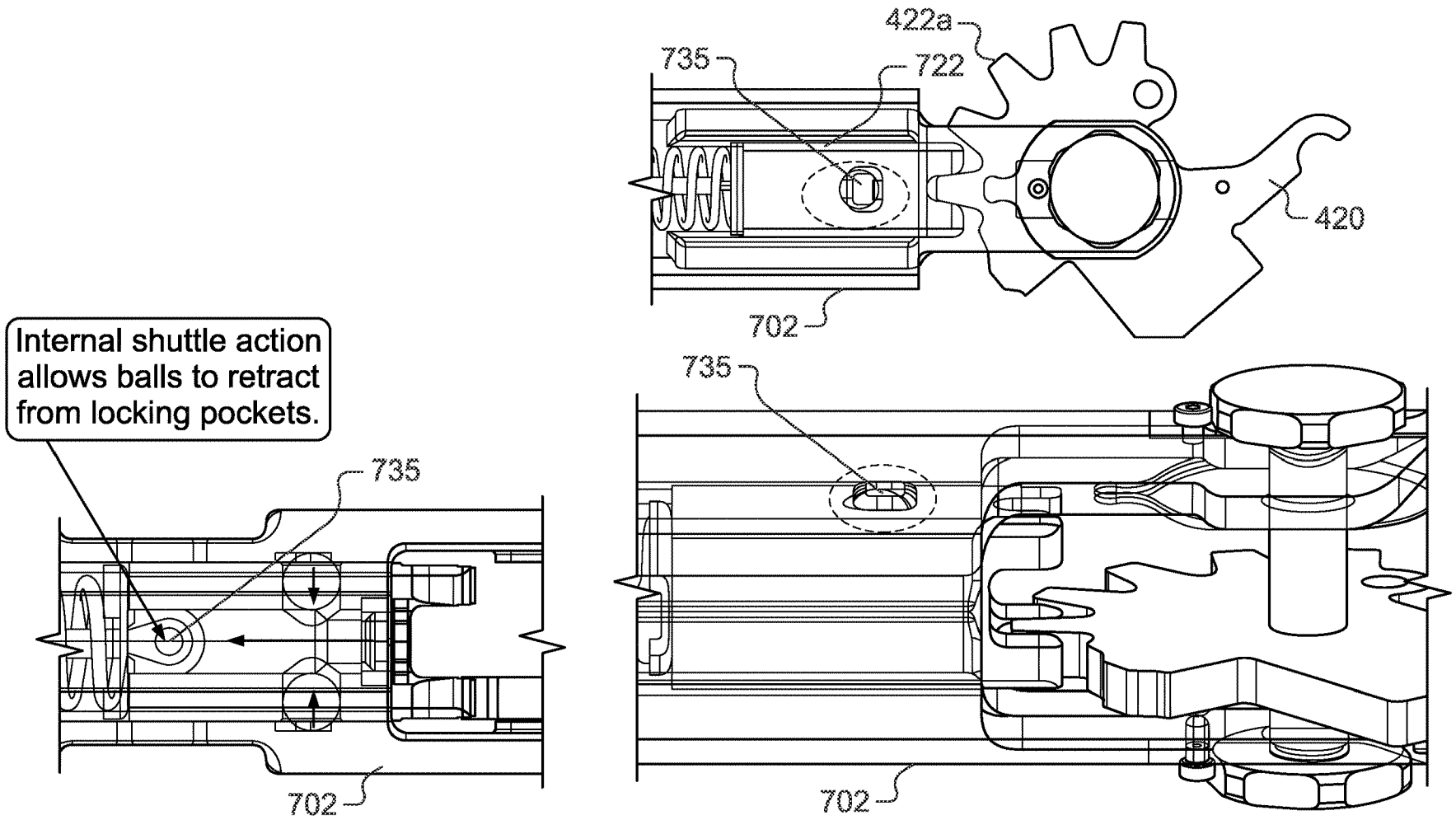
FIG. 7E illustrates a ball-locking system for arm vertical pivoting.

FIG. 7E illustrates a ball-locking system for arm vertical pivoting. In FIG. 7E, a side and top view is shown along with a perspective between side and top. The arm (702) is shown engaged with slider (420) by way of teeth (shown in FIG. 7E to be squared teeth (422*a*)) locked with member (722). A ball-lock (735) is used to mechanically lock tooth movement. An internal shuttle provides locking mechanism by allowing the ball to retract from a locking pocket. This provides a two-stage tooth action, to unlock and to move.

Without a system similar to a ball-locking system, certain movements down and with a side to side oscillation may produce small incremental movements of the tooth (422). Without a ball-lock, the spring (733) is primarily used to drive the tooth for engagement, and as an analogue system, the spring (733) pushes to force the interface surfaces. One issue that may arise is that even a small oscillation action of arm with constant down force may create a motion and loading situation that rock and racks the tooth back away from the gear.

Figure 7F:
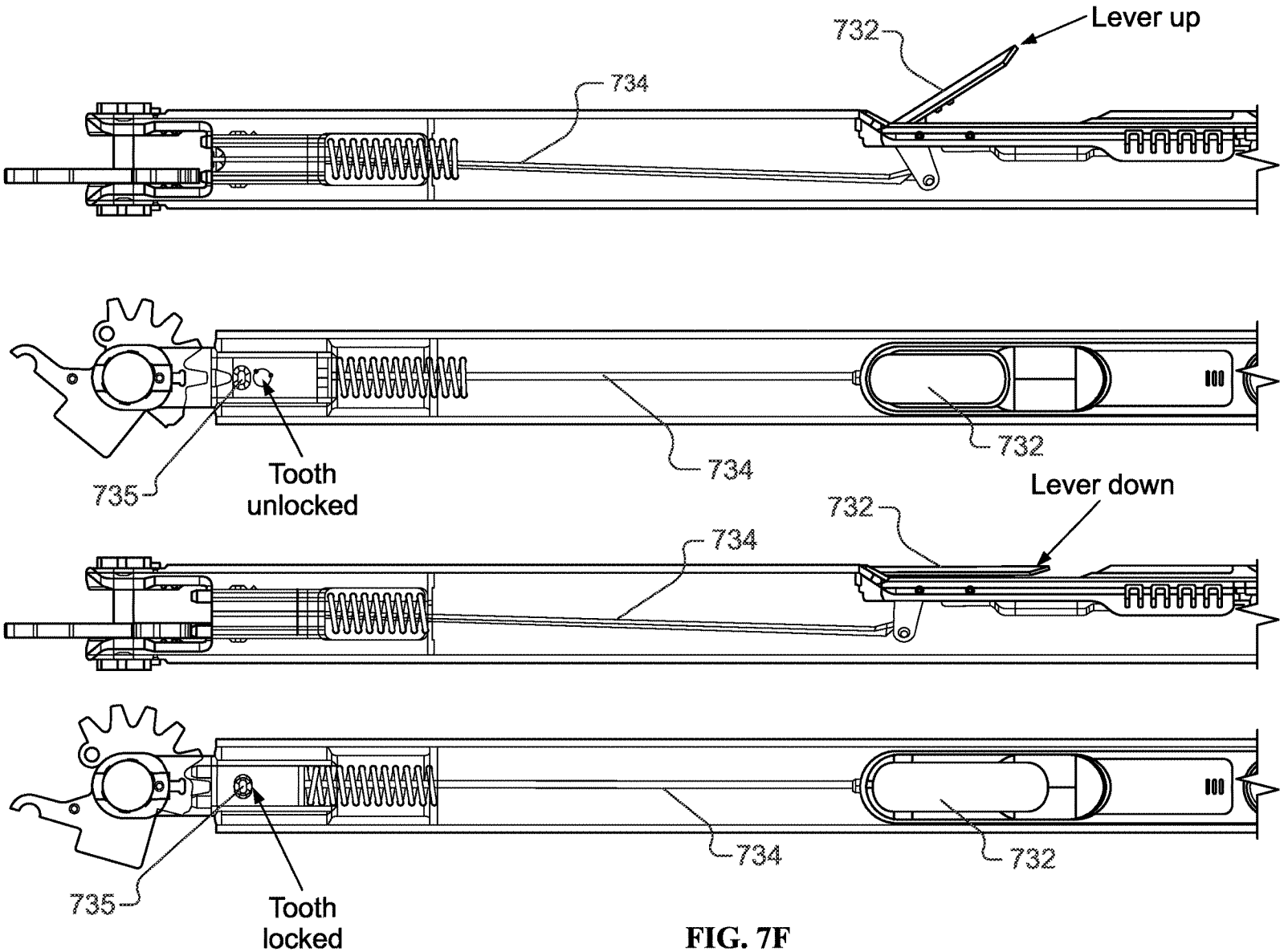
FIG. 7F illustrates a rod and ball-lock system for arm vertical pivoting.

FIG. 7F illustrates a rod and ball-lock system for arm vertical pivoting. In FIG. 7F, a side and top view is shown on the top when a lever (732) is up, and a side and top view is shown on the bottom when a lever (732) is down. In both cases, a rod (734) provides a one-to-one push-pull linkage to the ball-lock (735) mechanism. Thus, when the lever is up, the coupling unlocks the ball-lock and teeth (422). Alternately when the lever is seated, the coupling locks the ball-lock and teeth (422). Thus the lever changes to provide more stroke.

Horizontal Pivot. The arms may pivot horizontally around the sliders to provide user origination points for actuators (800,802) closer or further apart from each other for different exercises. In one embodiment, track (402) pivots, thus allowing arm (702) to pivot.

Figure 8B:
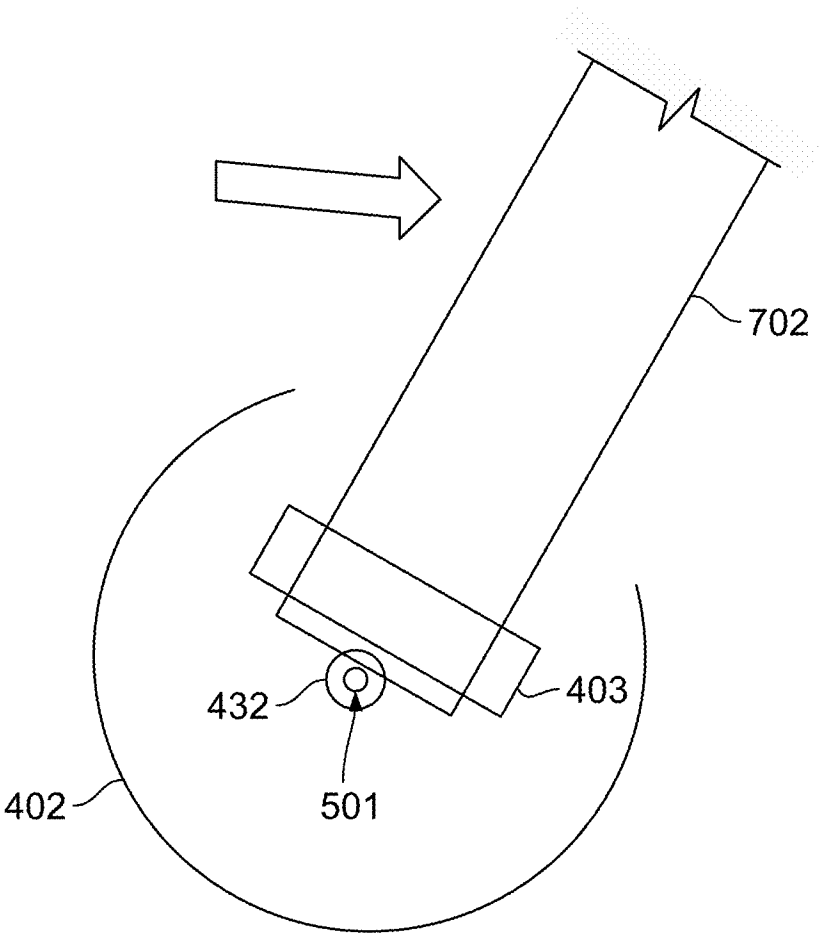
FIGS. 8A and 8B illustrate a top view of a track that pivots horizontally.
Figure 8A:
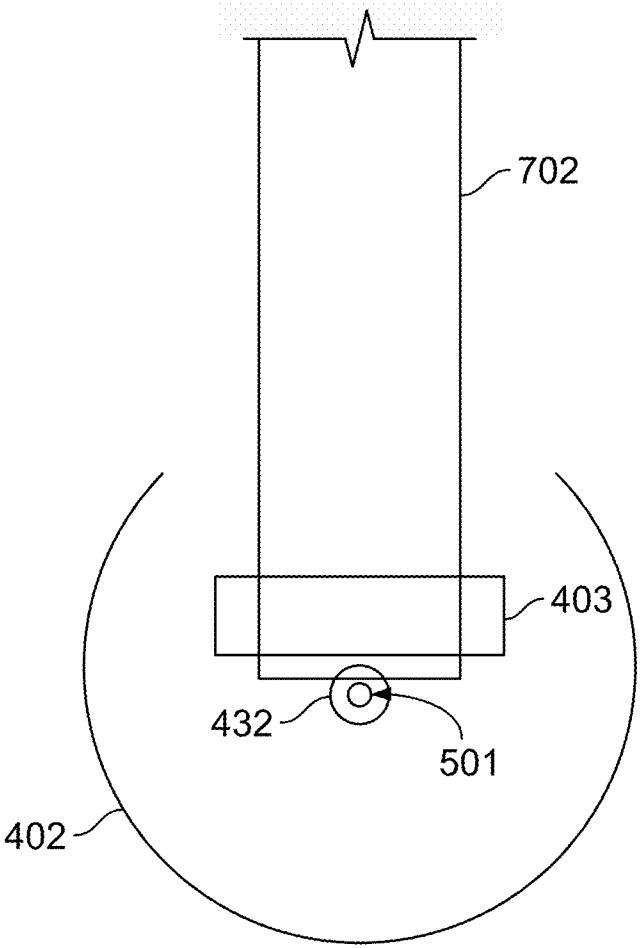

FIGS. 8A and 8B illustrate a top view of a track that pivots horizontally. In FIG. 8A, arm (702) is positioned straight out from the machine, in a 90 degree orientation to the face of the machine. Arm (702) may be locked to slider as shown in FIG. 7A. Further, slider (403) may be locked into track (402) as shown in FIG. 5A.

FIG. 8B shows all of track (402), slider (403), and arm (702) pivoted to the right around hole (432). The user may do this simply by moving the arm left or right when it is in an unlocked position.

Figure 9C:
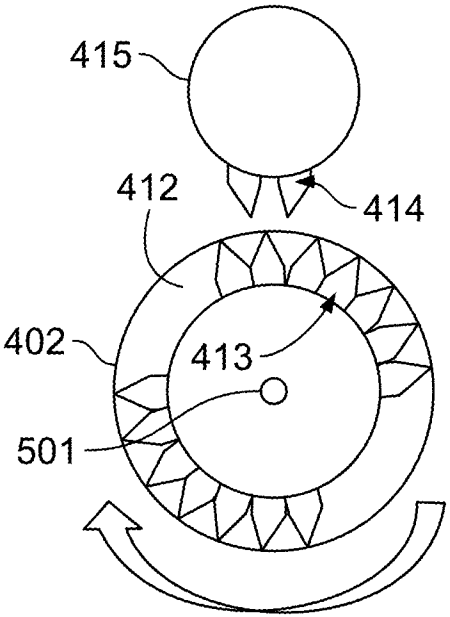
FIG. 9C shows device locking member (415) having been pulled back from top member (412).
Figure 9B:
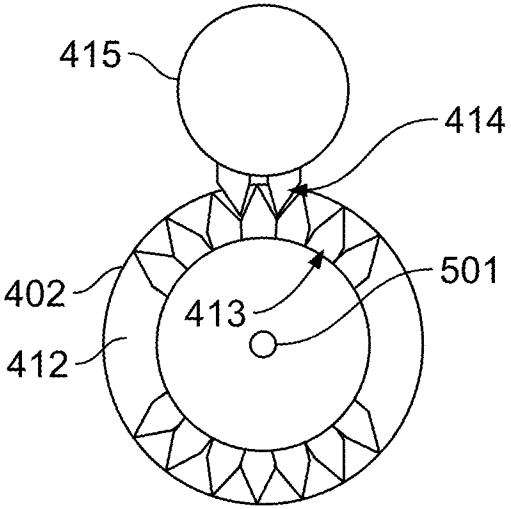
FIG. 9B shows a top view of arm (402).
Figure 9A:
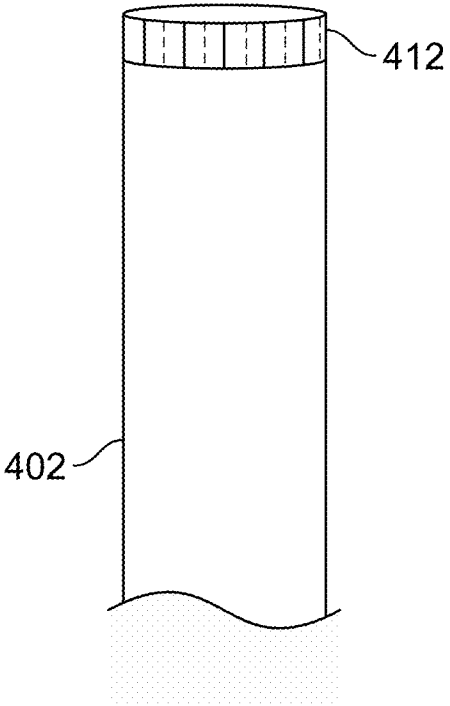
FIG. 9A shows column (402) from a side view.

FIGS. 9A, 9B, and 9C illustrate a locking mechanism for a horizontal pivot. FIG. 9A shows column (402) from a side view. This view shows top member (412). In one embodiment, the bottom of track 402 not shown in FIG. 9A has a corresponding bottom member (412*a*, not shown), with the same function and operation as top member (412).

FIG. 9B shows a top view of arm (402). This view shows that top member (412) and corresponding bottom member (412*a*) both have teeth (413). Teeth (413) can be placed around the entire circumference of top member (412), or just specific arcs of it corresponding to the maximum rotation or desired positions of track (402).

FIG. 9B shows track (402) in a locked position as the teeth (414) of a device locking member (415) are tightly coupled to teeth (413). This tight coupling prevents track (402), and thus arm (702) from pivoting left or right, horizontally.

FIG. 9C shows device locking member (415) having been pulled back from top member (412). In one embodiment, device locking member (415) uses a similar compression spring mechanism as shown in FIGS. 7A and 7B. This, together with the pulling back for bottom member (412*a*), frees up track (402) to rotate freely around cable (501). To do this, the user simply rotates arm (702) left or right, as desired. In one embodiment, a mechanism is used to permit the simultaneous unlocking and locking of top/bottom members (412, 412*a*).

Figure 9E:
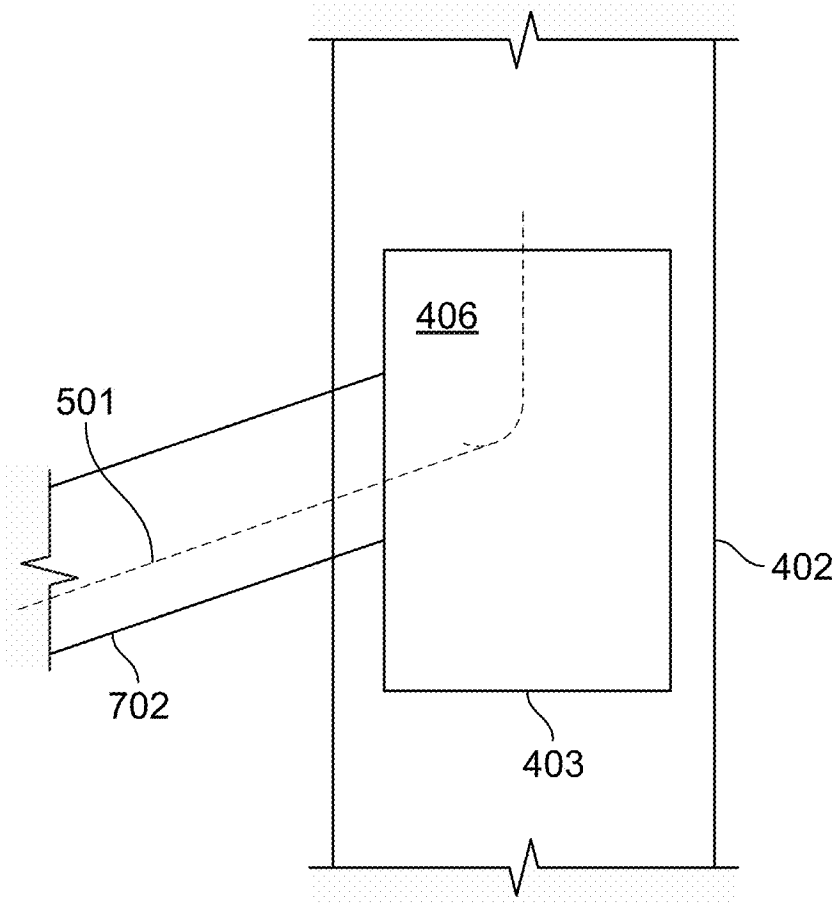
FIG. 9E shows the front view, now with arm (702) traveling down and to the left.
Figure 9D:
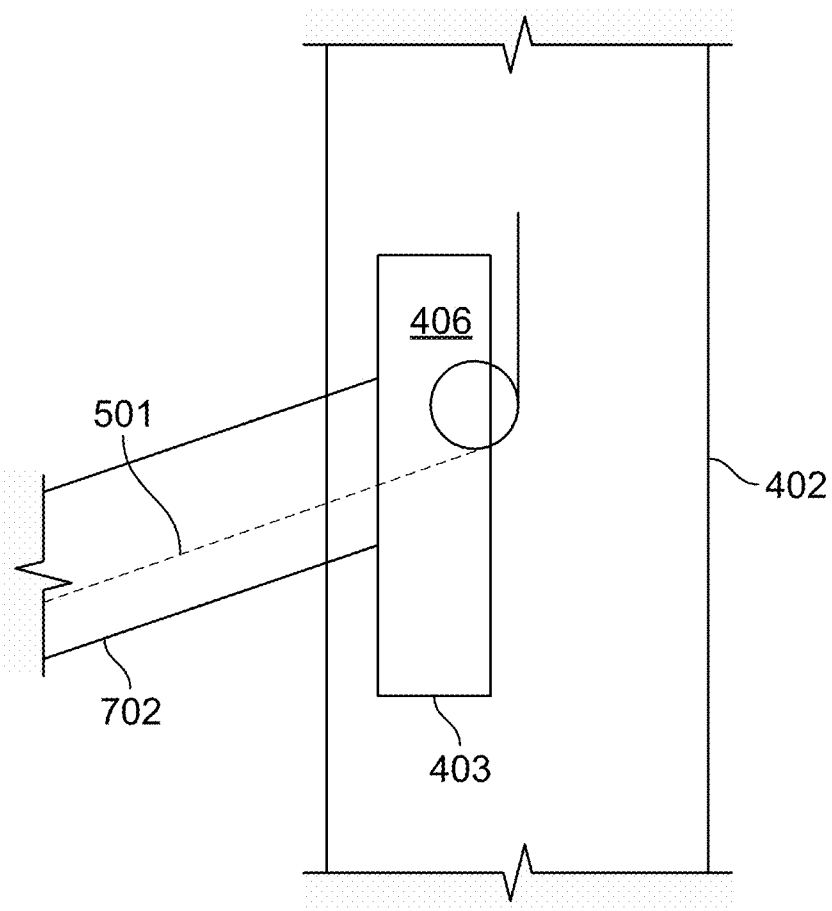
FIG. 9D shows a side view of track (402) with cable (501) located in the center of track (402), and arm (702) traveling down and directly away from the machine.

Concentric Path. In order for cable (501) to operate properly, bearing high loads of weight, and allow the track to rotate, it should always remain and travel in the center of track (402), no matter which direction arm (702) is pointed or track (402) is rotated. FIGS. 9D and 9E illustrate a concentric path for cabling.

FIG. 9D shows a side view of track (402) with cable (501) located in the center of track (402), and arm (702) traveling down and directly away from the machine. FIG. 9E shows the front view, now with arm (702) traveling down and to the left. In both views of FIG. 9D and FIG. 9E, cable (501) is directly in the center of track (402). The system achieves this concentric path of cable (501) by off-centering slider (403) and including pulley (406) that rotates horizontally as arm (702), slider (403), and track (402) rotate.

Figure 9F:
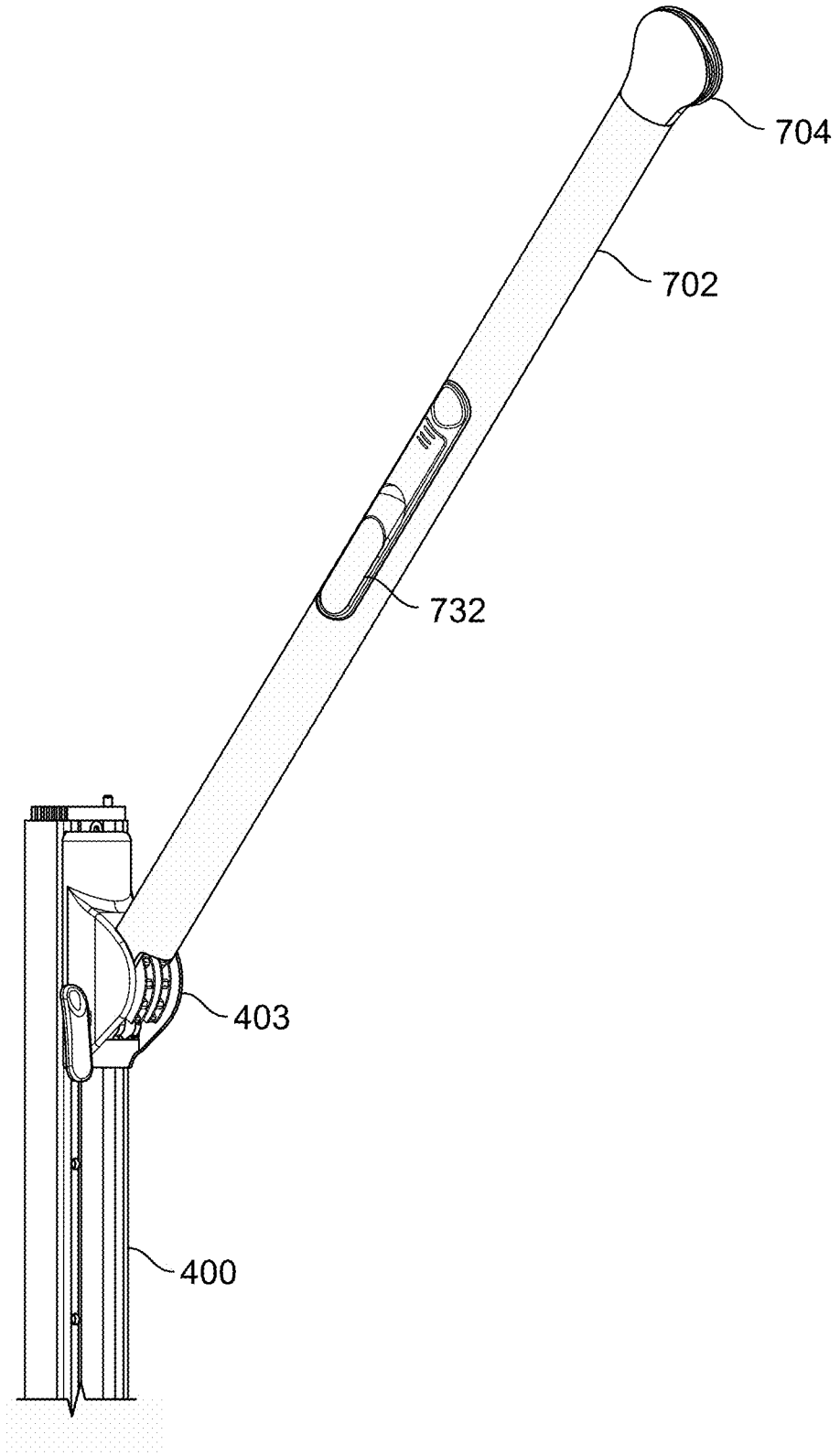
FIG. 9F is a perspective view of an exercise machine arm extended upward.
Figure 9G:
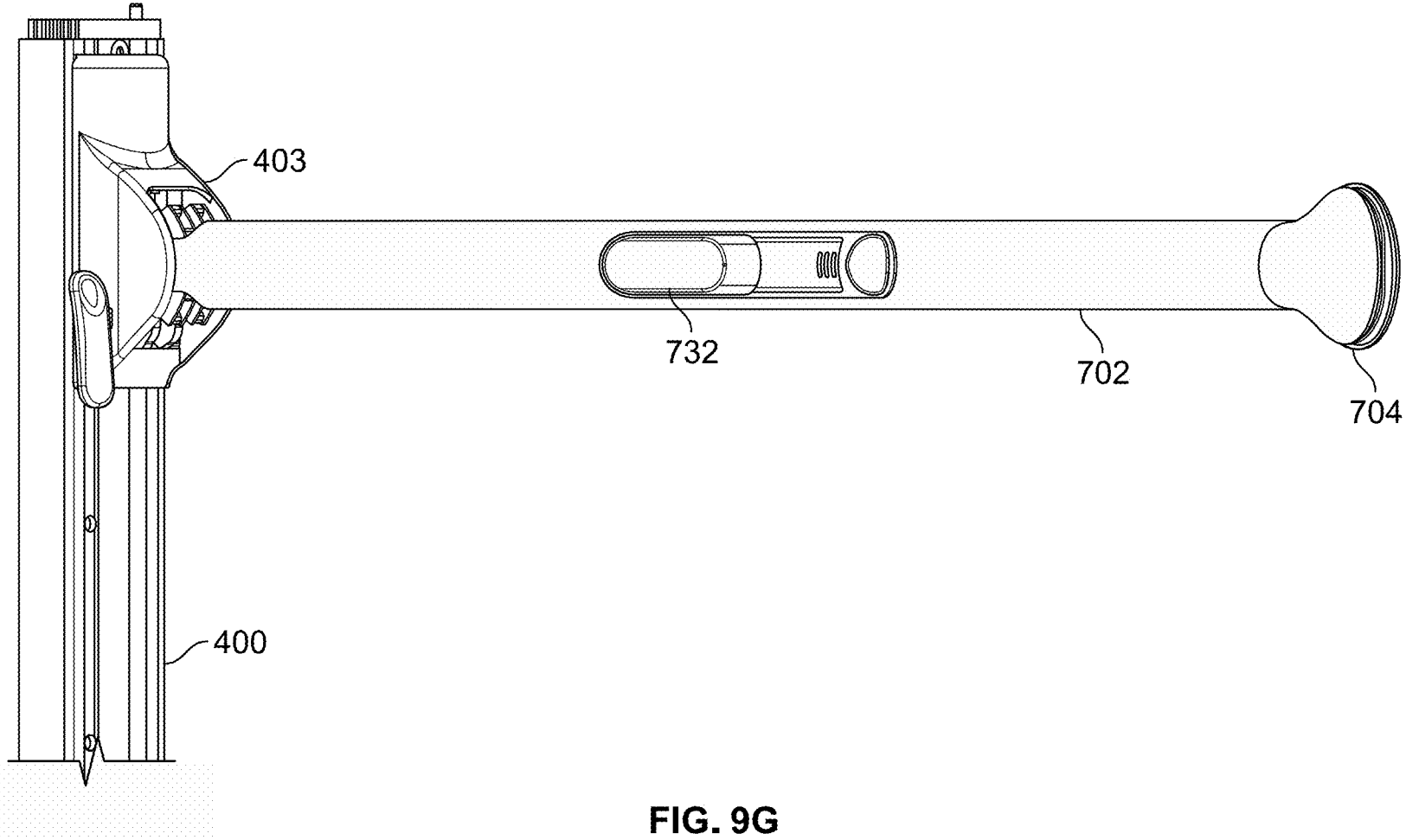
FIG. 9G is a perspective view of an exercise machine arm extended horizontally.
Figure 9H:
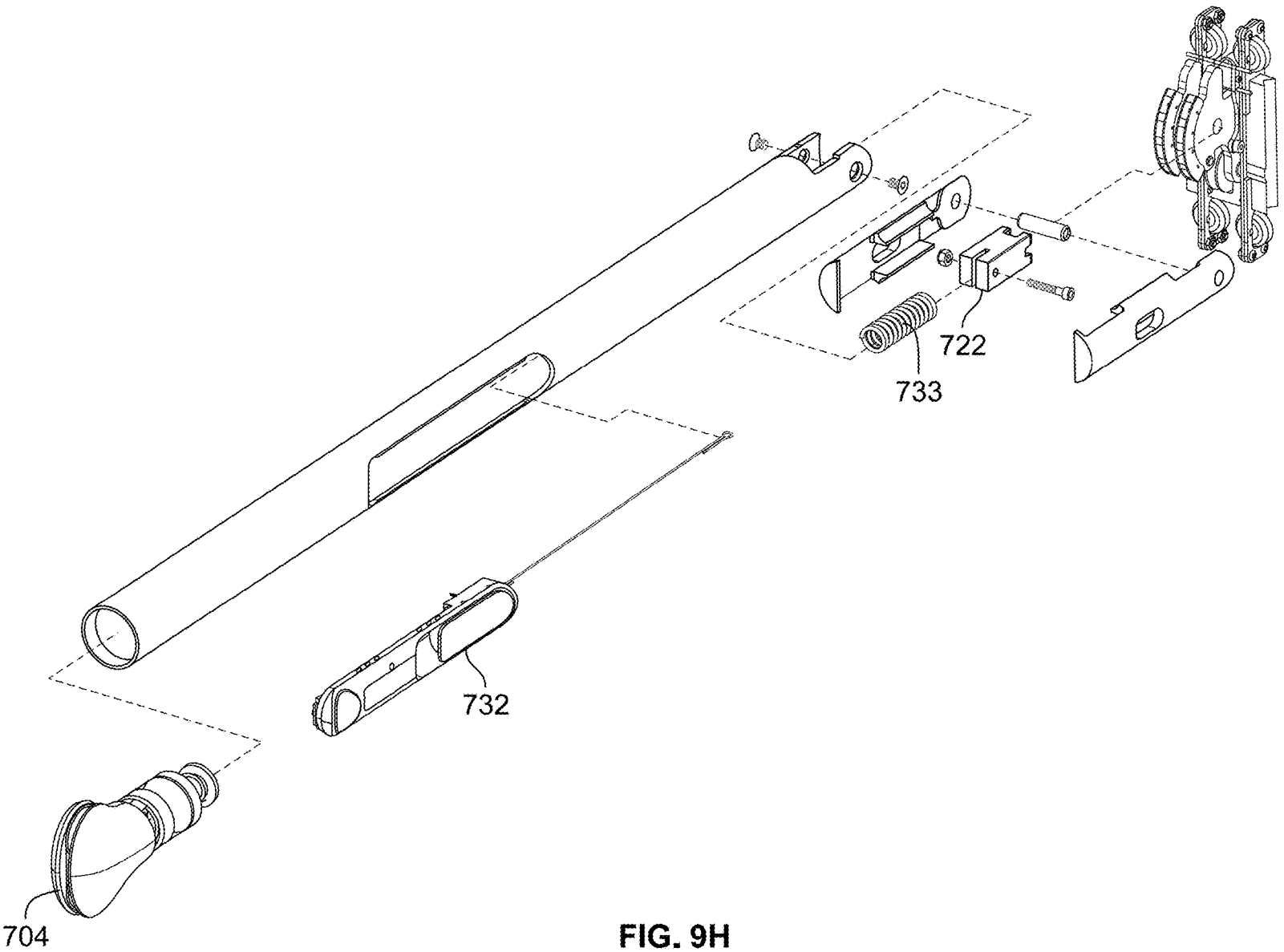
FIG. 9H illustrates an exploded perspective view drawing of an arm (702) including its lever (732), compression spring (733), and locking member (722).
Figure 9I:
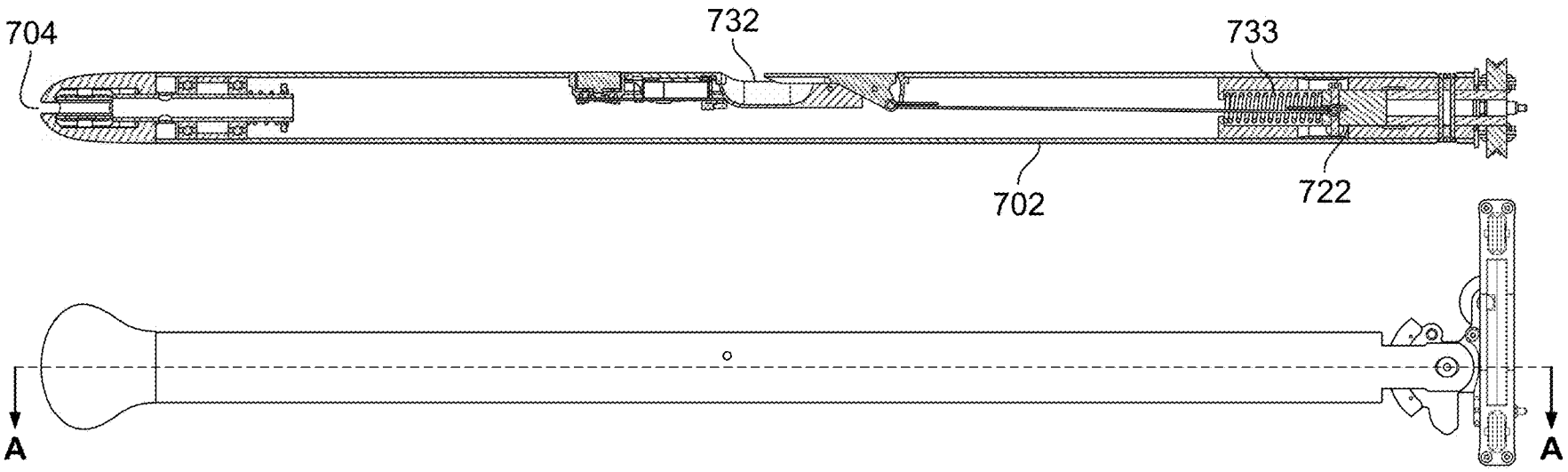
FIG. 9I illustrates both an assembled sectioned and non-sectioned perspective view drawing of the arm (702).

Arm Mechanical Drawings. FIGS. 9F-9X illustrate mechanical drawings of the arm (700, 702), components coupled to the arm such as the slider (401,403), and various features of the arm. FIG. 9F is a perspective view of an exercise machine arm extended upward. FIG. 9F is a view from the side of an arm (702) extended upward on an angle and its associated column (400), with the arm at its highest position along the column (400). FIG. 9G is a perspective view of an exercise machine arm extended horizontally. FIG. 9G is a view from the side of an arm (702) extended straight horizontally and its associated column (400), with the arm at its highest position along the column (400). FIG. 9H illustrates an exploded perspective view drawing of an arm (702) including its lever (732), compression spring (733), and locking member (722). FIG. 9I illustrates both an assembled sectioned and non-sectioned perspective view drawing of the arm (702).

Figure 9J:
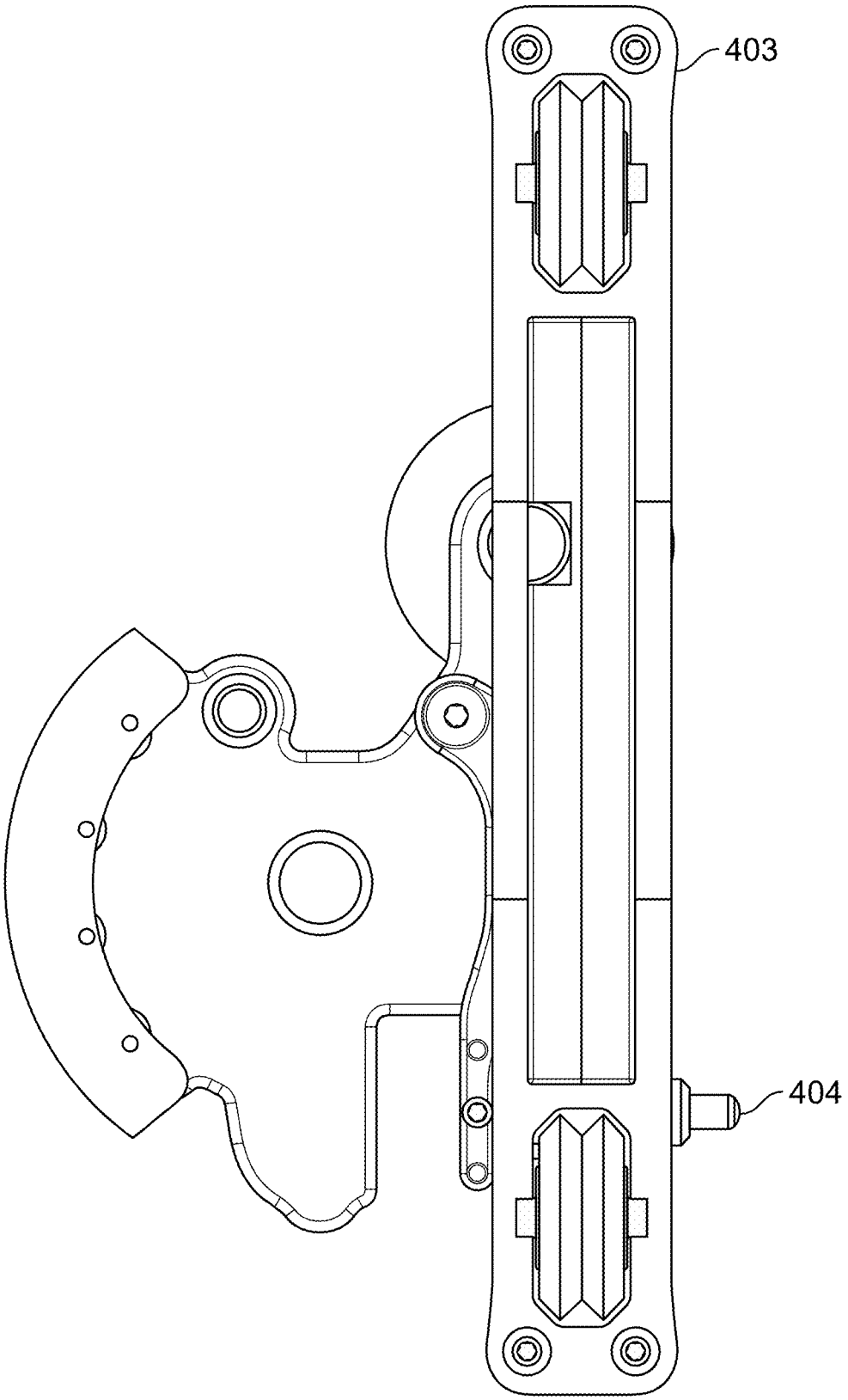
FIG. 9J is a side view section of an exercise machine slider (403) with its locking mechanism and pin locked.
Figure 9K:
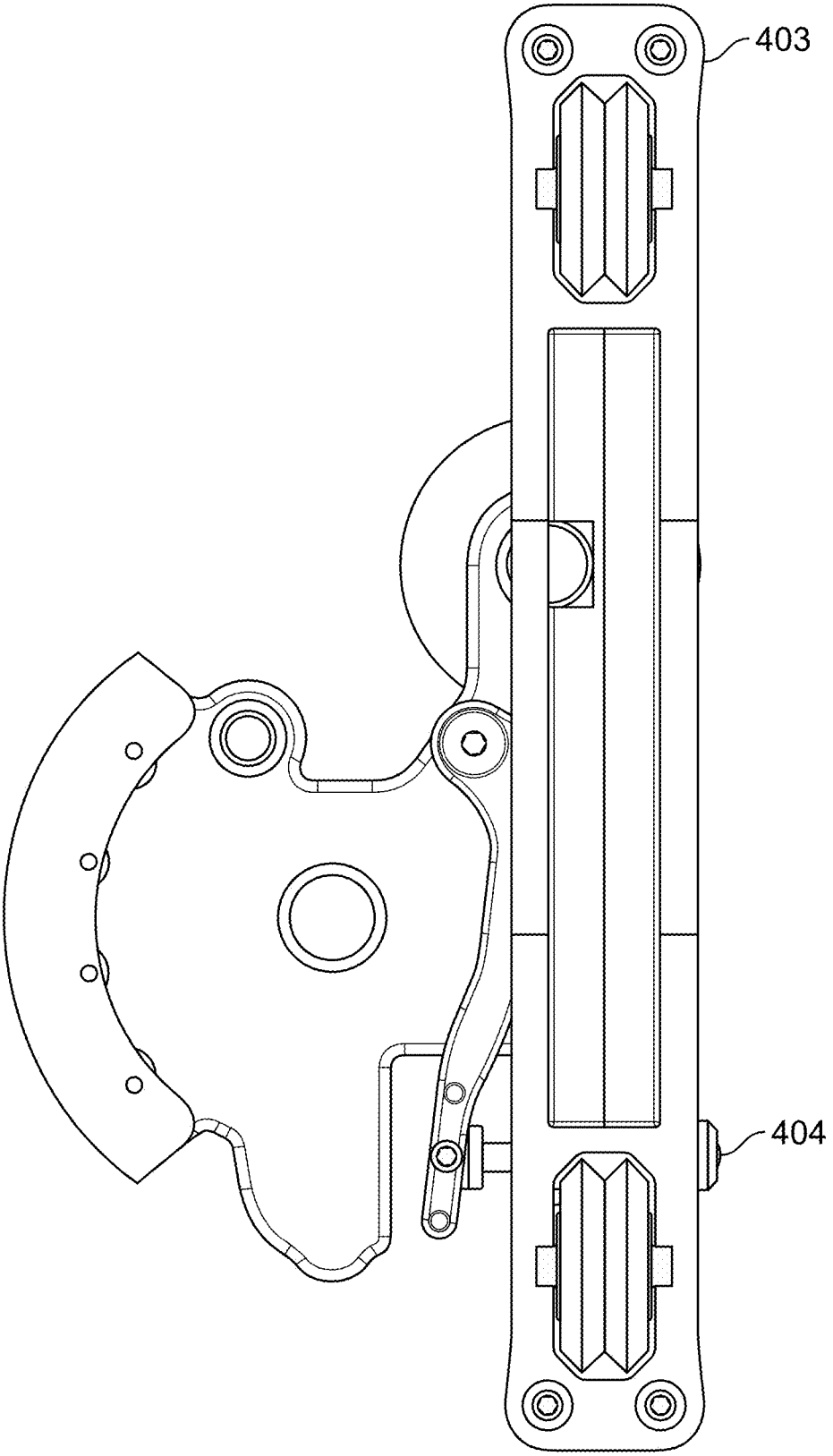
FIG. 9K is a side view section of an exercise machine slider (403) with its locking mechanism and pin unlocked.
Figure 9L:
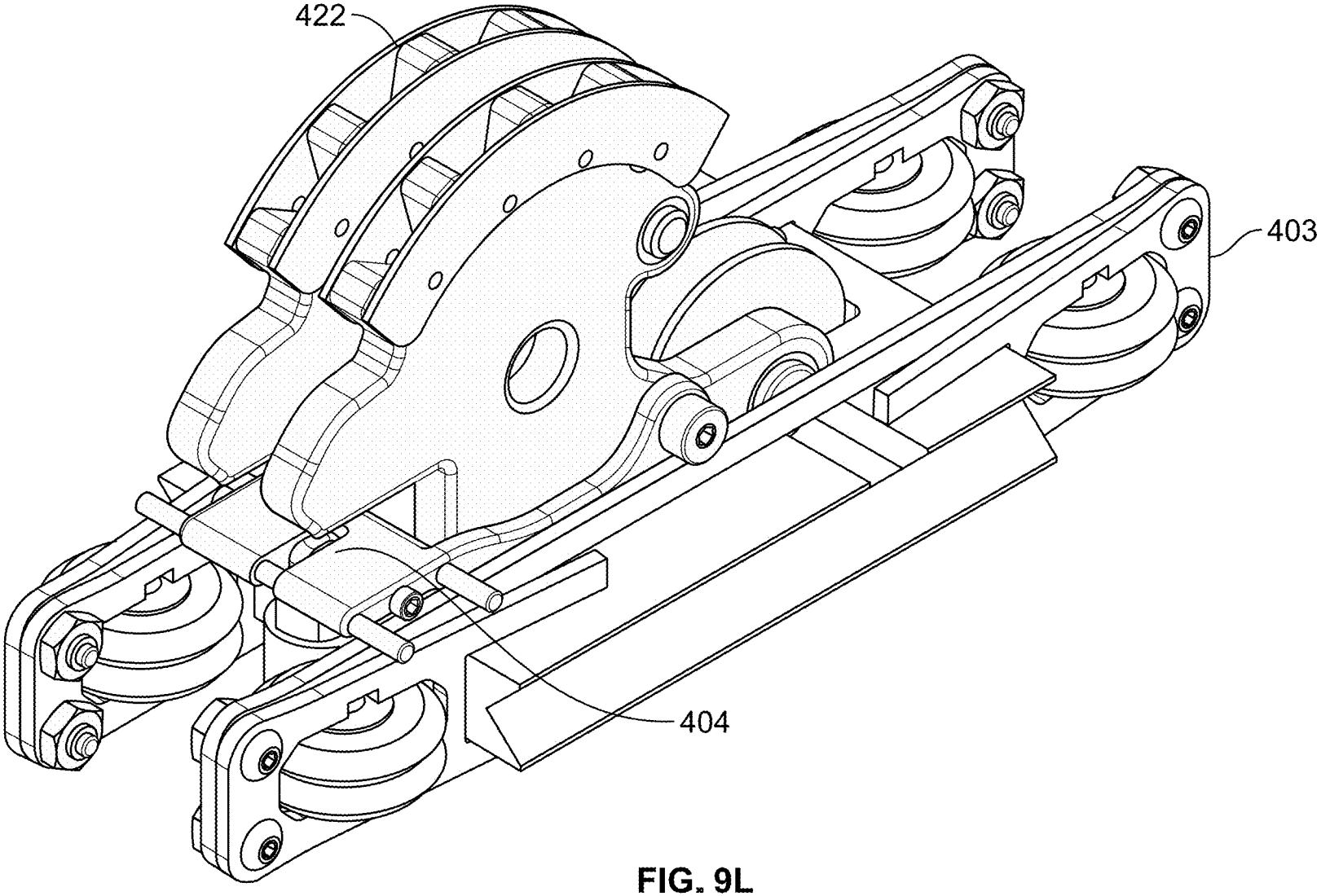
FIG. 9L is a perspective view of an exercise machine slider (403), revealing the pin (404) as well as teeth (422) for an arm vertical pivot.
Figure 9M:
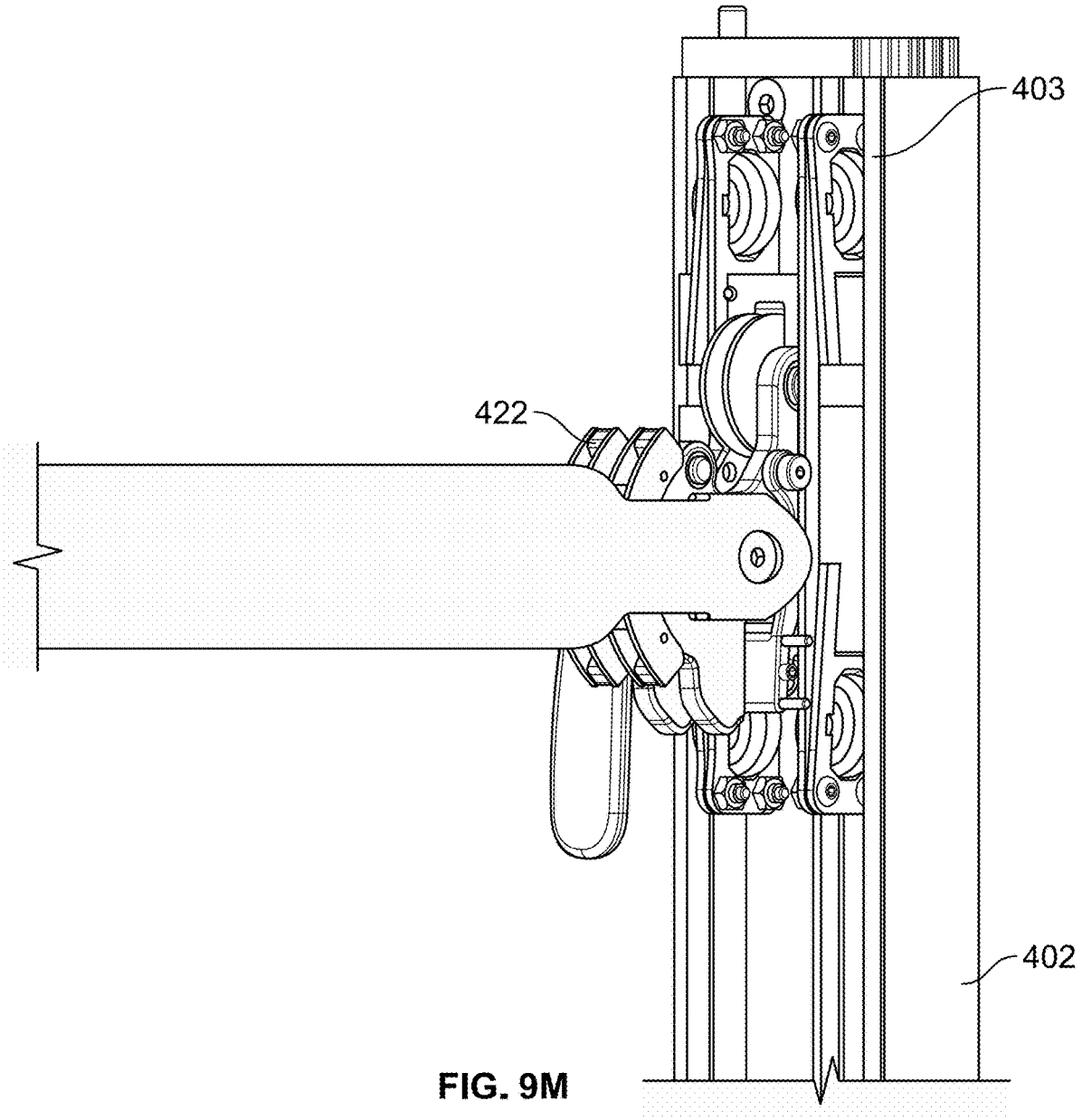
FIG. 9M is a perspective view of the exercise machine slider (403) in a column/rail (402) with revealed teeth (422), with arm (702) set at a vertical pivot at a point parallel to the horizontal plane.
Figure 9N:
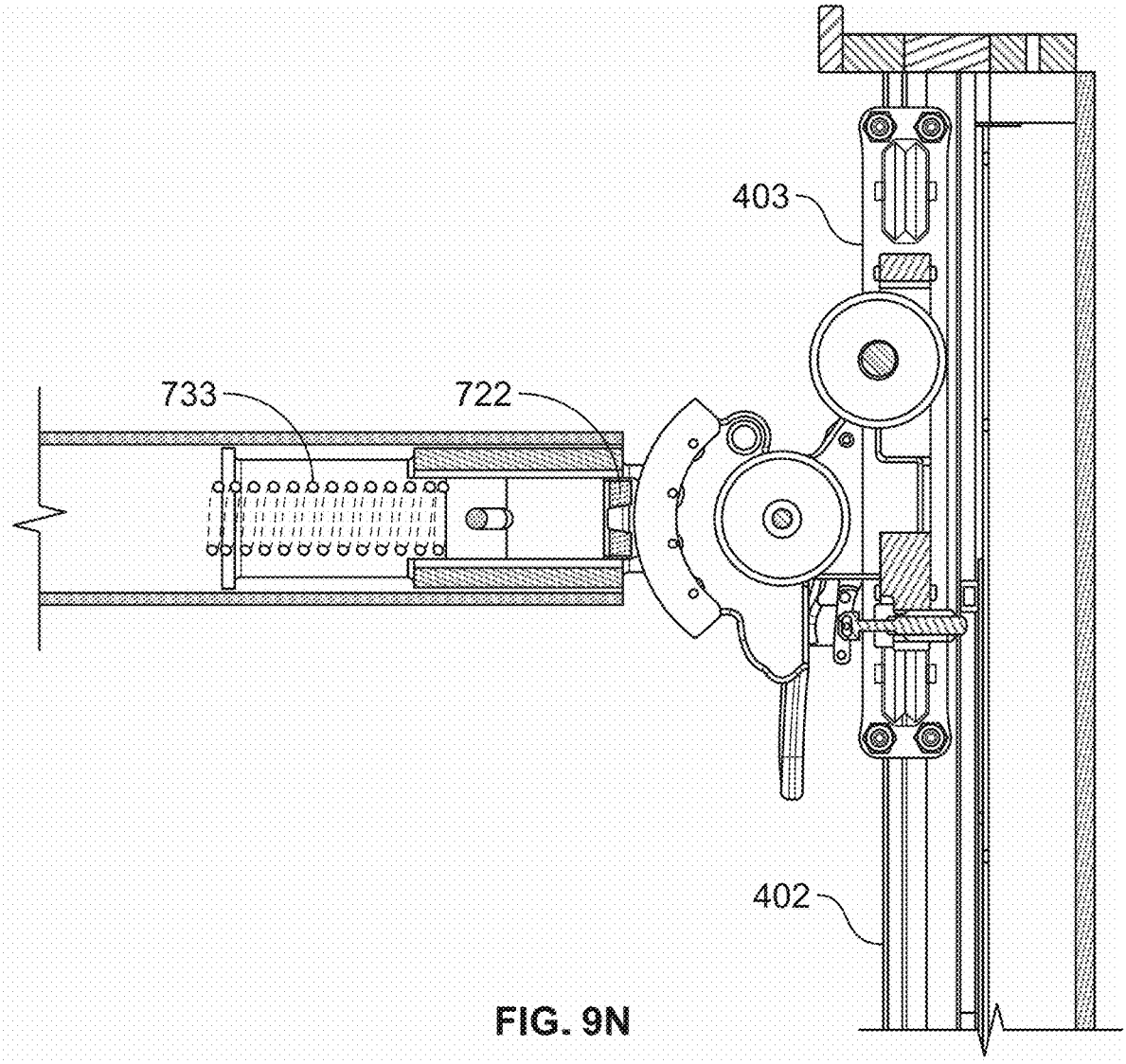
FIG. 9N is a side view section of the exercise machine slider (403) in a column/rail (402), with arm (702) set at a vertical pivot at a point parallel to the horizontal plane.
Figure 9P:
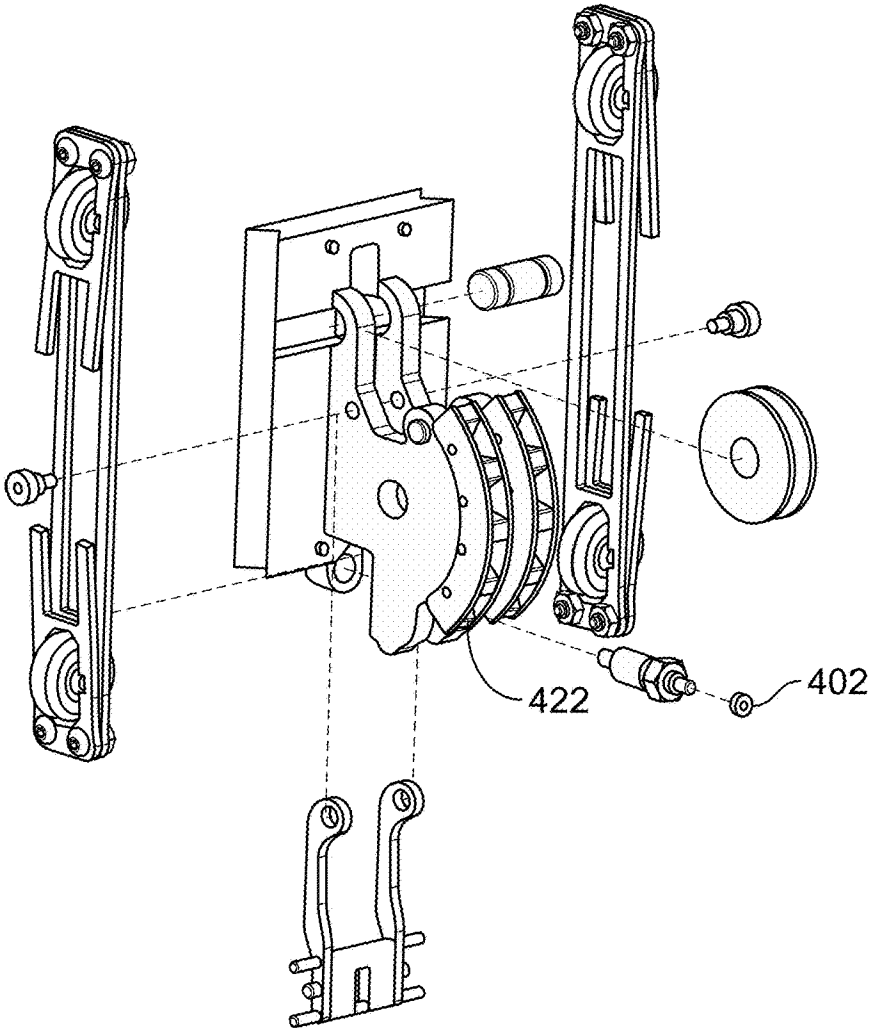
FIG. 9P illustrates an exploded perspective view drawing of the exercise machine slider (403).
Figure 9O:
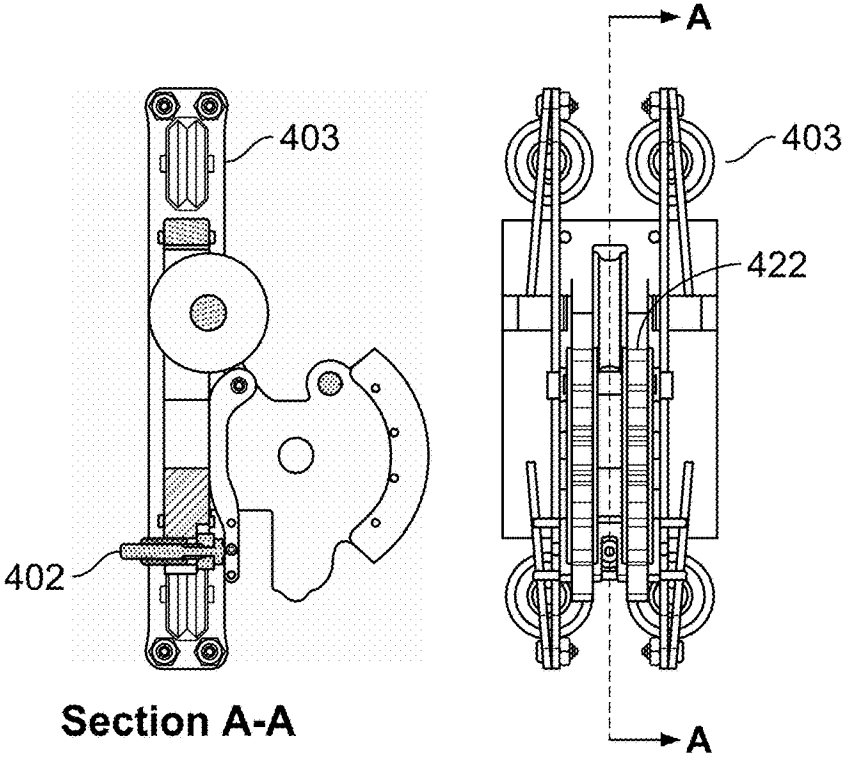
FIG. 9O is a sectional side view of the exercise machine slider (403).

FIG. 9J is a side view section of an exercise machine slider (403) with its locking mechanism and pin locked. FIG. 9K is a side view section of an exercise machine slider (403) with its locking mechanism and pin unlocked. FIG. 9L is a perspective view of an exercise machine slider (403), revealing the pin (404) as well as teeth (422) for an arm vertical pivot. FIG. 9M is a perspective view of the exercise machine slider (403) in a column/rail (402) with revealed teeth (422), with arm (702) set at a vertical pivot at a point parallel to the horizontal plane. FIG. 9N is a side view section of the exercise machine slider (403) in a column/rail (402), with arm (702) set at a vertical pivot at a point parallel to the horizontal plane. The female locking member (722) and compression spring (733) are visible within the section of FIG. 9N. FIG. 9O is a sectional side view of the exercise machine slider (403). FIG. 9P illustrates an exploded perspective view drawing of the exercise machine slider (403).

Figure 9Q:
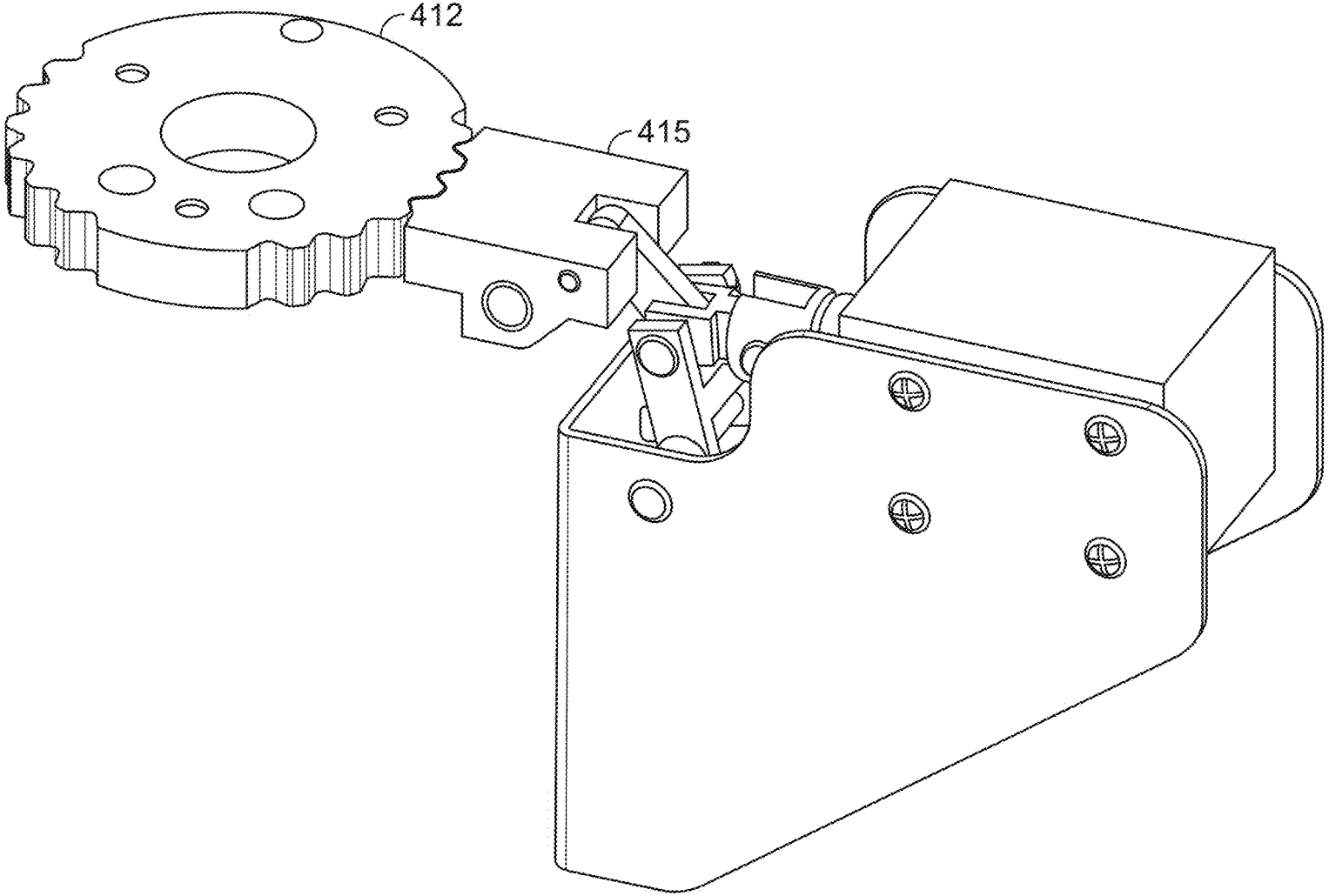
FIG. 9Q is a perspective view of a column locking mechanism for a horizontal pivot.
Figure 9R:
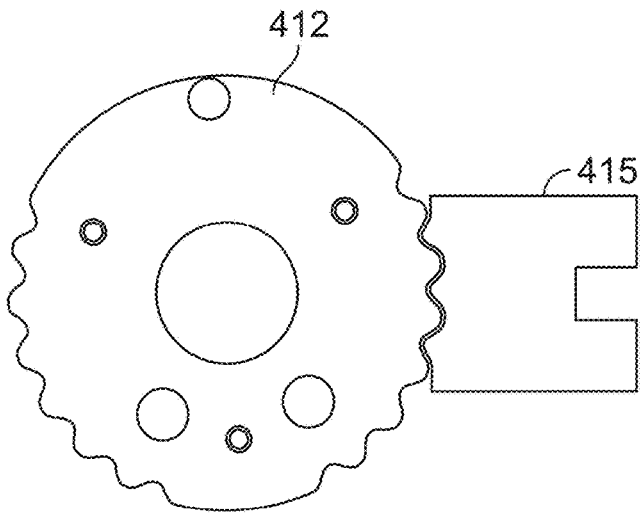
FIG. 9R is a top view of the top member (412).
Figure 9S:
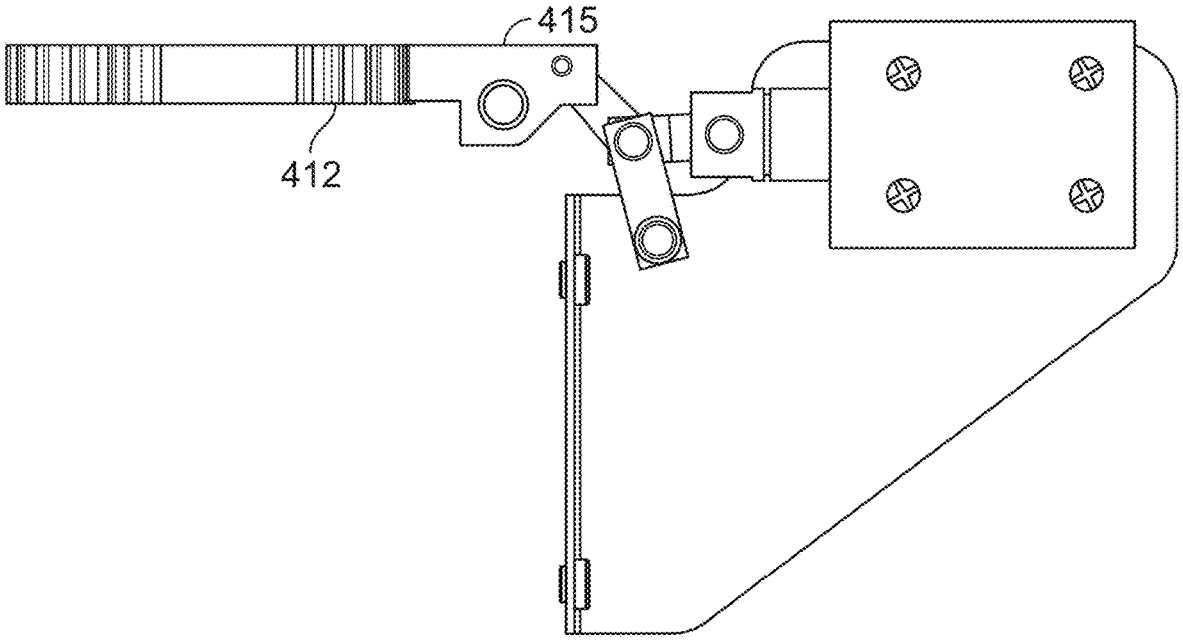
FIG. 9S is a side view of the column locking mechanism for the horizontal pivot.
Figure 9T:
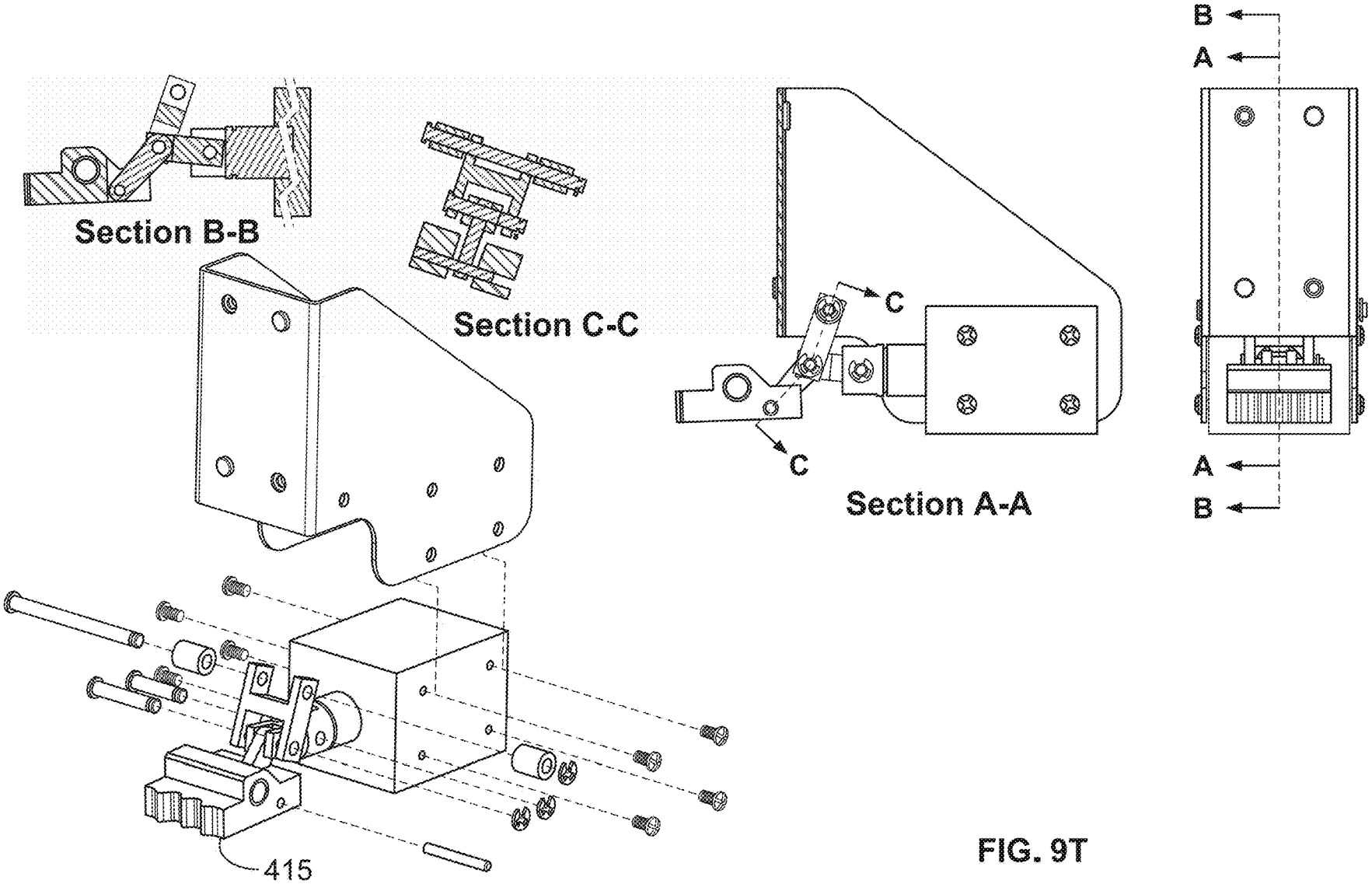
FIG. 9T illustrates an exploded perspective view drawing of the column locking mechanism including locking member (415).

FIG. 9Q is a perspective view of a column locking mechanism for a horizontal pivot. FIG. 9Q shows both top member (412) interfacing with the device locking member (415). FIG. 9Q shows without limitation a solenoid mechanism for controlling the device locking member (415). FIG. 9R is a top view of the top member (412), and FIG. 9S is a side view of the column locking mechanism for the horizontal pivot. FIG. 9T illustrates an exploded perspective view drawing of the column locking mechanism including locking member (415).

Figure 9V:
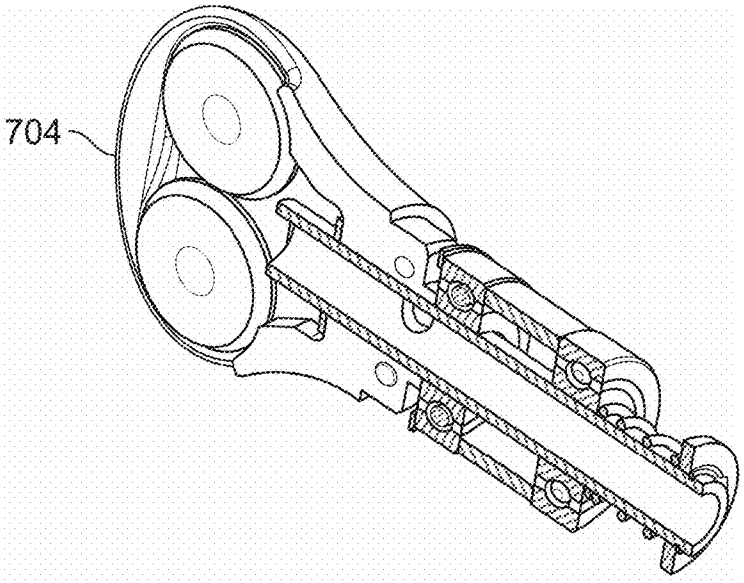
FIG. 9V is a perspective section of the wrist (704).
Figure 9U:
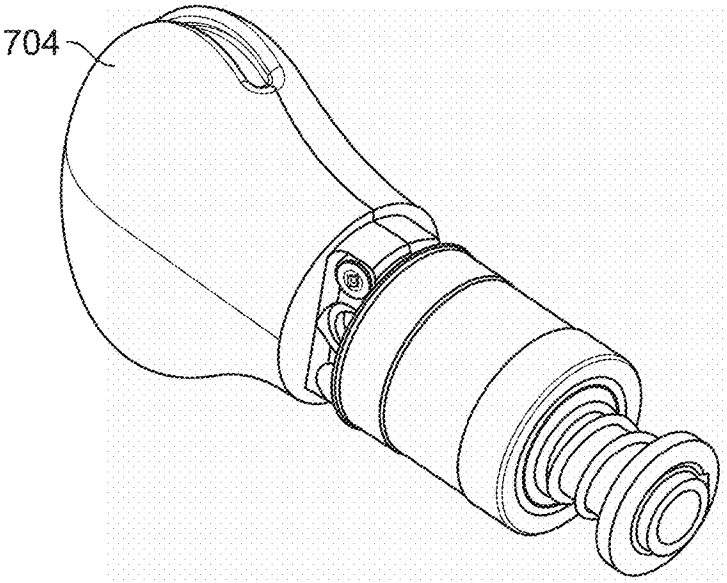
FIG. 9U is a perspective view of a wrist (704), showing a spring mechanism that enables access to the interior of the wrist (for example, to the bolts shown in FIGS. 9V and 9W) in order to, for example, service the wrist.
Figure 9W:
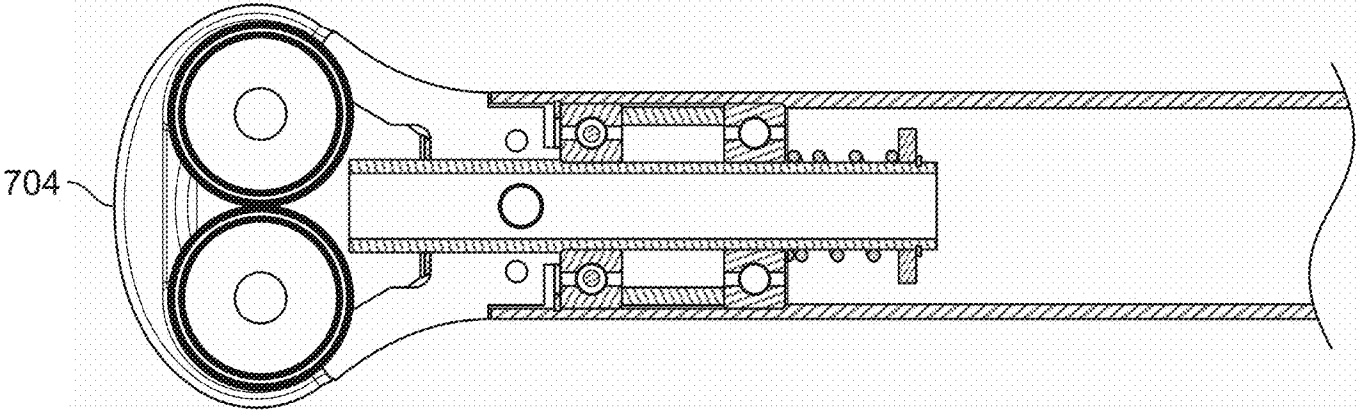
FIG. 9W is a side view section of the wrist (704).
Figure 9X:
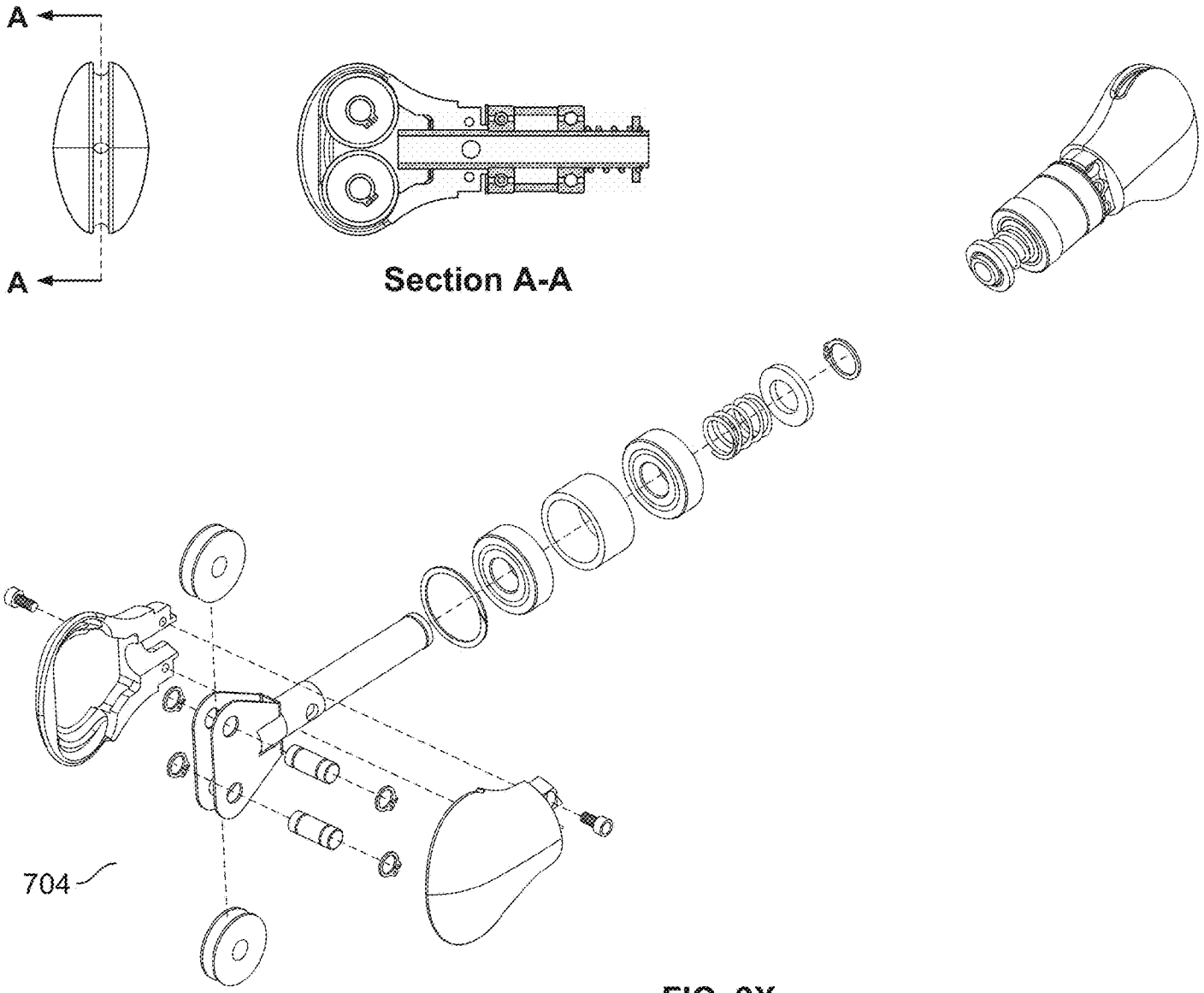
FIG. 9X illustrates an exploded perspective view drawing of the wrist (704).

In one embodiment, the user origination point/exertion point (704) is a configurable "wrist" to allow local rotation for guiding the cable (500, 501). FIG. 9U is a perspective view of a wrist (704), showing a spring mechanism that enables access to the interior of the wrist (for example, to the bolts shown in FIGS. 9V and 9W) in order to, for example, service the wrist. This has the benefit of concealing aspects of the wrist without preventing access to them. FIG. 9V is a perspective section of the wrist (704). FIG. 9W is a side view section of the wrist (704). FIG. 9X illustrates an exploded perspective view drawing of the wrist (704).

Figure 10C:
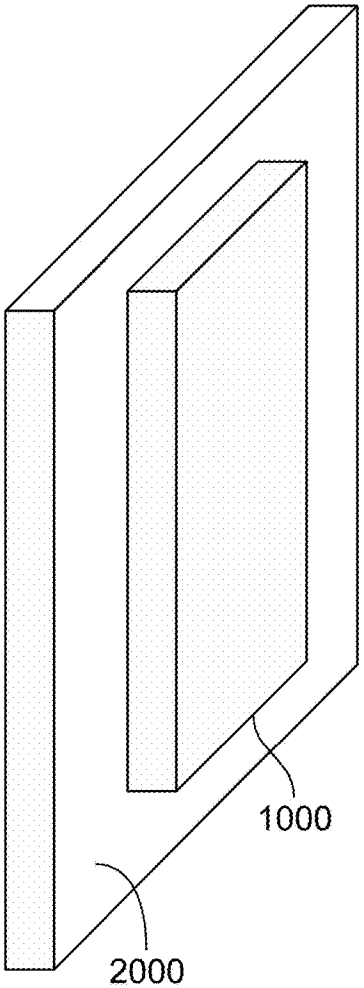
FIGS. 10A, 10B, and 10C illustrate a stowed configuration.
Figure 10B:
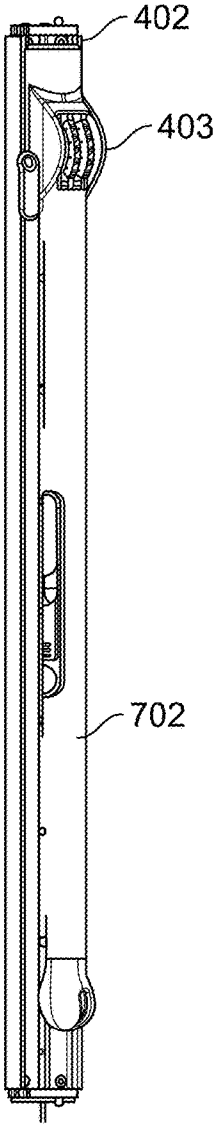
Figure 10A:
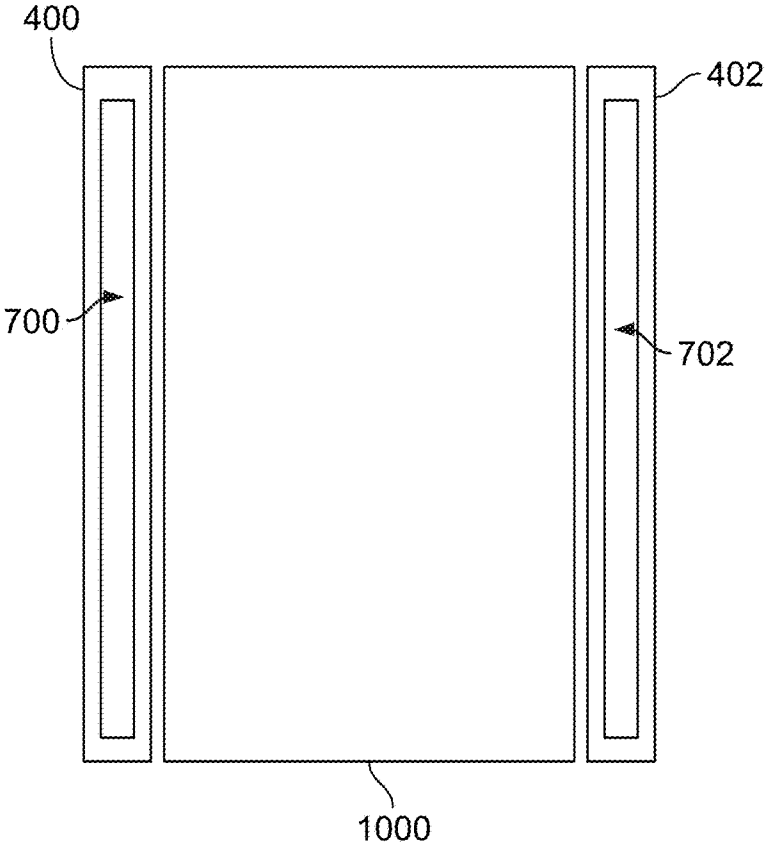

Stowing. Stowing arms (700, 702) to provide a most compact form is disclosed. When arm (702) is moved down toward the top of the machine as described above, and pivoted vertically until is flush with the machine as described above, the machine is in its stowed configuration which is its most compact form. FIGS. 10A, 10B, and 10C illustrate a stowed configuration. FIG. 10A shows this stowed configuration wherein the rails (400, 402) may be pivoted horizontally until the arm is facing the back of the machine (1000) and completely out of the view of the user. FIG. 10B illustrates a perspective view mechanical drawing of an arm (702) stowed behind rail (402).

FIG. 10C shows that this configuration may be unobtrusive. Mounted on wall (2000), machine (1000) may take no more space than a large mirror with ornamental framing or other such wall hanging. This compact configuration makes machine (1000) attractive as exercise equipment in a residential or office environment. Typically home exercise equipment consumes a non-trivial amount of floor space, making them obstacles to foot traffic. Traditionally home exercise equipment lacks functionality to allow the equipment to have a pleasing aesthetic. Machine (1000), mounted on wall (2000), causes less of an obstruction and avoids an offensive aesthetic.

Range of Motion. An exercise machine such as a strength training machine is more useful when it can facilitate a full body workout. An exercise machine designed to be configurable such that it can be deployed in a number of positions and orientation to allow the user to access a full body workout is disclosed. In one embodiment, the exercise machine (1000) is adjustable in three degrees of freedom on the left side, and three degrees of freedom on the right side, for a total of six degrees of freedom.

Figure 11:
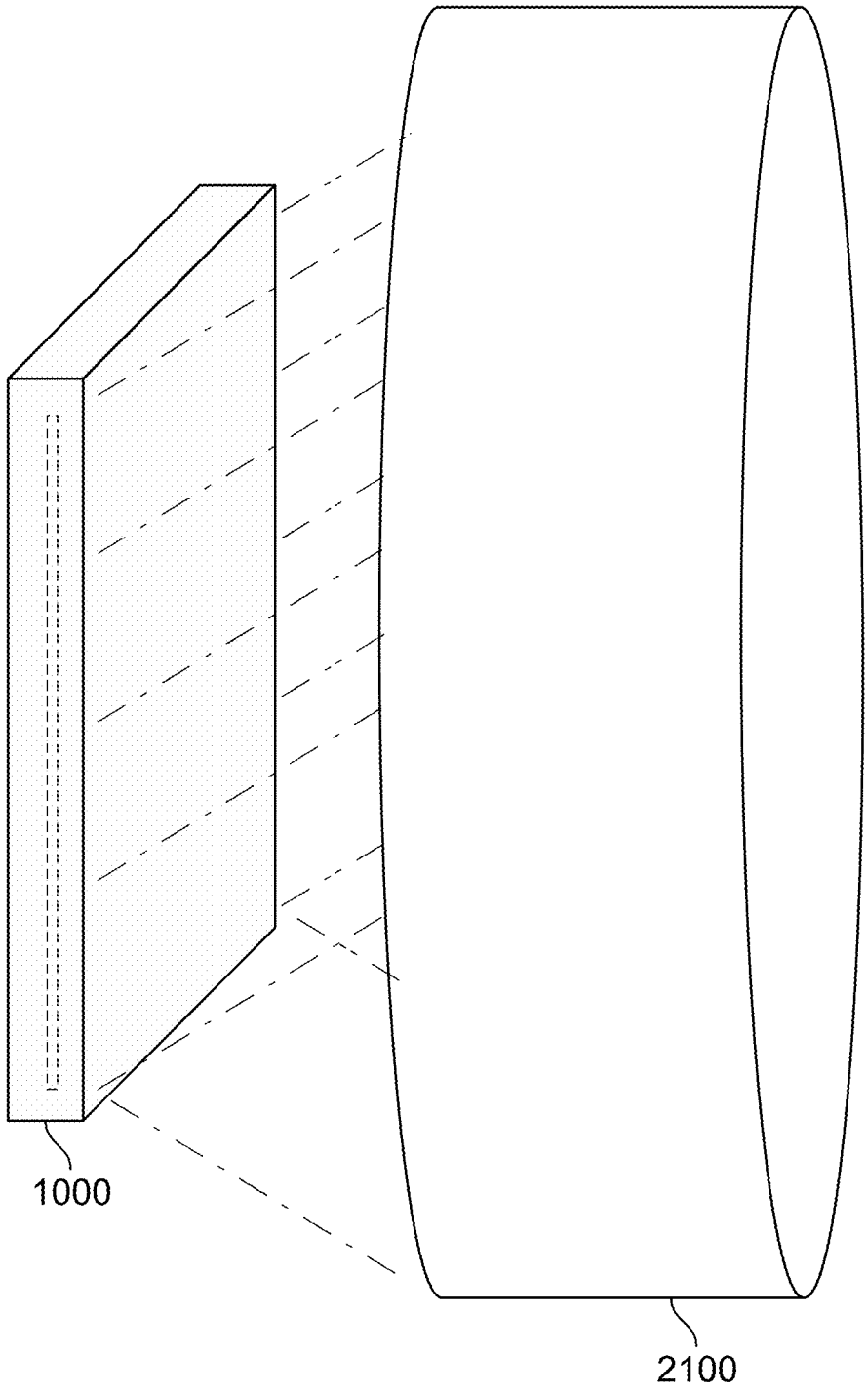
FIG. 11 illustrates the footprint of the dynamic arm placement.

As described above, each arm (700, 702) may be translated/moved up or down, pivoted up or down, or pivoted left and right. Collectively, this wide range of motion provides a substantial footprint of workout area relative to the compact size of machine (1000). FIG. 11 illustrates the footprint of the dynamic arm placement. The footprint (2100) as shown in FIG. 11 indicates than a compact/unobtrusive machine (1000) may serve any size of human being, who vary in "wing spans". As described herein, a wing span is the distance between left and right fingertips when the arms are extended horizontally to the left and right.

Arm Sensor. Wiring electrical/data connectivity through a movable arm (700, 702) is not trivial as the joint is complex, while sensors to measure angle of an arm are useful. In one embodiment, an accelerometer is placed in the arm coupled to a wireless transmitter, both powered by a battery. The accelerometer measures the angle of gravity, of which gravity is a constant acceleration. The wireless transmitter sends this information back to the controller, and in one embodiment, the wireless protocol used is Bluetooth.

For manufacturing efficiency, one arm is mounted upside down from the other arm, so control levers (732) in either case are oriented inwards. As the two arms are thus mirror images of one another, the signals from the accelerometer may be distinguished based at least in part because the accelerometer is upside down/mirrored on one opposing arm.

Figure 12A:
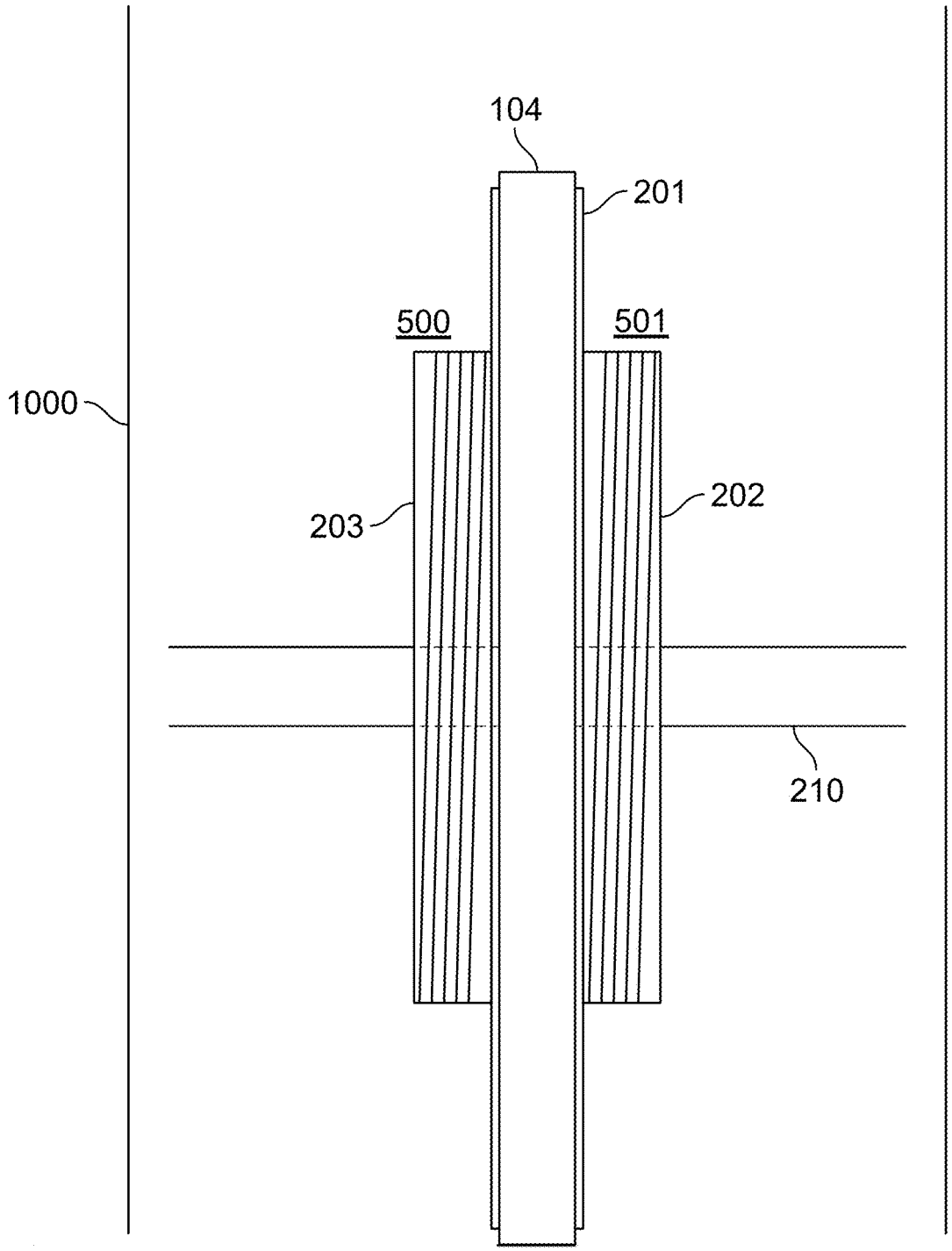
FIGS. 12A, 12B, 12C, and 12D illustrate a differential for an exercise machine.

Differential. FIGS. 12A-12D illustrate a differential for an exercise machine. FIG. 12A shows a top view of the differential, making reference to the same numbering as in FIG. 1B and FIG. 2, wherein sprocket (201) and spools (202, 203) rotate around shaft (210).

Figure 12B:
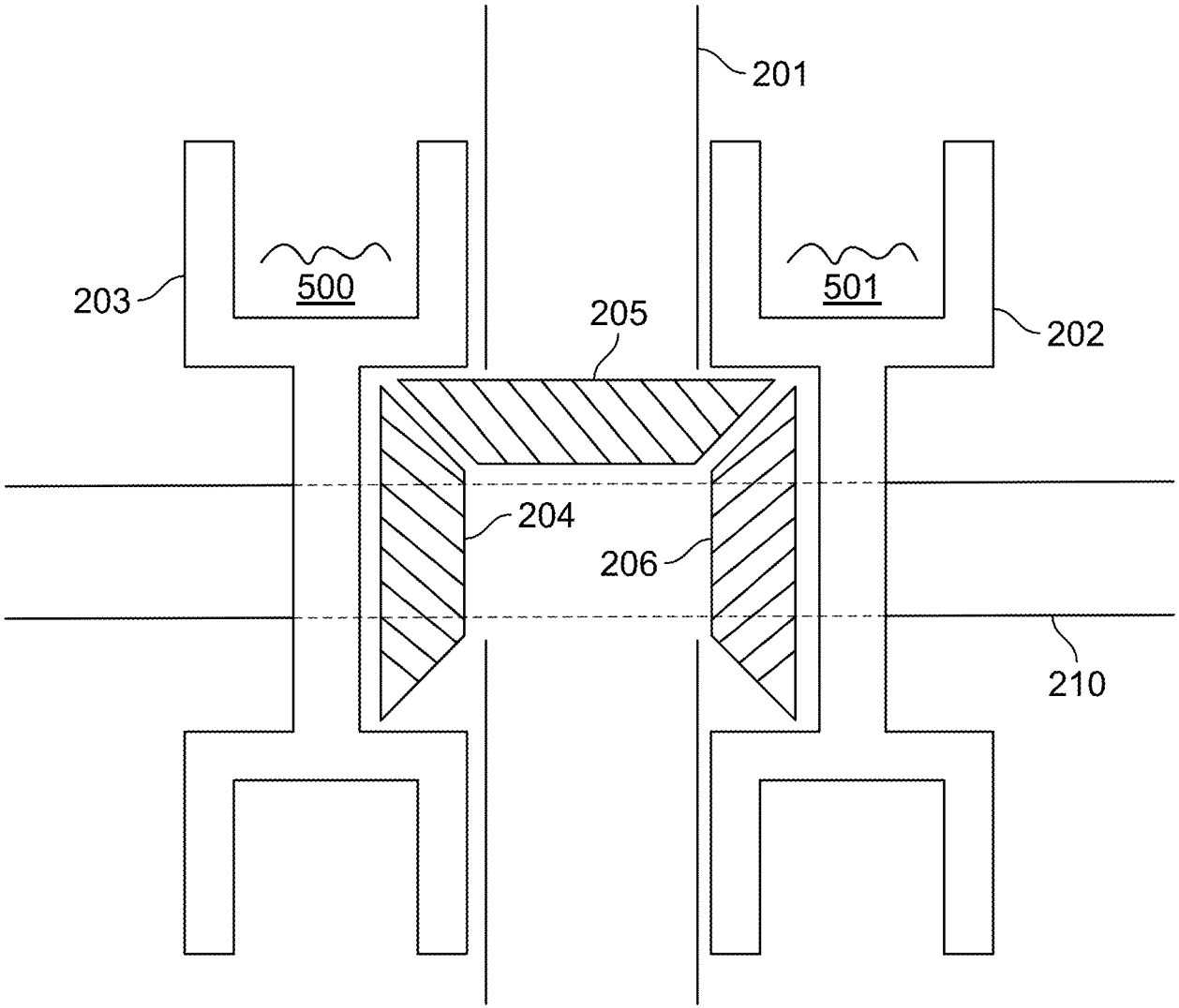

FIG. 12B illustrates a cross-sectional view of FIG. 12A. In addition to the components shown and discussed for FIG. 12A, this figure shows differential configuration of components embedded within sprocket (201) and spools (202) and (203). In one embodiment, sun gears (204) and (206) are embedded inside of cavities within spools (203) and (202), respectively. In one embodiment, planet gear (205) is embedded within sprocket (201), with the planet gear (205) to mesh with sun gears (204, 206) within spools (203, 202).

This configuration of sun gears (204, 206) and planet gear (205) operates as a differential. That is, sun gears (204, 206) rotate in a single vertical plane around shaft (210), whereas planet gear (205) rotates both in that vertical plane, but also horizontally. As described herein, a differential is a gear box with three shafts such that the angular velocity of one shaft is the average of the angular velocities of the others, or a fixed multiple of that average. In one embodiment, bevel style gears are used rather than spur gears in order to promote a more compact configuration.

The disclosed use of sun gears (204, 206) and planet gear (205) and/or embedding the gears within other components such as sprocket (201) permit a smaller size differential for dividing motor tension between cables (500) and (501) for the purposes of strength training.

Figure 12C:
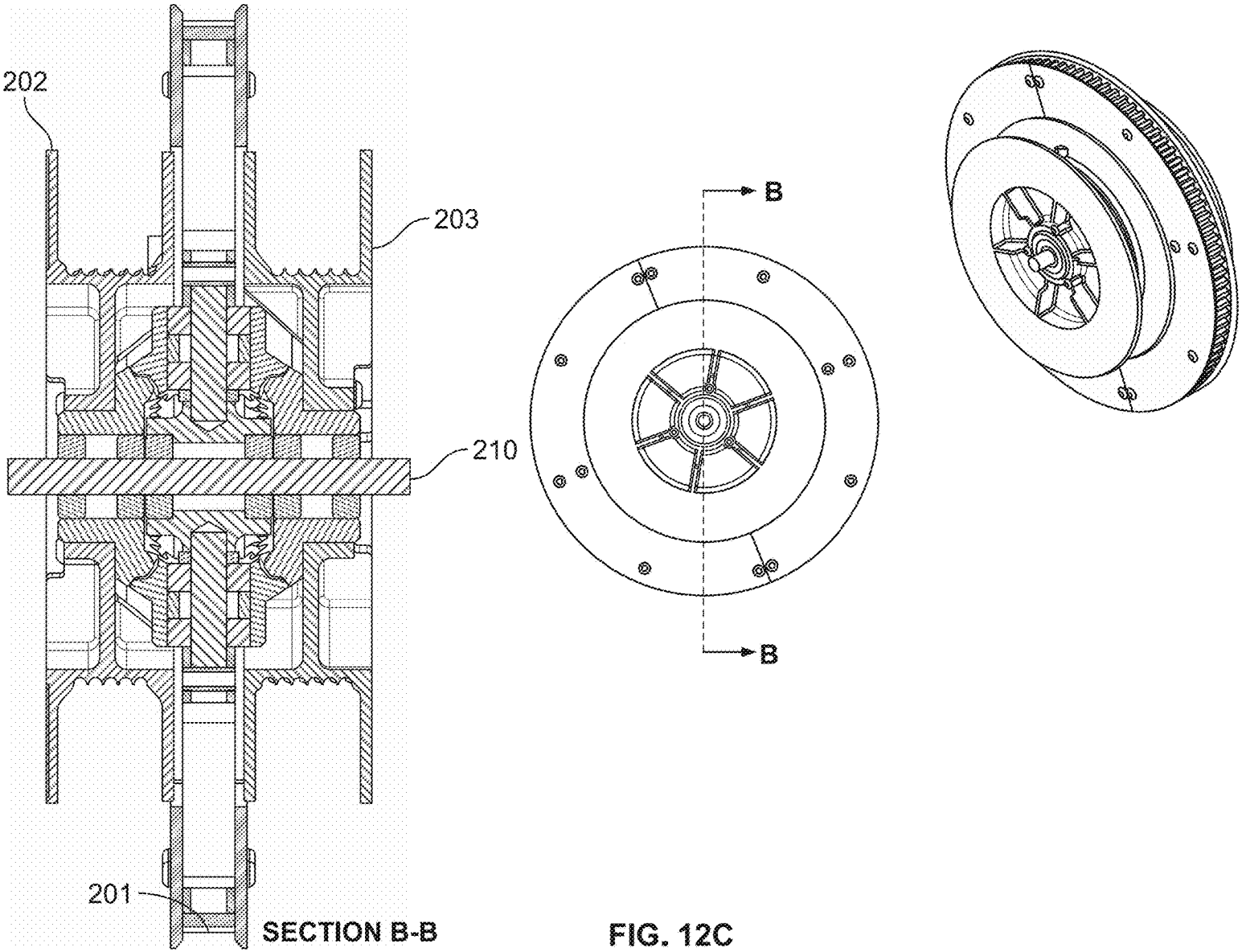

FIG. 12C illustrates a cross-sectional view mechanical drawing of differential (200). FIG. 12C shows an assembled sprocket (201), front spool (202), rear spool (203) and shaft (210).

Figure 12D:
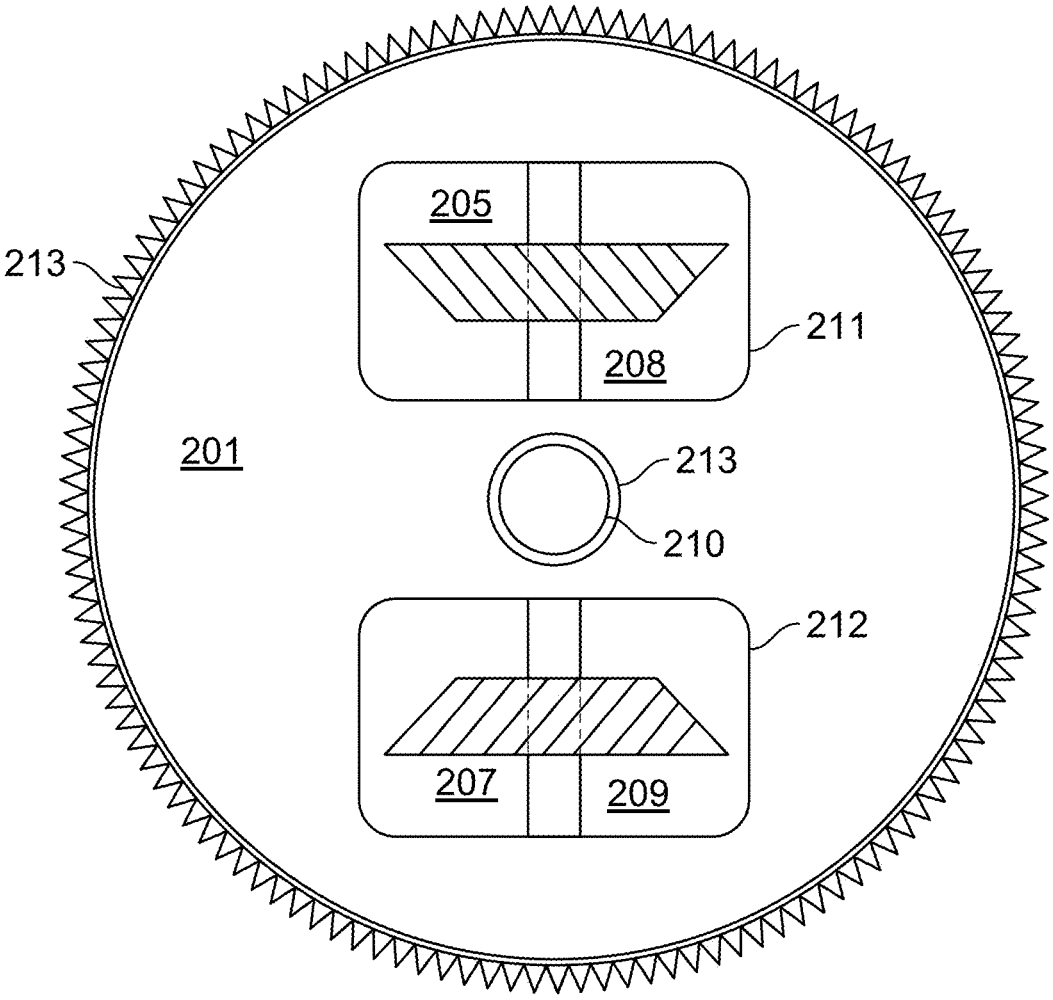

FIG. 12D illustrates a front cross-sectional view of sprocket (201). In one embodiment, multiple planet gears are used instead of a single gear (205) as shown in FIG. 12B. As shown in FIG. 12D, sprocket (201) is shown with cavities (211) and (212), which house planet gears (205) and (207). Without limitation, sprocket (201) is capable of embedding a plurality of planet gears. More planet gears enable a more balanced operation and a reduced load on their respective teeth, but cost a tradeoff of greater friction. Cavities (211) and (212), together with other cavities within sprocket (201) and spools (202) and (203), collectively form a "cage" (200) in which the sun gears (204, 206) and planet gears (205, 207) are housed and operate.

As shown in FIG. 12D, planet gears (205) and (207) are mounted on shafts (208) and (209), respectively. Thus, these gears rotate around these shafts in the horizontal direction. As noted above, while these gears are rotating around their shafts, they may also rotate around shaft (210) of FIGS. 12B and 12D as part of sprocket (201).

In one embodiment, each planet and sun gear in the system has at least two bearings installed within to aid in smooth rotation over a shaft, and the sprocket (201) has at least two bearings installed within its center hole to aid in smooth rotation over shaft (210). Shaft (210) may have retaining rings to aid in the positioning of the two sun gears (204, 206) on shaft (210).

In one embodiment, spacers may be installed between the sun gears (204, 206) and the sprocket (201) on shaft (210) to maintain the position of the sun gears (204, 206). The position of the planet gears (205, 207) may be indexed by the reference surfaces on the cage (200) holding the particular planet gear (205, 207), with the use of either spacers or a built in feature.

Figure 12E:
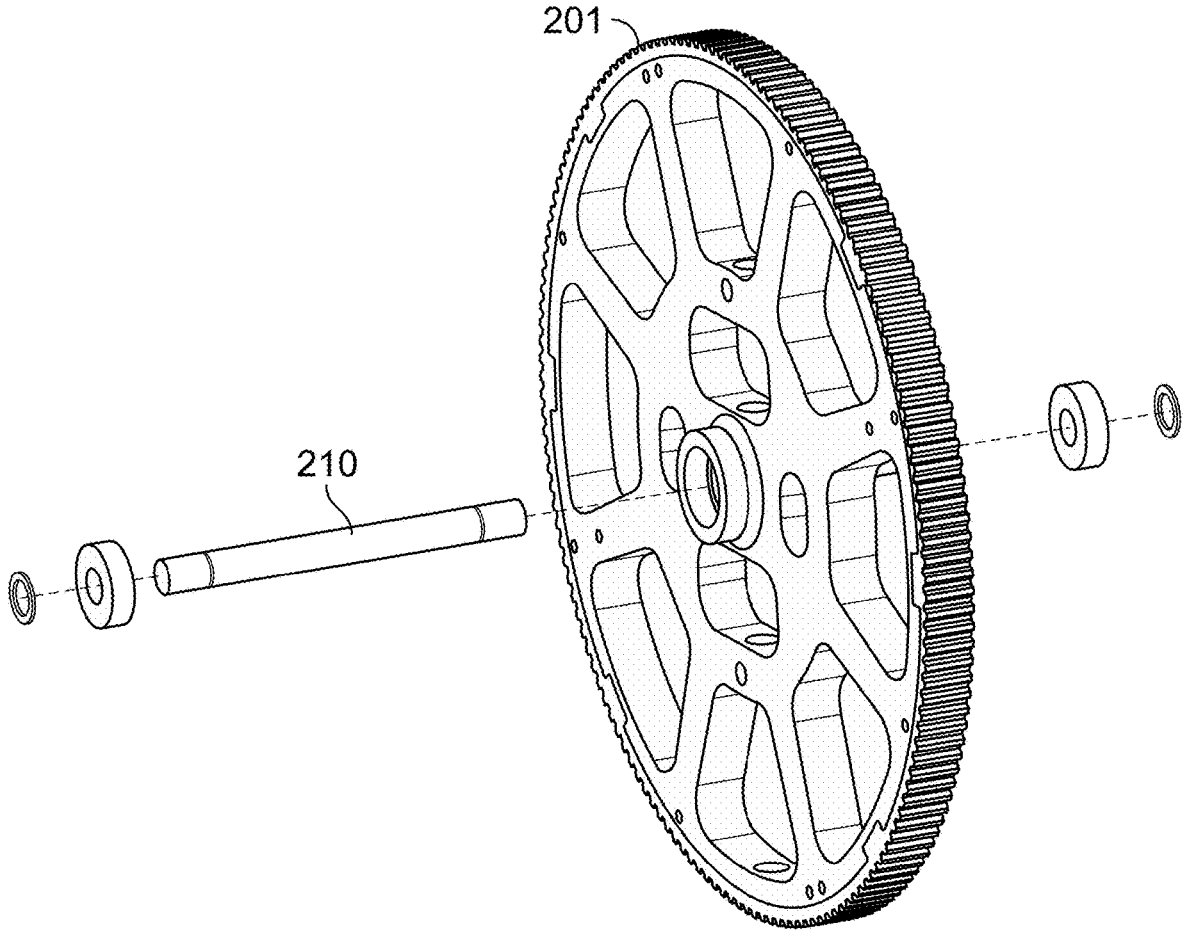
FIG. 12E illustrates an exploded perspective view drawing of sprocket (201) and shaft (210).
Figure 12F:
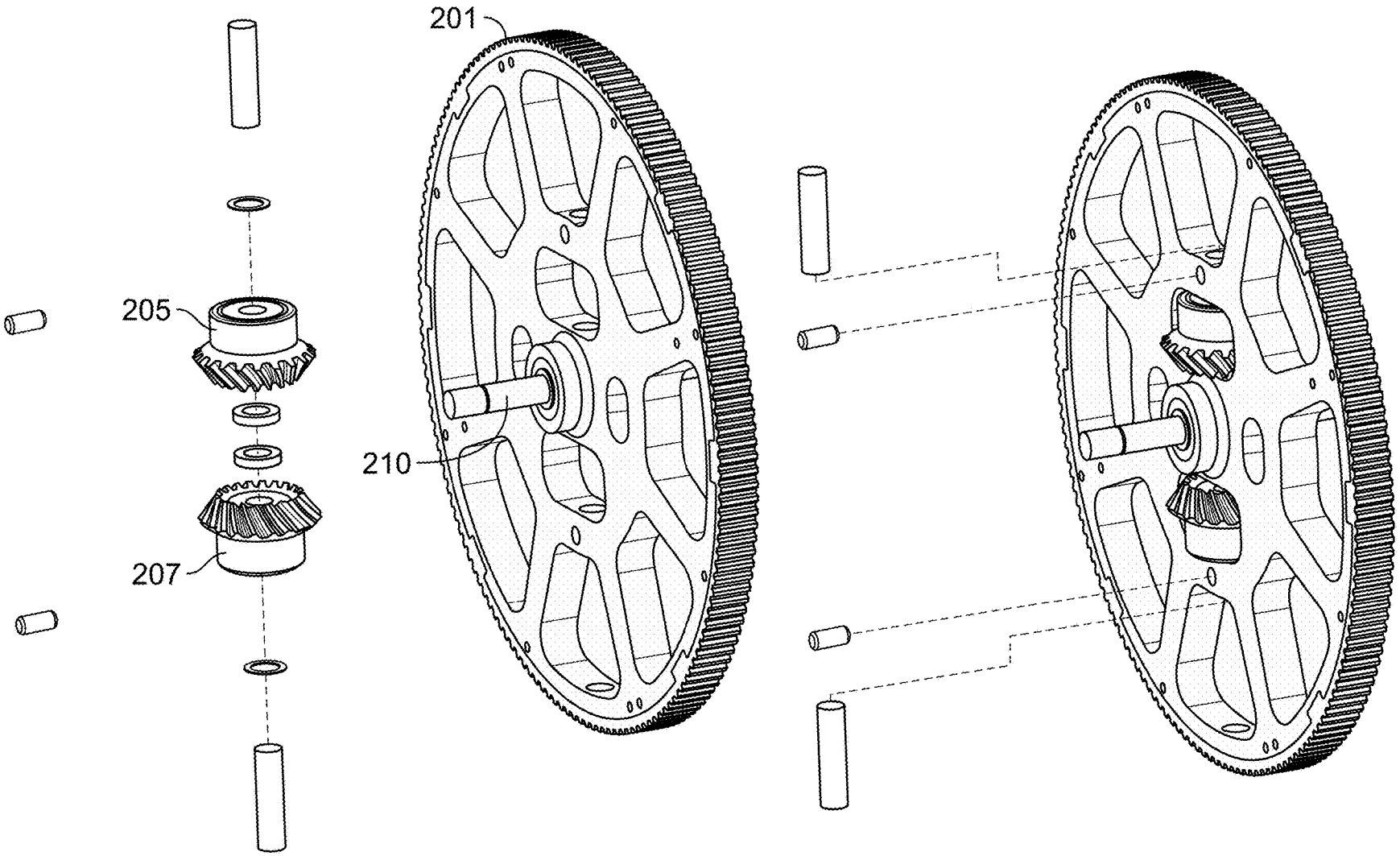
FIG. 12F illustrates an exploded perspective view drawing of planet gears (205, 207), sprocket (201) and shaft (210).
Figure 12G:
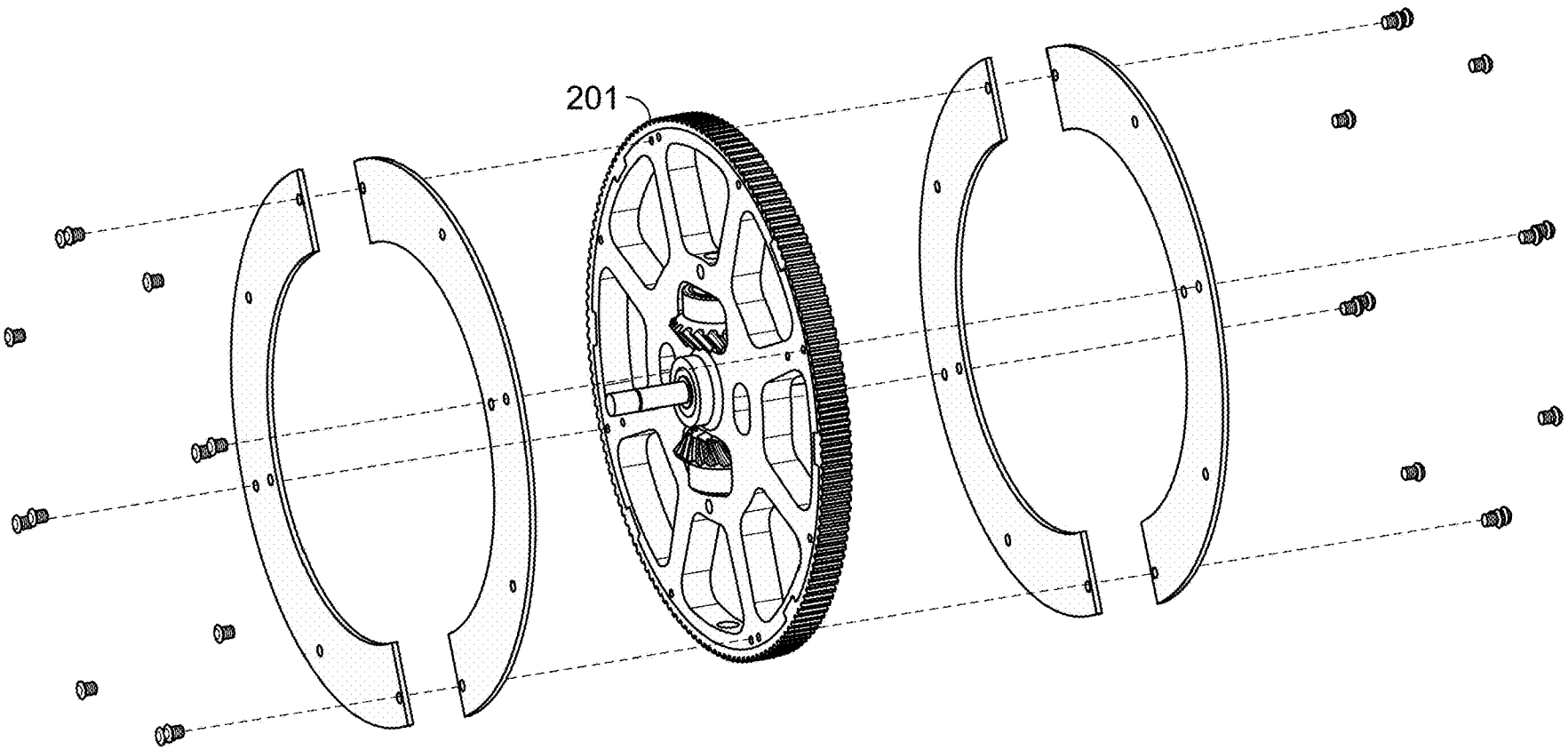
FIG. 12G illustrates an exploded perspective view drawing of a cover for sprocket (201).
Figure 12H:
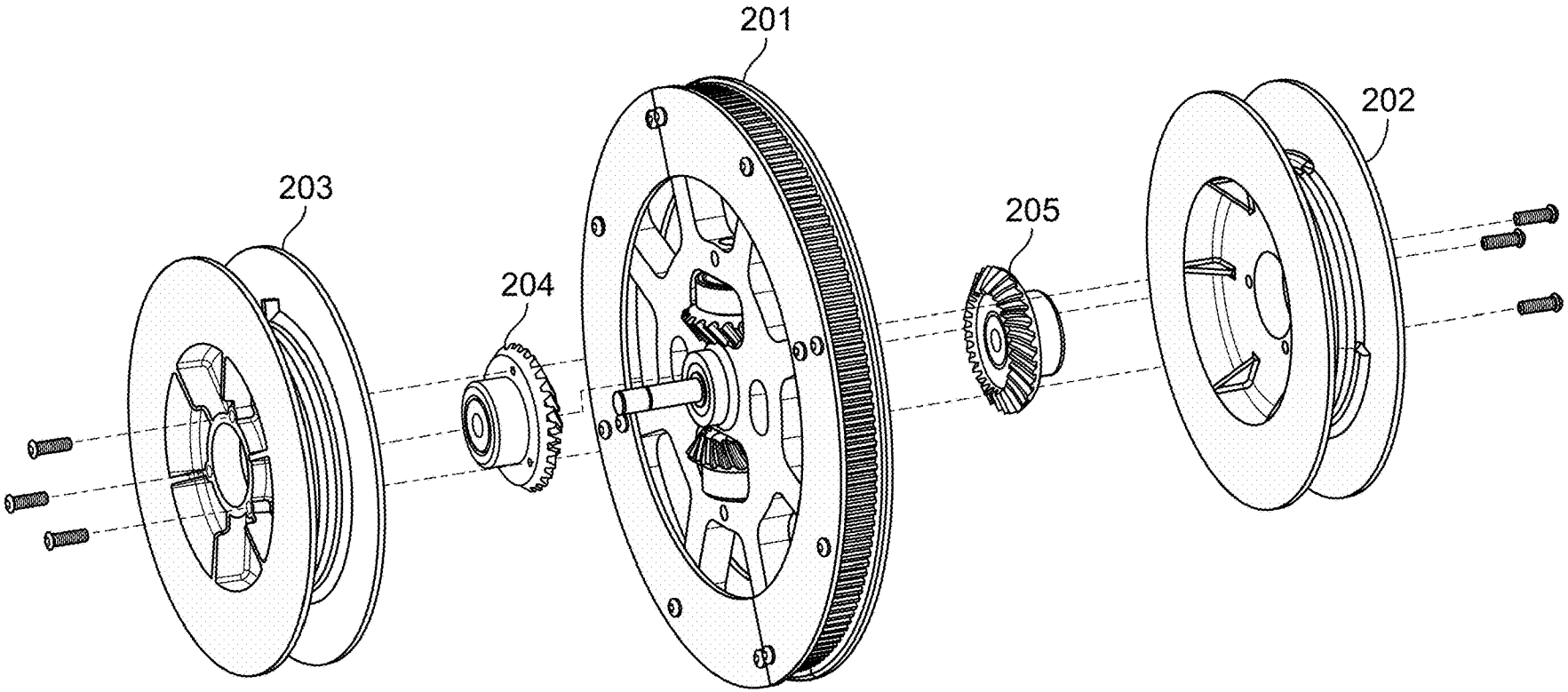
FIG. 12H illustrates an exploded perspective view drawing of the sun gears (204, 205) respectively bonded to spools (202, 203) and assembled with sprocket (201).
Figure 12I:
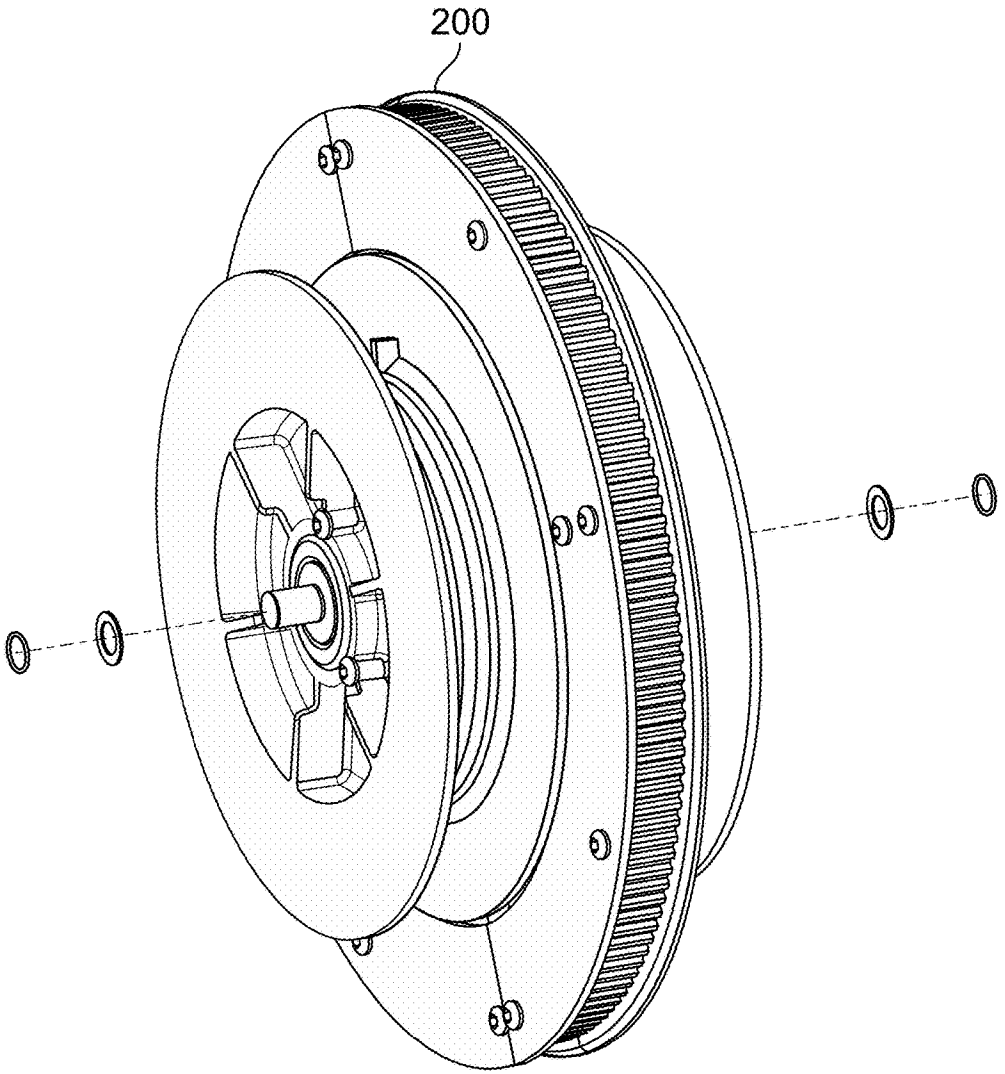
FIG. 12I illustrates an exploded perspective view drawing of the assembled differential (200) with finishing features.

Differential Mechanical Drawings. FIGS. 12E-12I illustrate detailed mechanical drawings of differential (200) and various features of the differential. FIG. 12E illustrates an exploded perspective view drawing of sprocket (201) and shaft (210). FIG. 12F illustrates an exploded perspective view drawing of planet gears (205, 207), sprocket (201) and shaft (210). FIG. 12G illustrates an exploded perspective view drawing of a cover for sprocket (201). FIG. 12H illustrates an exploded perspective view drawing of the sun gears (204, 205) respectively bonded to spools (202, 203) and assembled with sprocket (201). FIG. 12I illustrates an exploded perspective view drawing of the assembled differential (200) with finishing features.

Together, the components shown in FIGS. 12A-12I function as a compact, integrated, pancake style gearbox (200). The teeth (213) of sprocket (201), which mesh with toothed belt (104), enable the pancake differential/gearbox (200) to rotate in specific, pre-measured increments. This may allow electronics bay (600) to maintain an accurate account of the lengths of cables (500) and (501).

The use of a differential in a fitness application is not trivial as users are sensitive to the feel of cables. Many traditional fitness solutions use simple pulleys to divide tension from one cable to two cables. Using a differential (200) with spools may yield a number of benefits and challenges. An alternative to using a differential is to utilize two motor or tension generating methods. This achieves two cables, but may be less desirable depending on the requirements of the application.

One benefit is the ability to spool significantly larger amounts of cables. A simple pulley system limits the distance that the cable may be pulled by the user. With a spool based configuration, the only limitation on the length of the pull is the amount of the cable that may be physically stored on a spool—which may be increased by using a thinner cable or a larger spool.

One challenge is the feel of the cable. If a user pulls a cable and detects the teeth of the gears passing over one another, it may be an unpleasant experience for the user. Using spherical gears rather than traditional straight teeth bevel gears is disclosed, which provides smoother operation. Metal gears may be used, or plastic gears may be used to reduce noise and/or reduce the user feeling of teeth.

Cable Zero Point. With configurable arms (700, 702), the machine (1000) must remember the position of each cable (500, 501) corresponding to a respective actuator (800, 801) being fully retracted. As described herein, this point of full retraction is the "zero point". When a cable is at the zero point, the motor (100) should not pull further on that cable with full force. For example, if the weight is set to 50 lbs, the motor (100) should not pull the fully retracted cable with 50 lbs as that wastes power and generates heat.

In one embodiment, the motor (100) is driven to reduce cable tension instead to a lower amount, for example 5 lbs, whenever the end of the cable is within a range of length from the zero point, for example 3 cm. Thus when a user pulls on the actuator/cable that is at the zero point, they will sense 5 lbs of nominal tension of resistance for the beginning 3 cm, after which the intended full tension will begin, for example at 50 lbs.

In one embodiment, to determine the zero point upon system power-up the cables are retracted until they stop. In addition, if the system is idle with no cable motion for a pre-determined certain amount of time, for example 60 seconds, the system will recalibrate its zero point. In one embodiment, the zero point will be determined after each arm reconfiguration, for example an arm translation as described in FIGS. 5A and 5B above.

Cable Length Change. In order to determine when a cable is at the zero point, the machine may need to know whether and how much that cable has moved. Keeping track of cable length change is also important for determining how much of the cable the user is pulling. For example, in the process demonstrated in FIGS. 5A and 5B, if a user moves slider (403) down 20 cm, then the cable length will have increased by 20 cm. By keeping track of such length change, the machine (1000) avoids overestimating the length of the user's pull and avoids not knowing the ideal cable length at which to drop cable tension from full tension to nominal tension.

In a preferred embodiment, to keep track of cable length change the machine has a sensor in each of the column holes (405) of FIGS. 5A and 5B. When the user retracts pin (404), the sensor in that hole sends a signal to electronics bay (600) that slider (403) is about to be moved. Once the user moves slider (403) to a new location and resets pin (404), the track hole (405) receiving pin (404) sends a signal to electronics bay (600) of the new location of slider (403). This signal enables electronics bay (600) to compute the distance between the former hole and current holes (405), and add or subtract that value to the current recorded length of the cable. The control signals from holes (405) to electronics bay (600) concerning pin (404) retraction and resetting travel along physical transmission wires that maintain a connection regardless of where cable (501) or pin (404) are.

In practice, a user retracts and replaces pin (404) only when the cable is fully retracted since any cable resistance above the slider and arm weight matching resistance as described above makes it quite physically difficult to remove the pin. As the machine (1000) is always maintaining tension on the cable in order to offset the weight of the slider plus arm, as the slider moves up and down, the cable automatically adjusts its own length. After the pin is re-inserted, the machine re-zeroes the cable length and/or learns where the zero point of the cable is.

In an alternate embodiment, the sensor is in pin (404) instead of holes (405). In comparison to the preferred embodiment, the physical connections between holes (405) and electronics bay (600) still exist and signals are still generated to be sent to electronics bay (600) once pin (404) is removed or reset. One difference is that the signal is initiated by pin (404) instead of by the relevant hole (405). This may not be as efficient as the preferred embodiment because holes (405) still need to transmit their location to electronics bay (600) because of system startup, as if the hole (405) were not capable of transmitting their location, the machine would have no way of knowing where on track (402) slide (403) is located.

In one embodiment, using hole sensors (405) is used by the electronics (600) to determine arm position and adjust torque on the motor (100) accordingly. The arm position may also be used by electronics (600) to check proper exercise, for example that the arm is low for bicep curl and high for a lat pulldown.

Cable Safety. When a user has retracted cable (501), there is typically a significant force being applied on slider (403) of FIGS. 5A and 5B. This force makes it physically challenging for the user to retract pin (404) at this point. After the user retracts cable (501) to the zero point and the machine resets the tension at the nominal weight of 5 lbs, the user instead may find it easy to retract pin (404).

Without a safety protocol, if a user were able to begin removing pin (404) while, for example, 50 lbs of force is being applied to cable (501), a race would ensue between the user fully removing pin (404) and the machine reducing tension weight to 5 lbs. As the outcome of the race is indeterminate, there is a potentially unsafe condition that the pin being removed first would jerk the slider and arm suddenly upwards with 50 lbs of force. In one embodiment, a safety protocol is configured so that every sensor in holes (405) includes a safety switch that informs the electronics bay (600) to reduce motor tension to a safe level such as 5 or 10 lbs. The electrical speed of such a switch being triggered and motor tension being reduced is much greater than the speed at which the slider would be pulled upward against gravity.

In a preferred embodiment, the removal of the locking pin (404) causes the system to reduce cable tension to the amount of tension that offsets the weight of the slider and arm. This allows the slider and arm to feel weightless.

Wall Bracket. To make an exercise machine easier to install at home, in one embodiment the frame is not mounted directly to the wall. Instead, a wall bracket is first mounted to the wall, and the frame as shown in FIG. 1C is attached to the wall bracket. Using a wall bracket has a benefit of allowing a single person to install the system rather than requiring at least two people. Using a wall bracket also allows the mounting hardware such as lag bolts going into wall studs for the bracket to be concealed behind the machine. Alternately, if the machine (1000) were mounted directly, then mounting hardware would be accessible and visible to allow installation. Using a wall bracket also keeps the machine away from dust created while drilling into the wall and/or installing the hardware.

Compactness. An advantage of using digital strength training is compactness. The system disclosed includes the design of joints and locking mechanisms to keep the overall system small, for example the use of a pancake motor (100) and differential (200) to keep the system small, and tracks (400) and sliders (401) to keep arms (700) short.

The compact system also allows the use of smaller pulleys. As the cable traverses the system, it must flow over several pulleys. Traditionally fitness equipment uses large pulleys, often 3 inches to 5 inches in diameter, because the large diameter pulleys have a lower friction. The disclosed system uses many 1 inch pulleys because of the friction compensation abilities of the motor control filters in electronics box (600); the friction is not perceived by the user because the system compensates for it. This additional friction also dampens the feeling of gear teeth in the differential (200).

Figure 13:
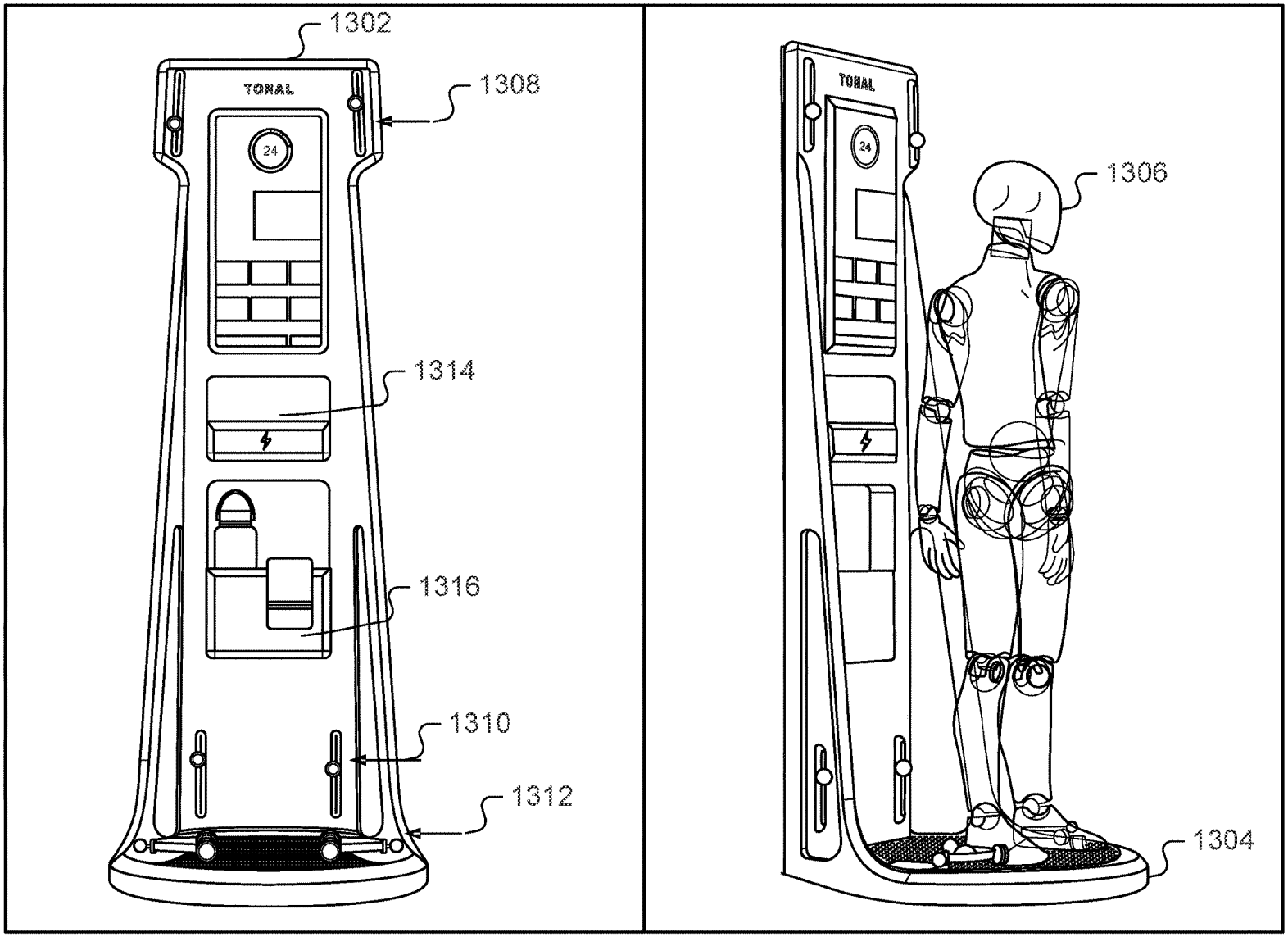
FIG. 13 is an illustration of a configuration of an exercise machine with a compact platform.

FIG. 13 is an illustration of a configuration of an exercise machine with a compact platform. FIG. 13 includes two perspective illustrations with a head-on elevation and a rotated perspective with a user mockup of where they may stand. Console unit (1302) is attached to a compact platform (1304) which may be fixed as shown or alternately may fold up into the console unit (1302). As referred to herein a 'compact platform' is one that maintains a lower profile in depth from console unit (1302) to the end of the platform (1304). A user (1306) may thus stand on platform (1304) to perform an exercise. In one embodiment, the platform (1304) may be a vibrational plate providing lower frequency/whole body vibration for a user's health benefit.

In one embodiment, the configuration of FIG. 13 shows cables routed without arms like that shown in FIG. 4 to position exertion points (704). Instead, exertion points such as (1308) and (1310) are routed along the console unit so that a user may thread a cable through an exertion point, for example exertion point (1308) may be suitable for a pull-down movement, and exertion point (1310) may be suitable for a pull-up movement. An auxiliary exertion point (1312) on the platform is also available for a user's movements out at the platform, for example a squat movement. One improvement of an arm-less design is a more reliable and simpler machine without the complication of arms.

In one embodiment, the configuration of FIG. 13 permits stowable accessories such as a device charging station (1314), and/or a water bottle/towel (1316). A sensor may be used to indicate to the exercise machine which particular accessory is being used currently by the user, for example if the rowing handle is not in the compartment. In one embodiment, the exercise machine has a sensor in the associated platform (1304) that can indicate where and/or how the user is positioning themselves and may be used to provide further feedback on a user's form and/or indicate when a dangerous situation may arise such as user exhaustion, falls, or trips.

Figure 14:
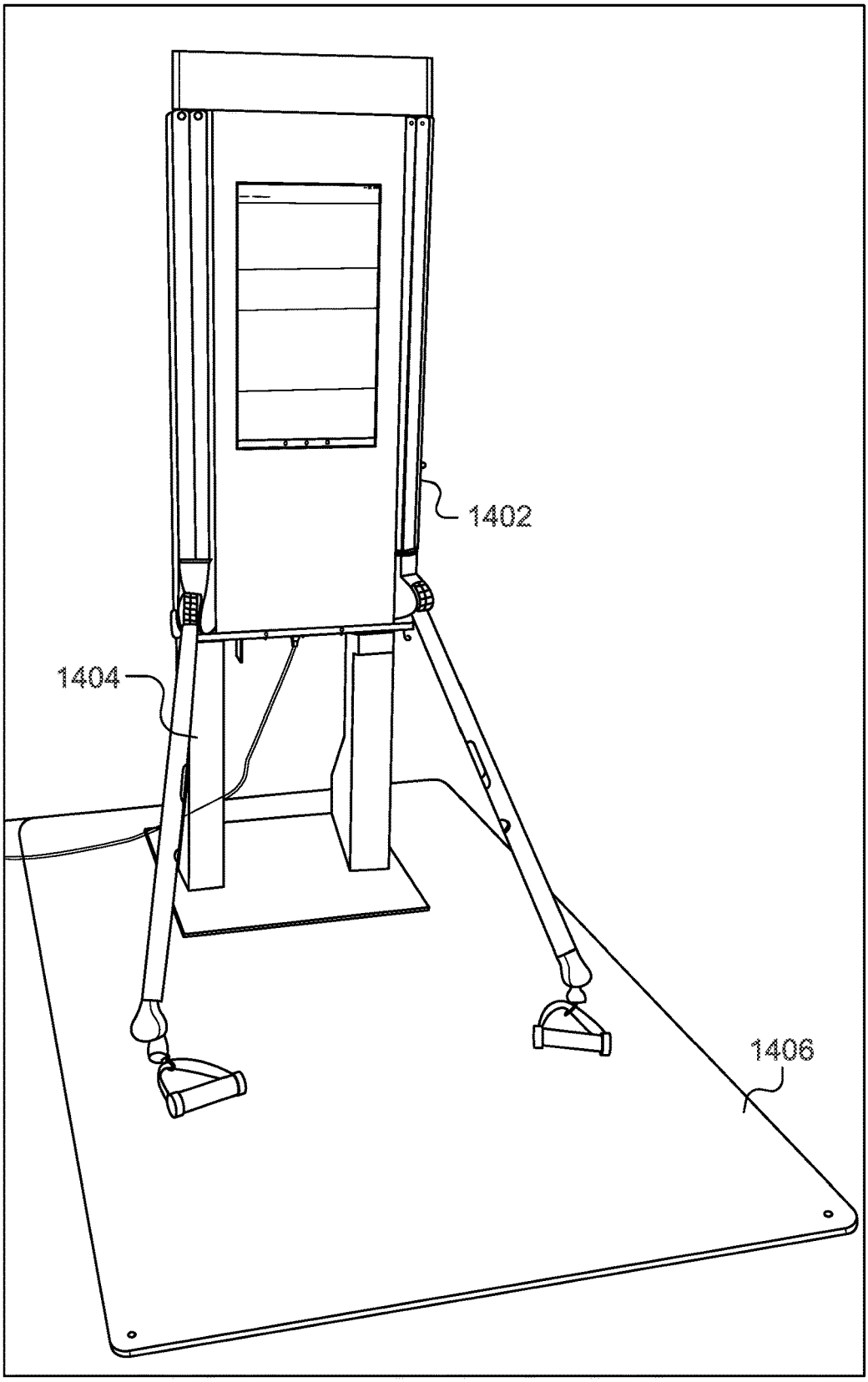
FIG. 14 is an illustration of a structural leg configuration of a freestanding exercise machine.

FIG. 14 is an illustration of a structural leg configuration of a freestanding exercise machine. FIG. 14 includes one rendered illustration. Console unit (1402) is attached to one or more structural legs (1404) which may be subsequently attached to a larger platform (1406) for enhanced stability. As referred to herein a 'structural leg' is one that supports a console unit (1302) and/or mounts the console unit (1302) freestanding to a floor. An improvement of the freestanding unit shown in FIG. 14 is that it is designed for the flexibility of a console unit (1402) with arms as shown.

In one embodiment, the platform (1406) may be attached directly to the structural leg (1404) to provide stability along the breadth and depth axes, and/or counterweight to balance either the user and/or the user's motions. In one embodiment, the leg (1404) is not attached to any platform (1406).

Figure 15:
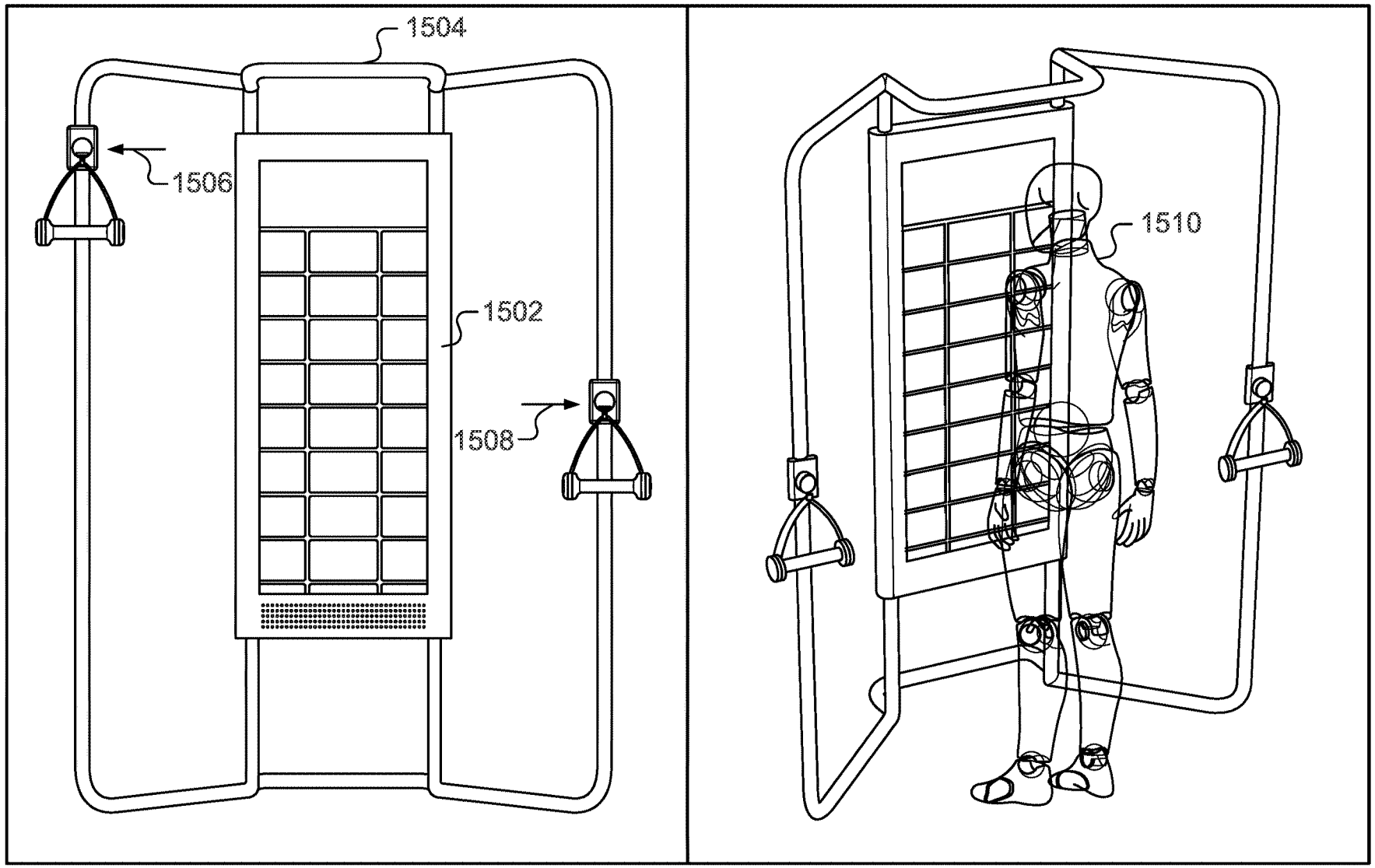
FIG. 15 is an illustration of a cage configuration of a freestanding exercise machine.

FIG. 15 is an illustration of a cage configuration of a freestanding exercise machine. FIG. 15 includes two rendered illustrations of different perspectives, including one with a user mockup of where they may stand.

Figure 16:
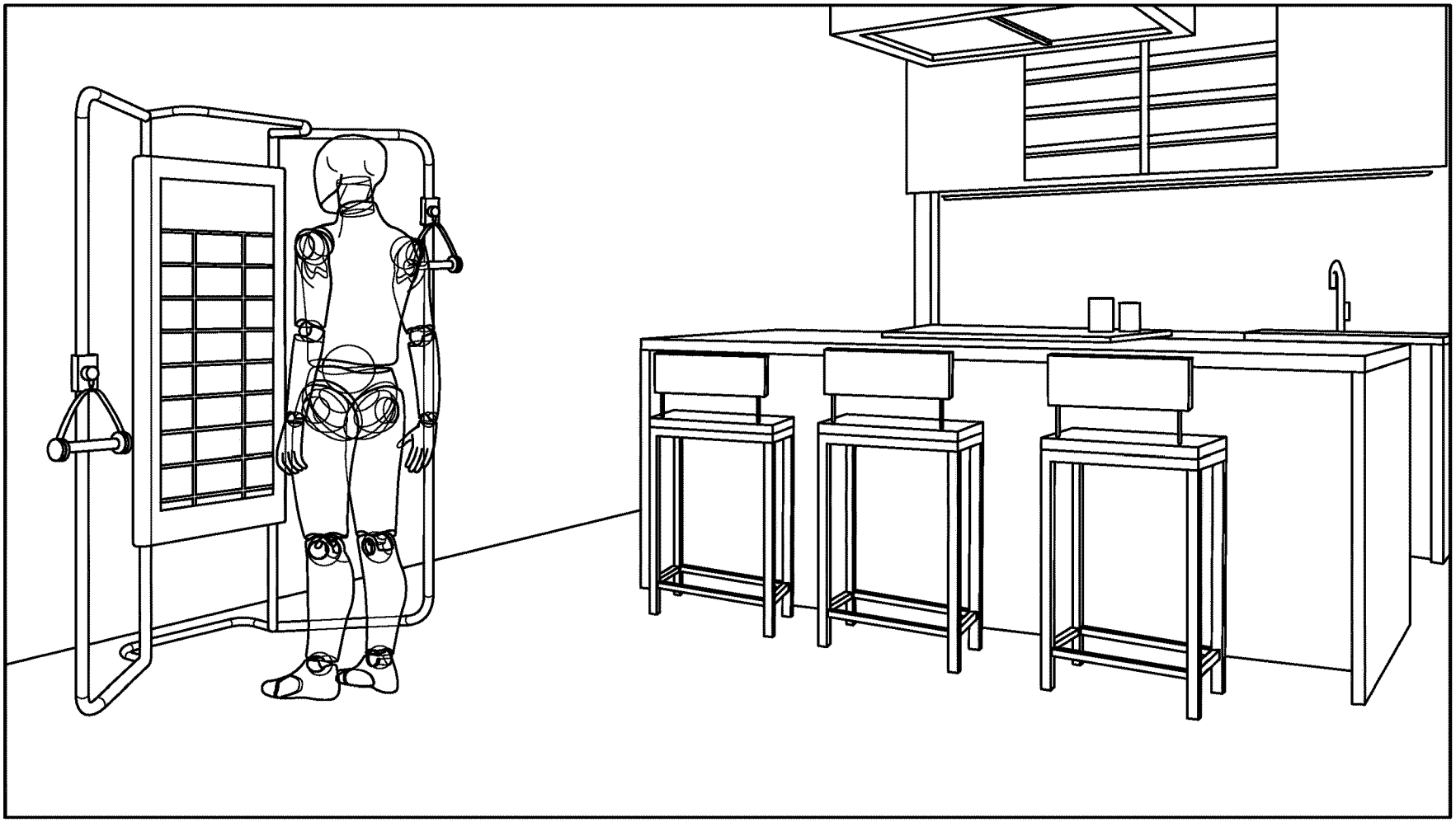
FIG. 16 is a contextual illustration of a cage configuration of a freestanding exercise machine shown in a residential room.

Console unit (1502) is attached to a 'cage' (1504), referred to herein as any structure that relies on its own rigidity to provide a freestanding mount. In one embodiment, the cage is foldable to be a lower profile in depth. Instead of requiring complex, confusing, and/or costly arms, the console unit (1502) relies on cage exertion points (1506), (1508), for a user (1510) to exert against, for example a pull-down movement (1506) or a machine fly movement (1508). In one embodiment, a cable attached to a motor on console (1502) is routed directly to an attachable and lockable pulley (1506) (1508). In one embodiment, a cable attached to a motor on console (1502) is routed around the cage to an attachable and lockable pulley (1506) (1508) so that cables are more discreet and safer for users. FIG. 16 is a contextual illustration of a cage configuration of a freestanding exercise machine shown in a residential room.

Figure 17:
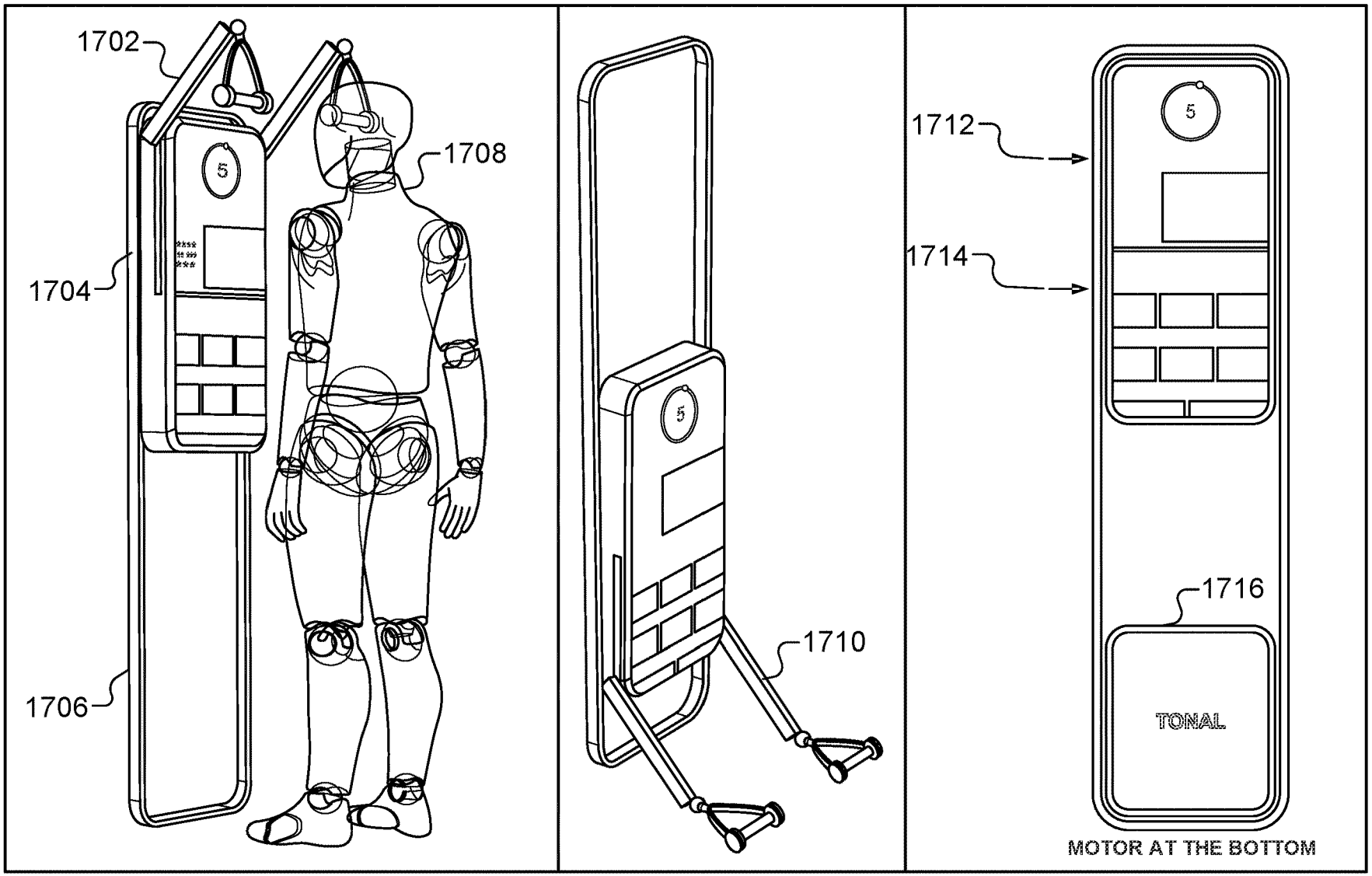
FIG. 17 is an illustration of an adjustable screen unit configuration of an exercise machine.

FIG. 17 is an illustration of an adjustable screen unit configuration of an exercise machine. FIG. 17 includes two rendered illustrations of different perspectives, including one with a user mockup of where they may stand, and a third rendered illustration of an alternate configuration with a motor unit closer to ground.

In one embodiment, fixed arms (1702) are coupled to a console unit (1704). As opposed to fully-articulated arms as shown in FIG. 4, fixed arms (1702) have fixed length of arm with a sliding rail to position the 'shoulder' of the arm at a certain height, and a tilt articulation to further tilt the arm vertically to position the 'wrist' of the arm at an exertion point; shown in FIG. 17 in a raised tilt articulation (1702) or a lowered tilt articulation (1710). Such fixed arms give an improvement of greater robustness, ease of use, and/or higher simplicity over those fully-articulated arms in FIG. 4.

The console unit (1704) may itself adjust along a sliding rail (1706) which may be the same rail as the arm sliding rail or a different sliding rail, for example an outer rail for the console unit (1704) and an inner rail for the arms (1702). In one embodiment, the resistance unit (1716) is removable from the console unit (1712) to improve stability with a lower center of mass, and arms are stowable (1714) at a fully vertical position so as to be taken out of the way of use and kept a lower profile in depth.

As shown in FIG. 17, the exercise machine may comprise a set of rails, wherein the screen unit is translatable along the set of rails (1706). In one embodiment not shown in FIG. 17, the resistance unit and the screen unit are integrated as a single unit, and wherein the resistance unit and the screen unit are translatable together along the set of rails. In one embodiment the resistance unit (1716) and the screen unit (1704) are separate units, and wherein the screen unit (1704) is translatable separately from the resistance unit (1716).

Figure 18:
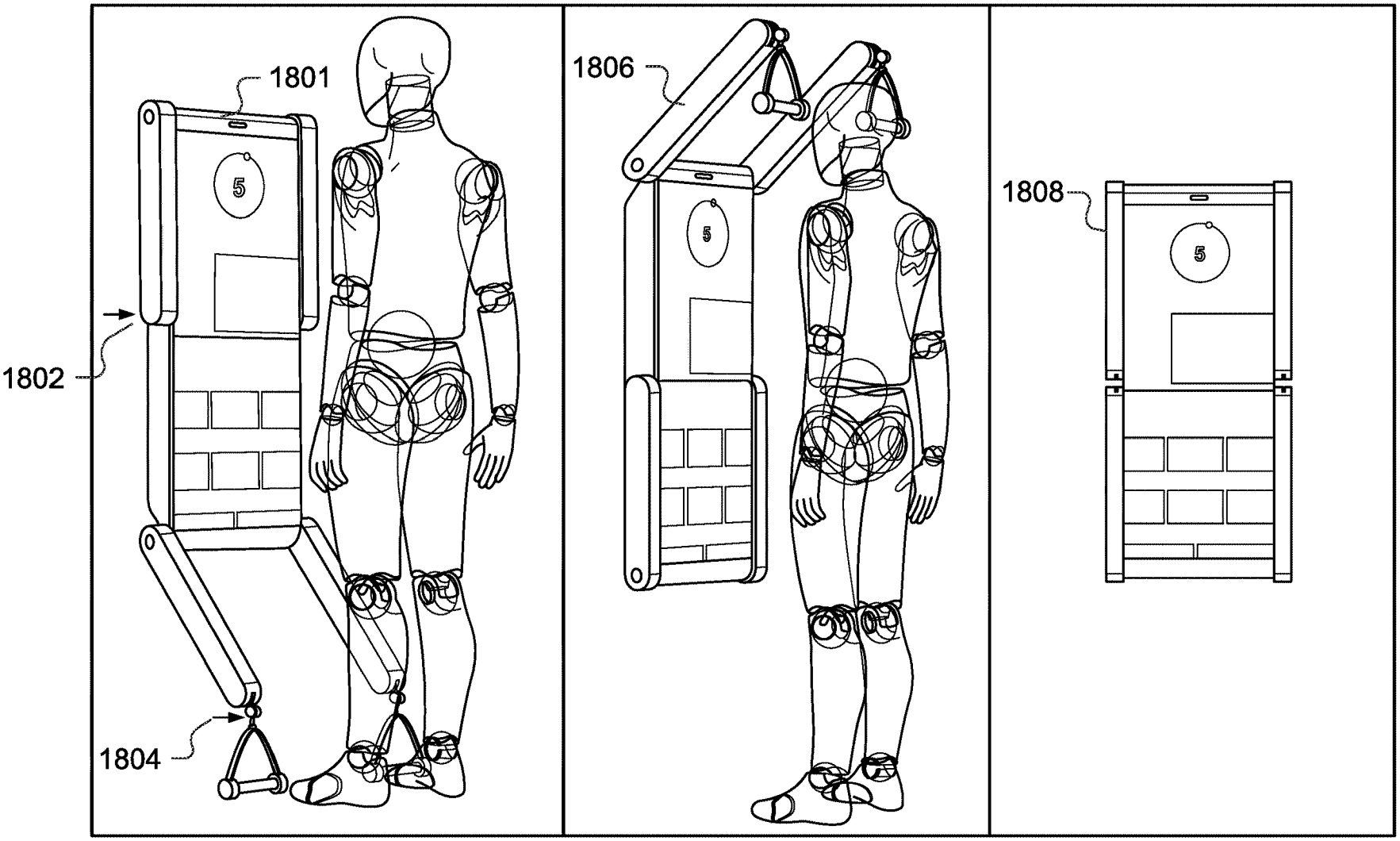
FIG. 18 is an illustration of an alternate exertion point positioning configuration of an exercise machine.

FIG. 18 is an illustration of an alternate exertion point positioning configuration of an exercise machine. FIG. 18 includes three rendered illustrations, two with a user mockup of where they may stand, and each with different exertion point positioning.

In one embodiment, console unit (1801) has four arms of both fixed length and a fixed shoulder-point of which they may be adjustably tilted. In one embodiment, the upper arms (1802) and the lower arms (1804) are coupled such that they tilt together. Such fixed arms give an improvement of greater robustness, ease of use, and/or higher simplicity over those fully-articulated arms in FIG. 4. The arms are stowable (1802) along the profile of the console unit (1801), may tilt to an exertion point lower than the user (1804), or to an exertion point higher than the user (1806). When both sets of arms are stowed (1808) the wall-mounted console unit is lower-profile.

With more than one arm, an increased number of motors may be used, for example using two motors with two arms instead of one motor with two arms via a differential such as that shown in FIGS. 12A-12D, using two motors with four arms and two differentials, or using four motors with four arms without any differentials.

Figure 19:
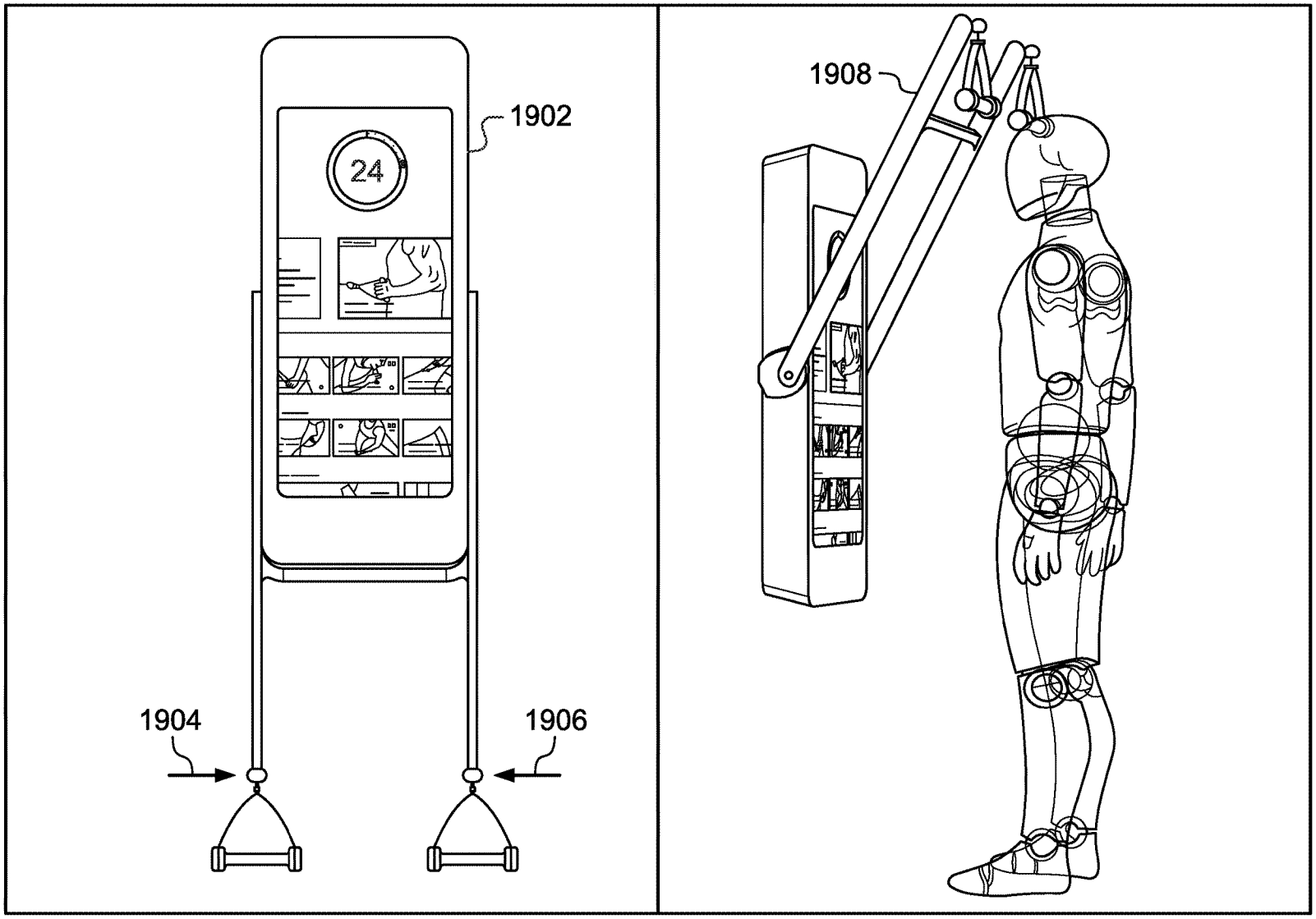
FIG. 19 is an illustration of an alternate exertion point positioning configuration of an exercise machine.

FIG. 19 is an illustration of an alternate exertion point positioning configuration of an exercise machine. FIG. 19 includes two rendered illustrations, one with a user mockup of where they may stand, and each with different exertion point positioning.

In one embodiment, console unit (1902) has two arms of fixed length and a fixed shoulder-point of which they may be adjustably tilted. In one embodiment, the arms (1904) and (1906) are coupled (1908) such that they tilt together. Such fixed arms give an improvement of greater robustness, ease of use, and/or higher simplicity over those fully-articulated arms in FIG. 4. The arms are stowable along the profile of the console unit (1902), may tilt to an exertion point lower than the user (1904) (1906), or to an exertion point higher than the user (1908). When both sets of arms are stowed (1904) (1906) the wall-mounted console unit is lower-profile.

With more than one arm, an increased number of motors may be used, for example using two motors with two arms instead of one motor with two arms via a differential such as that shown in FIGS. 12A-12D.

Figure 20:
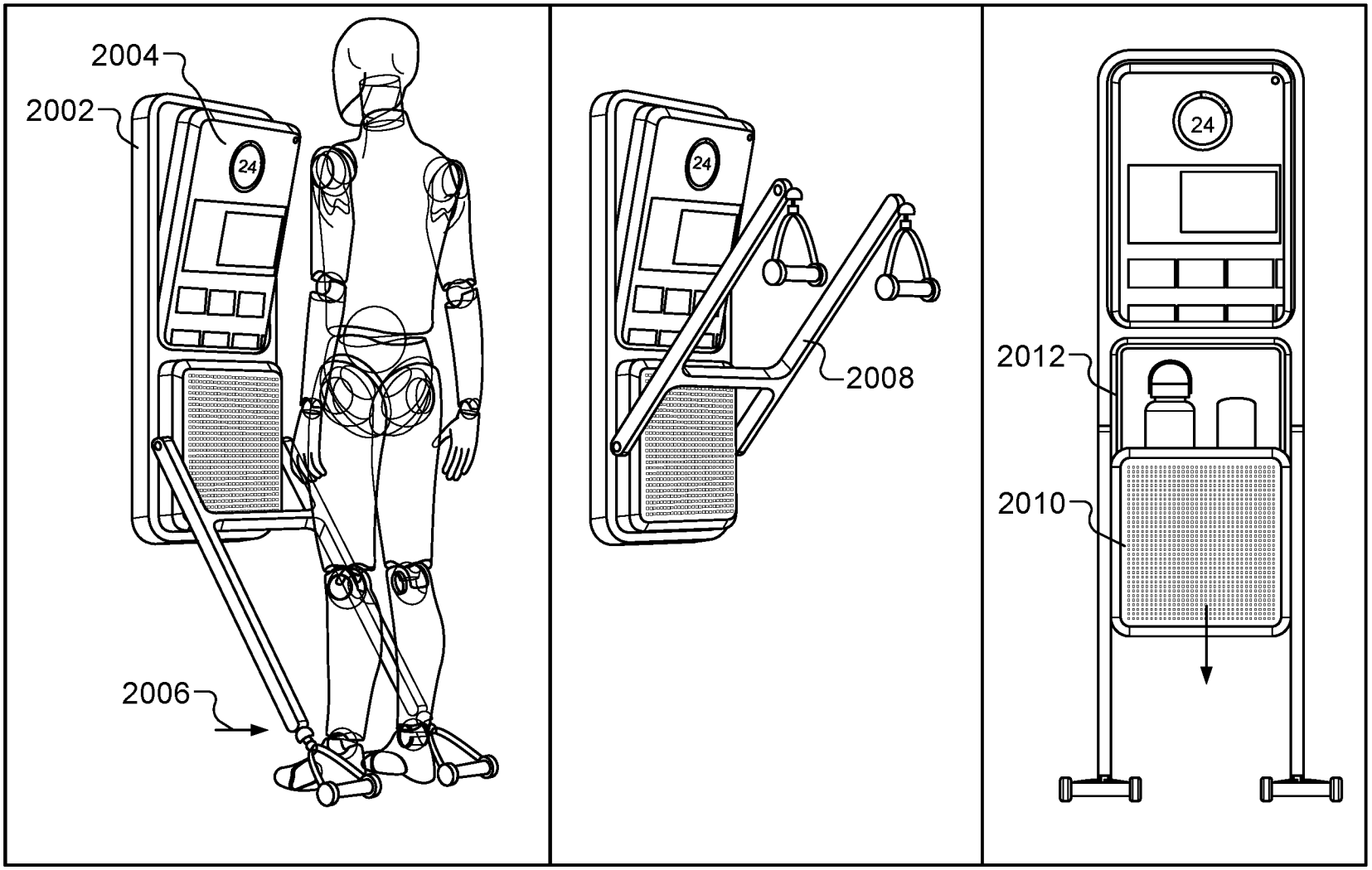
FIG. 20 is an illustration of an adjustable screen unit/alternate exertion point positioning configuration of an exercise machine.

FIG. 20 is an illustration of an adjustable screen unit/alternate exertion point positioning configuration of an exercise machine. FIG. 20 includes three rendered illustrations, one with a user mockup of where they may stand, and each with different exertion point positioning and/or screen unit adjustment.

In one embodiment, console unit (2002) has two arms of fixed length and a fixed shoulder-point of which they may be adjustably tilted. The console unit (2002) includes a screen unit (2004) that may be tilted out/downward from the console unit. In one embodiment, the arms (2006) are coupled (2008) such that they tilt together. Such fixed arms give an improvement of greater robustness, ease of use, and/or higher simplicity over those fully-articulated arms in FIG. 4. The arms are stowable along the profile of the console unit, may tilt to an exertion point lower than the user (2006), or to an exertion point higher than the user (2008). Accessories may be stowed by sliding a lower portion of the console unit (2010) and revealing the stowed accessories (2012) such as a water bottle, towel or actuator.

A sensor may be used to indicate to the exercise machine which particular accessory (2012) is being used currently by the user, for example if the rowing handle is not in the compartment. With more than one arm, an increased number of motors may be used, for example using two motors with two arms instead of one motor with two arms via a differential such as that shown in FIGS. 12A-12D.

Figure 21:
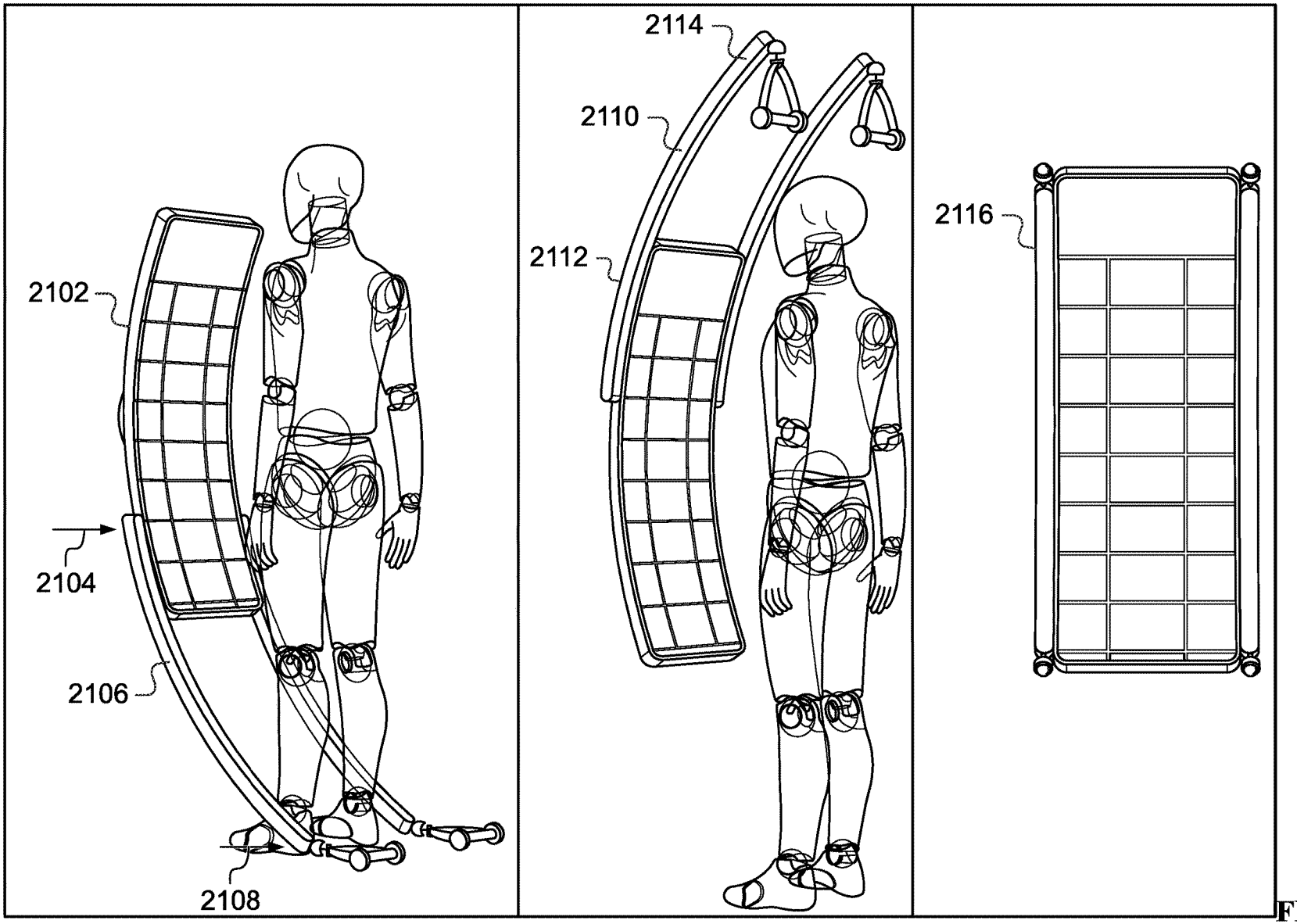
FIG. 21 is an illustration of a curved screen unit/alternate exertion point positioning configuration of an exercise machine.

FIG. 21 is an illustration of a curved screen unit/alternate exertion point positioning configuration of an exercise machine. FIG. 21 includes three rendered illustrations, two with a user mockup of where they may stand, and each with different exertion point positioning and/or screen unit adjustment.

In one embodiment, console unit including a curved screen unit (2102) has two curved arms (2106) of fixed length along a curved rail, of which the arms may be secured along the rail. One end of an arm (2104) may be used to secure the arm along the rail, and the other end of an arm (2108) may be used as an exertion point, as shown in FIG. 21 when an exertion point is lower for the user, say for a pull-up movement. This may be reversed where the exertion end of the arm becomes a secure end (2112) when the arm is on the other side (2110) of the console unit, and the other end of the arm (2114) becomes a higher exertion point, say for a pull-down movement.

In one embodiment, the screen unit (2102) may be slid along the curved rail to provide further screen adjustment. In one embodiment, the arms (2106) are coupled such that they tilt together. Such fixed arms give an improvement of greater robustness, ease of use, and/or higher simplicity over those fully-articulated arms in FIG. 4. The arms are stowable along the profile of the console unit (2116), may tilt to an exertion point lower than the user (2108), or to an exertion point higher than the user (2114). With more than one arm, an increased number of motors may be used, for example using two motors with two arms instead of one motor with two arms via a differential such as that shown in FIGS. 12A-12D.

Figure 22:
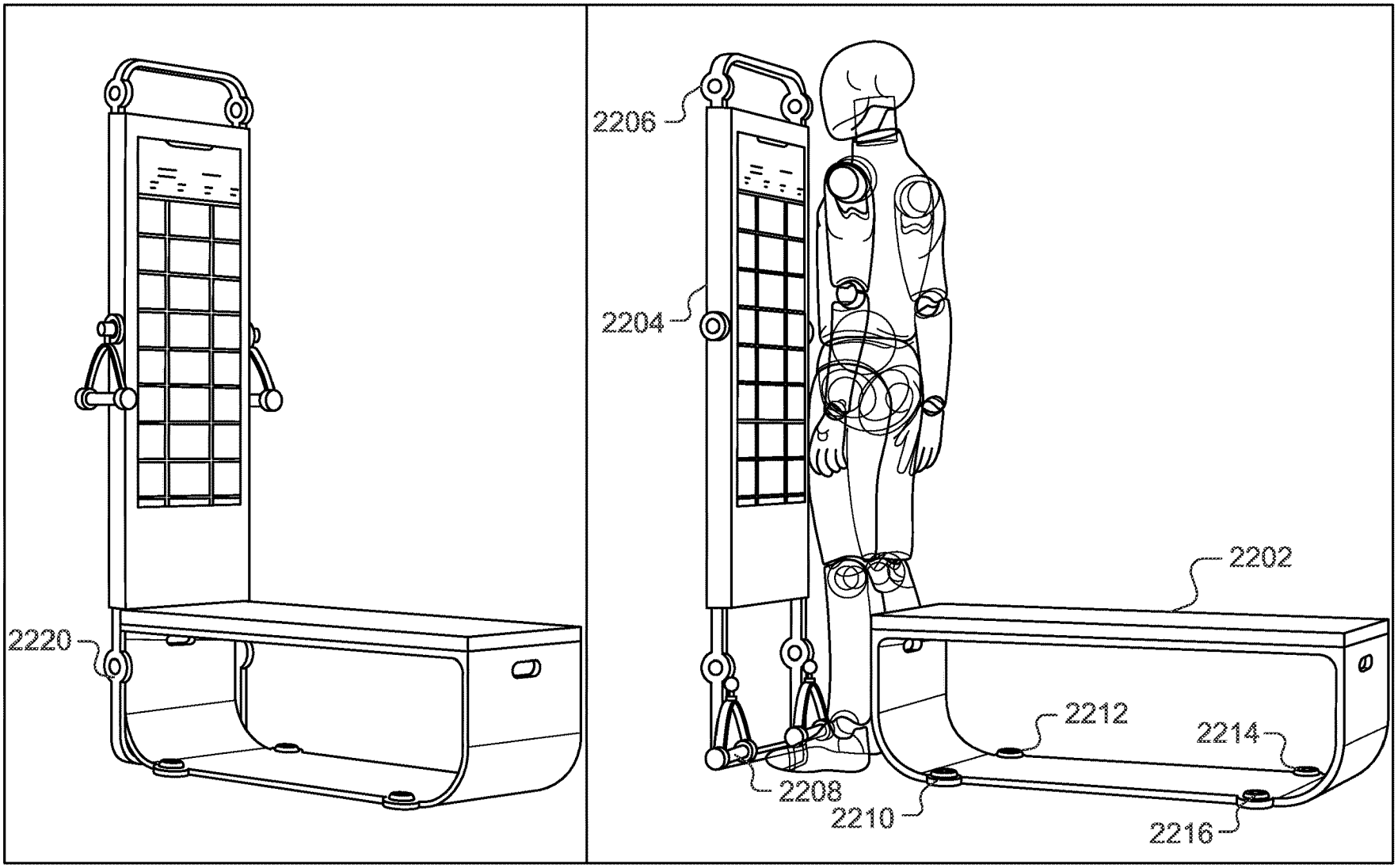
FIG. 22 is an illustration of a bench style auxiliary exertion point configuration of an exercise machine.

FIG. 22 is an illustration of a bench style auxiliary exertion point configuration of an exercise machine. FIG. 22 includes two rendered illustrations, one with a user mockup of where they may stand, and each with different auxiliary exertion point positioning and/or bench position.

In one embodiment, a bench is used to (2202) provide one or more auxiliary extension points for the console unit (2204), which has its own adjustable extension points, for example at the top of the machine (2206) and bottom of the machine (2208), shown in FIG. 22 with an actuator/handle. The bench (2202) may have a number of auxiliary extension points, for example four points (2210), (2212), (2214), and (2216). The bench may also be structurally coupled (2220) with the console unit to provide a freestanding configuration that no longer needs wall-mounting or other vertical mounting. In one embodiment, the bench is a "T" style bench (not shown in FIG. 22) that provides additional structural stability.

Figure 23:
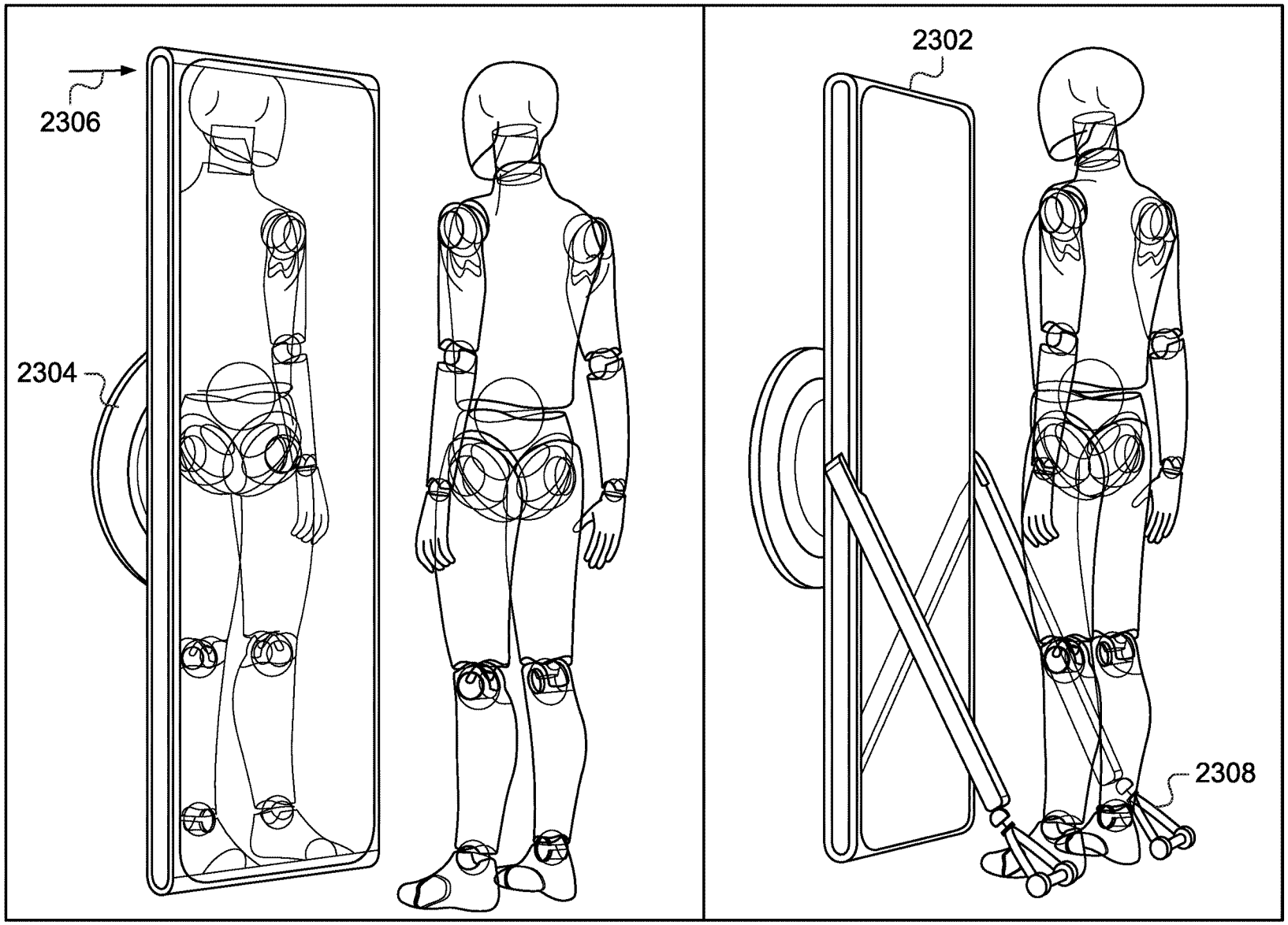
FIG. 23 is an illustration of an adjustable/rotatable screen unit configuration of an exercise machine.

FIG. 23 is an illustration of an adjustable/rotatable screen unit configuration of an exercise machine. FIG. 23 includes two rendered illustrations, each with a user mockup of where they may stand, and each with different exertion point positioning.

In one embodiment, a console unit with optional mirror finish (2302) is mounted to a wall using a rotatable mount (2304). As referred to herein, a 'mirror finish' is a smart mirror display that allows a user to see themselves while exercising while still retaining a digital display that is transmissive through the mirror. In one embodiment, arms (2306) have a fixed shoulder joint at the rotatable mount (2304) so that the wrist of the arm (2306) may be stowed or rotated out (2308). As the vertically oriented console unit (2302) and/or screen unit may be rotated to a 'landscape' or 'portrait' orientation, the screen unit is likewise rotatable, along with the range of possible exertion point positioning when the arms are rotated.

Figure 24:
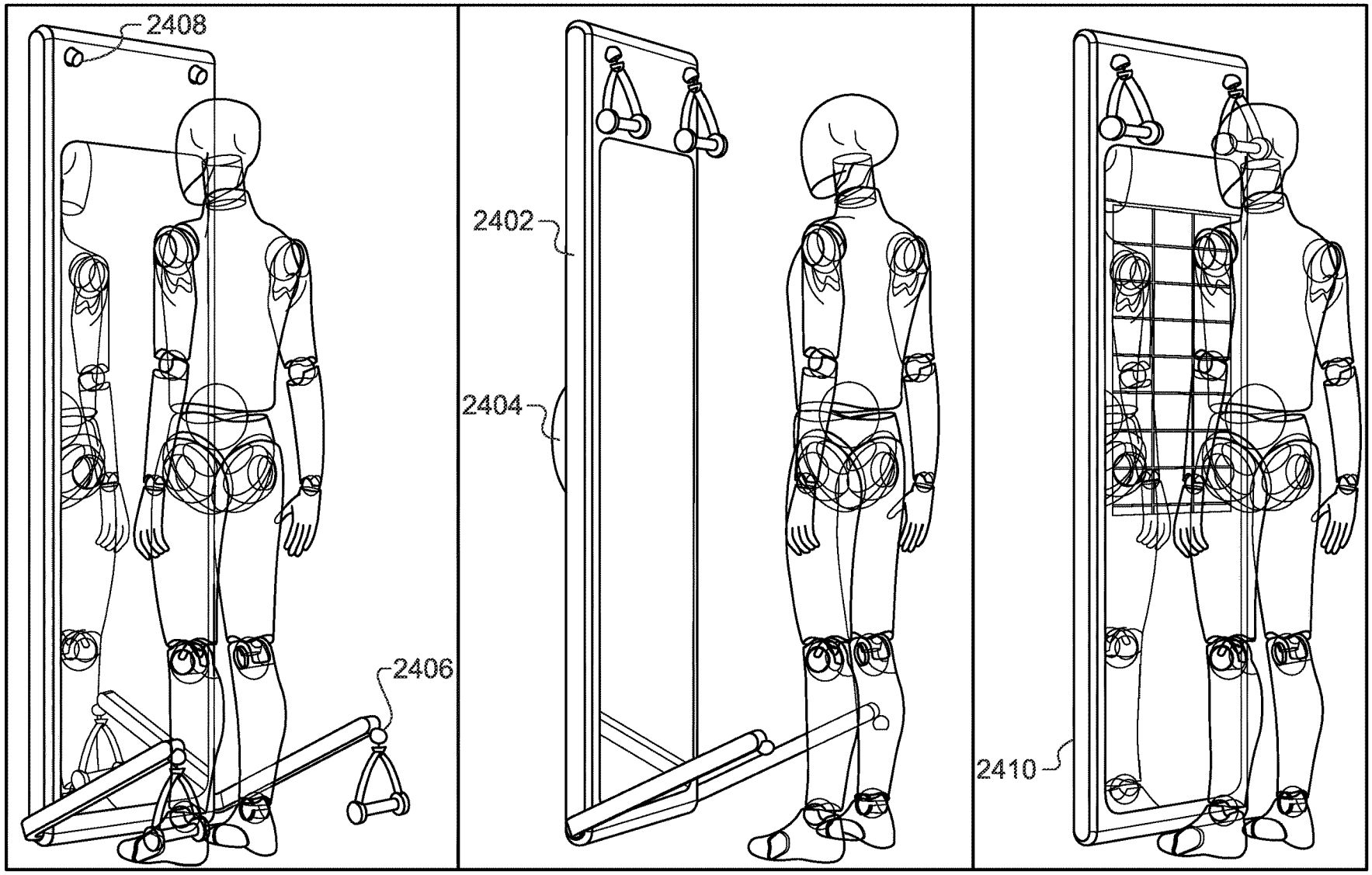
FIG. 24 is an illustration of full-length screen unit configuration of an exercise machine.

FIG. 24 is an illustration of full-length screen unit configuration of an exercise machine. FIG. 24 includes three rendered illustrations, each with a user mockup of where they may stand, and each with different exertion point positioning.

In one embodiment, a console unit with optional mirror finish (2402) is of full-height and mounted to a wall using a mount (2404). An improvement of a full-height unit is that some exercise machine or movement mass and/or mechanical stress may be transferred to the floor, lowering the danger of a wall mount failing and allowing a simpler mount (2404). In one embodiment, the console unit uses only simple fixed-length ground shoulder arms (2406) that may rotate from a stowed position inline with the console unit (2402) out to the ground for lower exertion point movements such as pull-ups. For higher exertion point movements, a static exertion point (2408) may be used along with internal pulleys to transfer for example a cable to point (2408). Such fixed arms give an improvement of greater robustness, ease of use, and/or higher simplicity over those fully-articulated arms in FIG. 4.

Figure 25:
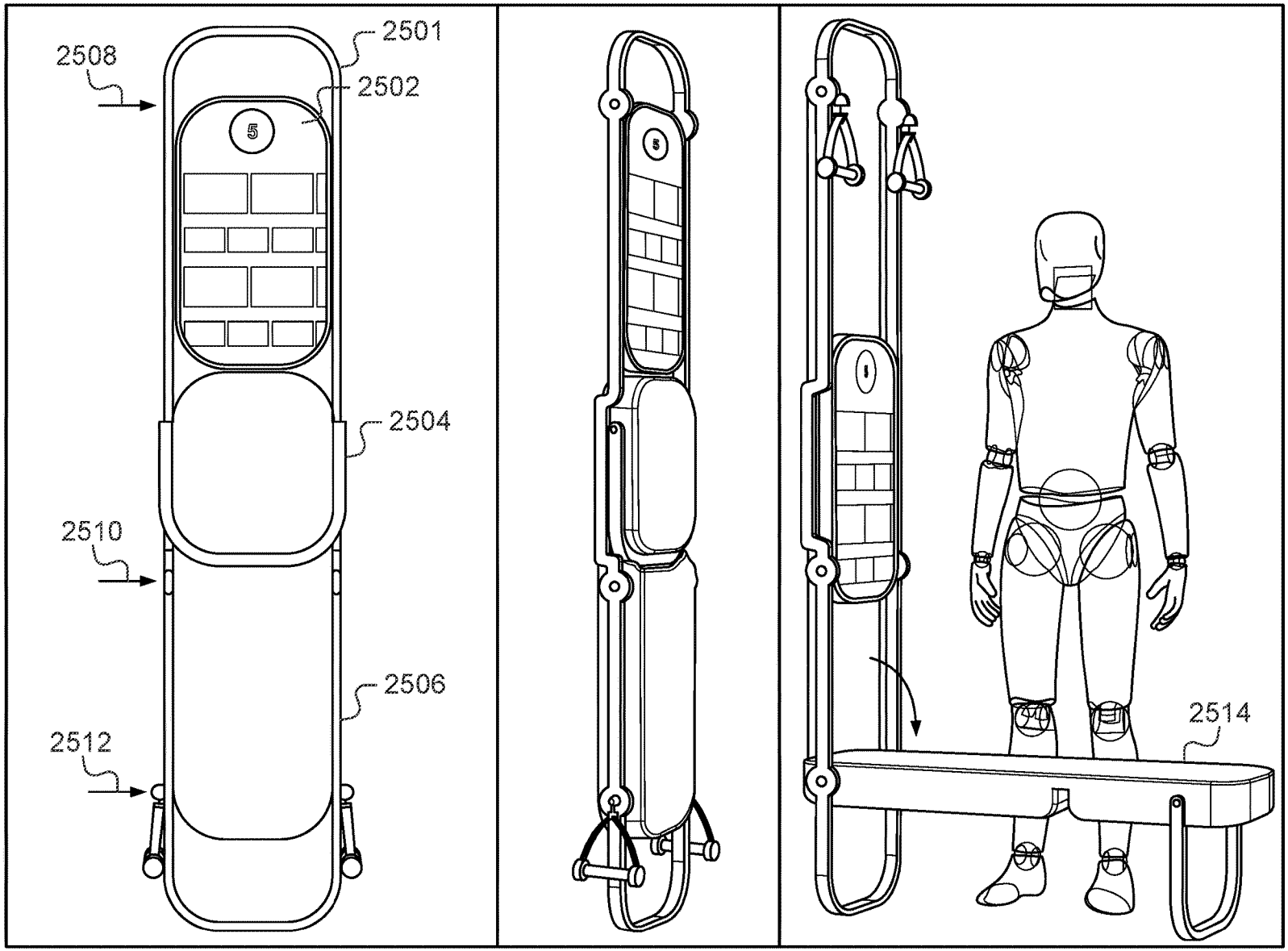
FIG. 25 is an illustration of a stowable bench style configuration of an exercise machine.

FIG. 25 is an illustration of a stowable bench style configuration of an exercise machine. FIG. 25 includes three rendered illustrations, one with a user mockup of where they may stand, and each with different perspective and/or bench position.

In one embodiment, a full-length wall mounted rail system (2501) includes a display unit (2502) that may slide along the rails, and a resistance unit (2504) as part of a stowable bench (2506) that rotates out from the rail system. An improvement of the full-length rail (2501) is that some exercise machine or movement mass and/or mechanical stress may be transferred to the floor, lowering the danger of a wall mount failing and allowing a simpler mount. The rail system includes two exertion points (2508) and (2510), and the bench includes an exertion point (2512) along the rail system and auxiliary exertion point (2514). In one embodiment, the bench is a "T" style bench (not shown in FIG. 25) that provides additional structural stability. An improvement of this arm-less design is that of greater robustness, ease of use, and/or higher simplicity over those fully-articulated arms in FIG. 4.

Figure 26:
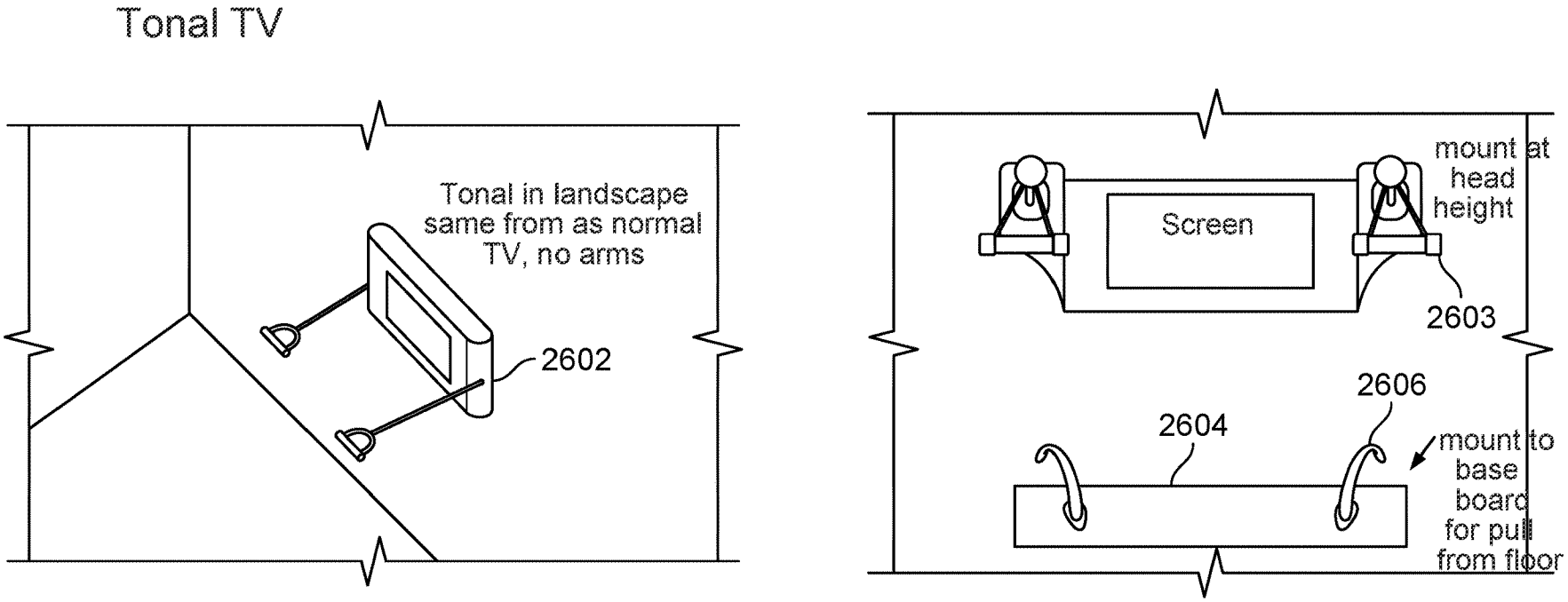
FIG. 26 is an illustration of a television configuration of an exercise machine.

FIG. 26 is an illustration of a television configuration of an exercise machine. FIG. 26 includes two illustrations, one with a perspective drawing and one with a head-on elevation that includes a floorboard.

Console unit (2602) is a wall mounted unit including a display unit and a resistance unit, in a landscape orientation as is typical for any television. In one embodiment, the console unit (2602) has no arms as shown in FIG. 4, but two exertion points on the side of the display unit. The console unit (2602) may have all the normal functionality of a television for viewing broadcast, cable, satellite, and/or streaming content. The console unit (2602) may be mounted at a height level to the user for appropriate movements such as a rowing pull from exertion point (2603). A floorboard accessory (2604) below the console unit (2602) with hooks and/or pulleys (2606) to channel a cable from point (2603) through a lower exertion point (2606) for movements such as a curl or pull-up.

Figure 27:
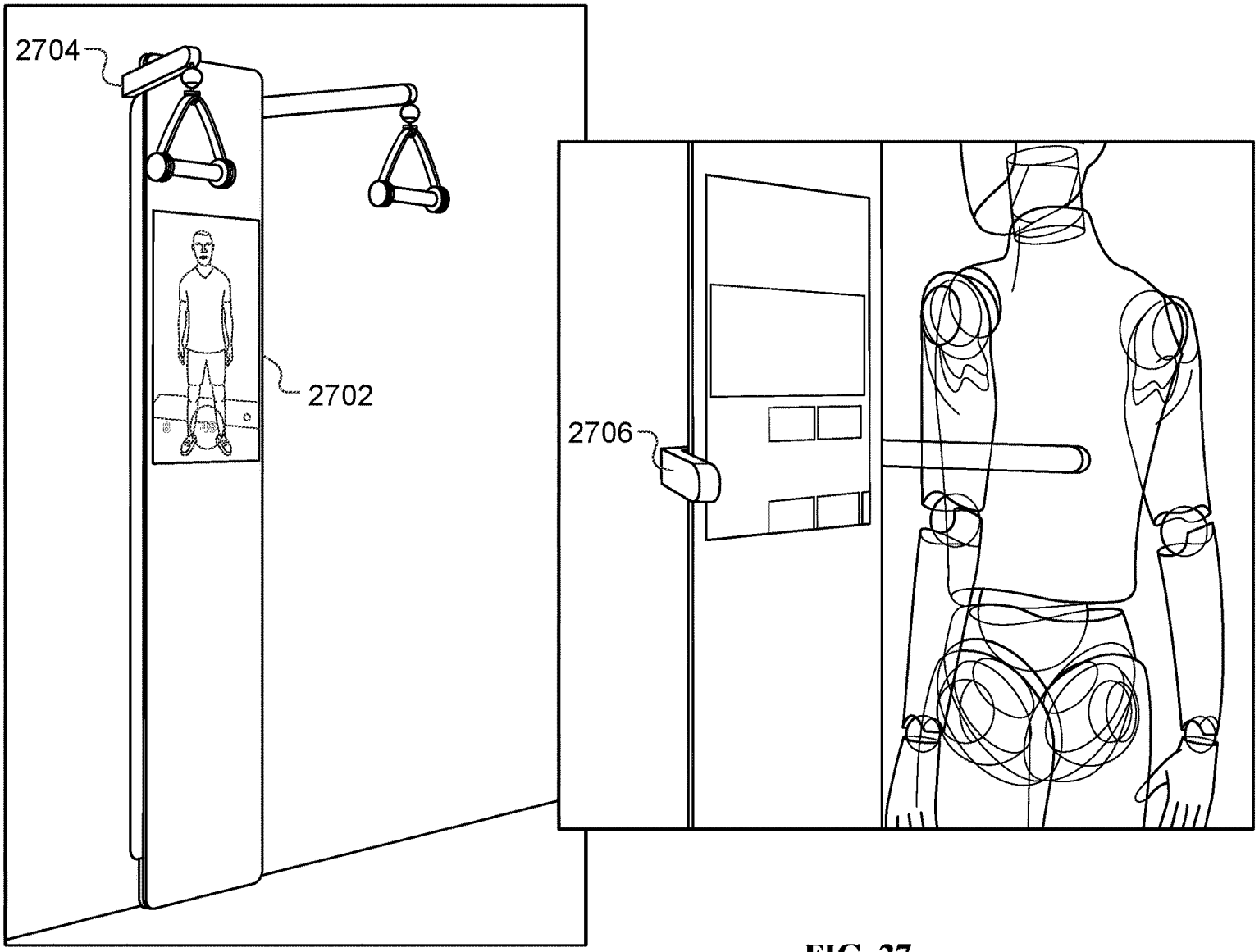
FIG. 27 is an illustration of an alternate full-length screen unit configuration of an exercise machine.

FIG. 27 is an illustration of an alternate full-length screen unit configuration of an exercise machine. FIG. 27 includes two rendered illustrations with arms in different positions.

In one embodiment, similar to FIG. 24, a console unit with optional mirror finish (2702) is of full-height and mounted to a wall. An improvement of a full-height unit is that some exercise machine or movement mass and/or mechanical stress may be transferred to the floor, lowering the danger of a wall mount failing and allowing a simpler mount. In one embodiment, the console unit uses only simple fixed-length top shoulder arms (2702) from the top of the machine for upper exertion point movements such as pull-downs. In one embodiment, the fixed arms may slide along the side of the console unit (2702) downwards for lower exertion point movements (2706), and then be stowed out of the way by returning them to their top position (2704). Such fixed arms give an improvement of greater robustness, ease of use, and/or higher simplicity over those fully-articulated arms in FIG. 4.

Figure 28:
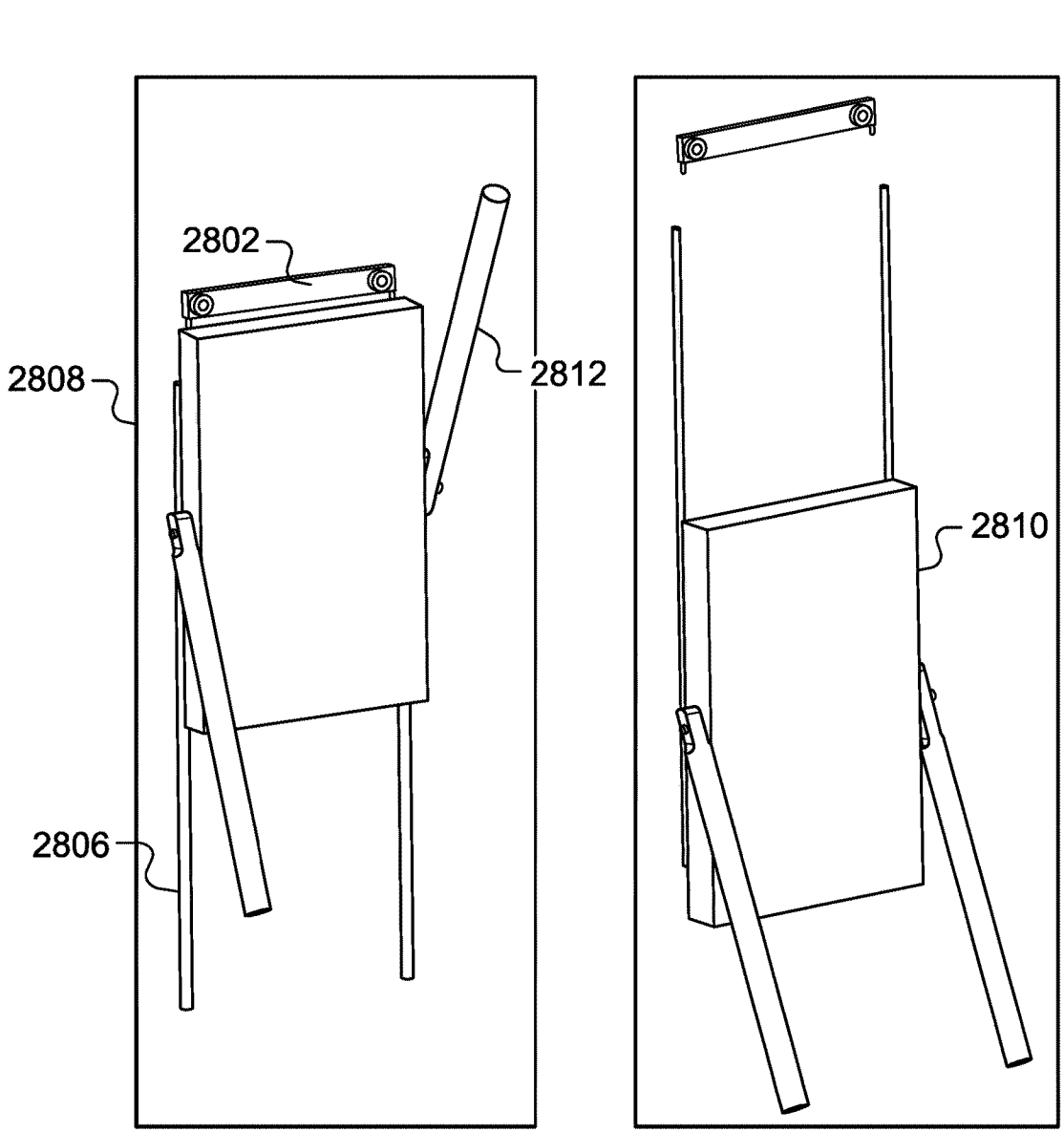
FIG. 28 is an illustration of a slide-rail configuration of an exercise machine.

FIG. 28 is an illustration of a slide-rail configuration of an exercise machine. FIG. 28 includes two rendered illustrations with the console unit in different positions.

In one embodiment, the slides and/or rails described earlier, for example in FIGS. 15, 16, 17, 21, and 25, use a slide-rail similar to that depicted in FIG. 28. A secure mounting bracket (2802) is used to counterweight the console unit (2804), and one or more rails (2806) are used to provide the track for the slide-rail system. As shown in FIG. 28, having a slide-rail allows the console unit to move vertically up (2808) or down (2810), allowing the arms (2812) to be simpler and static relative to the console unit (2804). Such fixed arms give an improvement of greater robustness, ease of use, and/or higher simplicity over those fully-articulated arms in FIG. 4.

Figure 29:
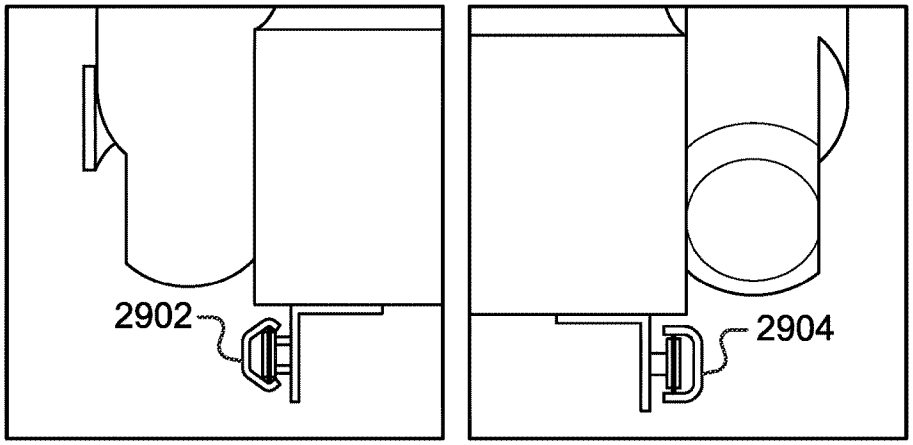
FIG. 29 is an illustration of a slide-rail configuration detail of an exercise machine.
Figure 29:
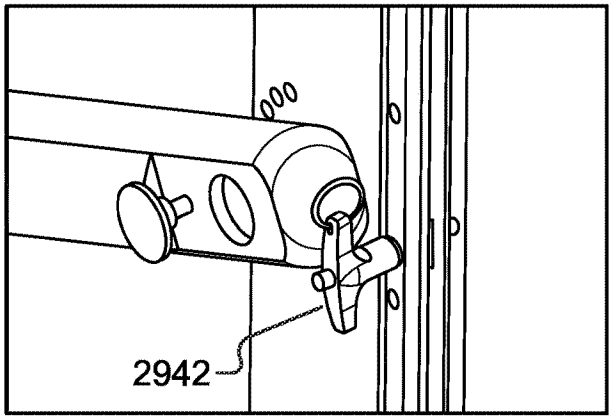
Figure 29:
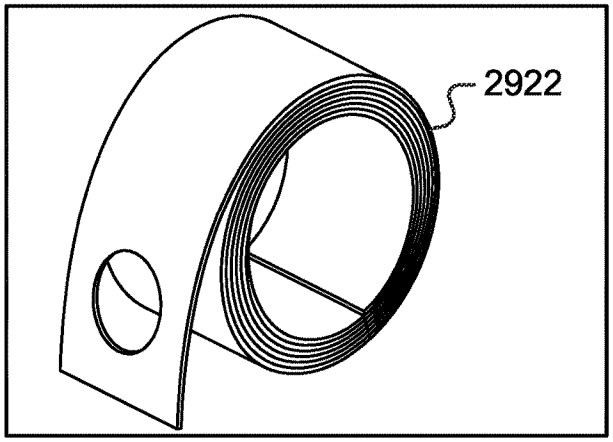

FIG. 29 is an illustration of a slide-rail configuration detail of an exercise machine. FIG. 29 includes four rendered illustrations, two of an embodiment of a rail system, one of an embodiment of a counterbalance, and one of an embodiment of a locking system.

In one embodiment, the preferred rail system for the configuration shown generally in FIG. 28 is one that accounts for some misalignment, for example a V track (2902), or a C track (2904). In one embodiment, a constant force spring (2922) may be used as a counterbalancing force for the mounting bracket (2802) in FIG. 28. In one embodiment, pins (2942), for example spring-loaded pins, may be used for a possible locking system, for example an arm locking system.

Figure 30:
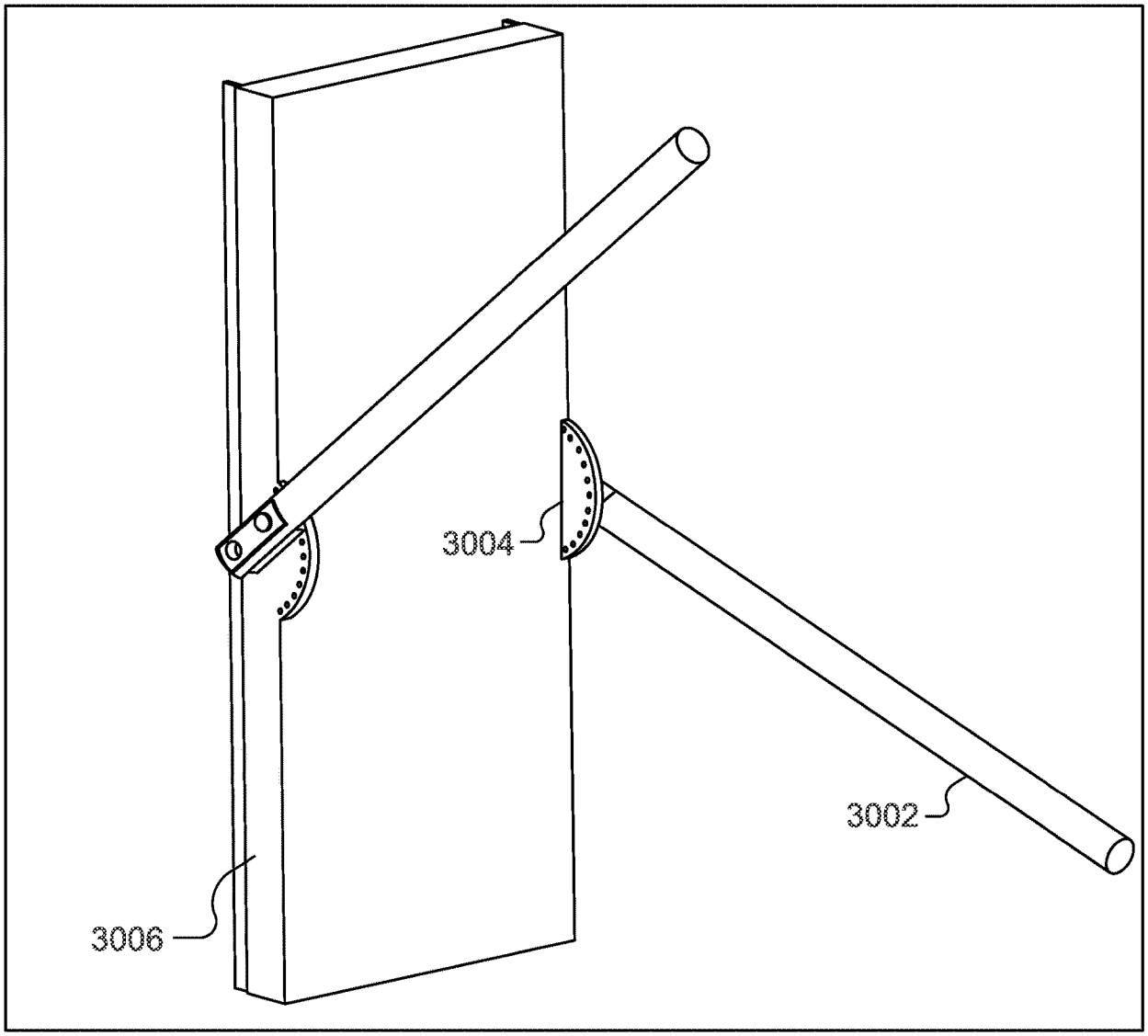
FIG. 30 is an illustration of a slide-rail configuration arm detail of an exercise machine.

FIG. 30 is an illustration of a slide-rail configuration arm detail of an exercise machine. FIG. 30 includes one rendered illustration, of an embodiment of an arm pivot system.

In one embodiment, with the slide-rail shown in FIGS. 28-29, the arms (3002) are fixed and/or made simple. Such fixed arms give an improvement of greater robustness, ease of use, and/or higher simplicity over those fully-articulated arms in FIG. 4. In one embodiment, pins (2942) shown in FIG. 29, are used to provide a single pivot (3004) for each arm. In one embodiment, an arm length is between 36" and 60", for example 45". When a higher or lower movement is being performed, the console unit (3006) may then be lowered or raised along the slide-rail. In comparison to the arms of FIG. 4, the arms may be mechanically stronger to handle the static arm and/or pin locking system.

Figure 31:
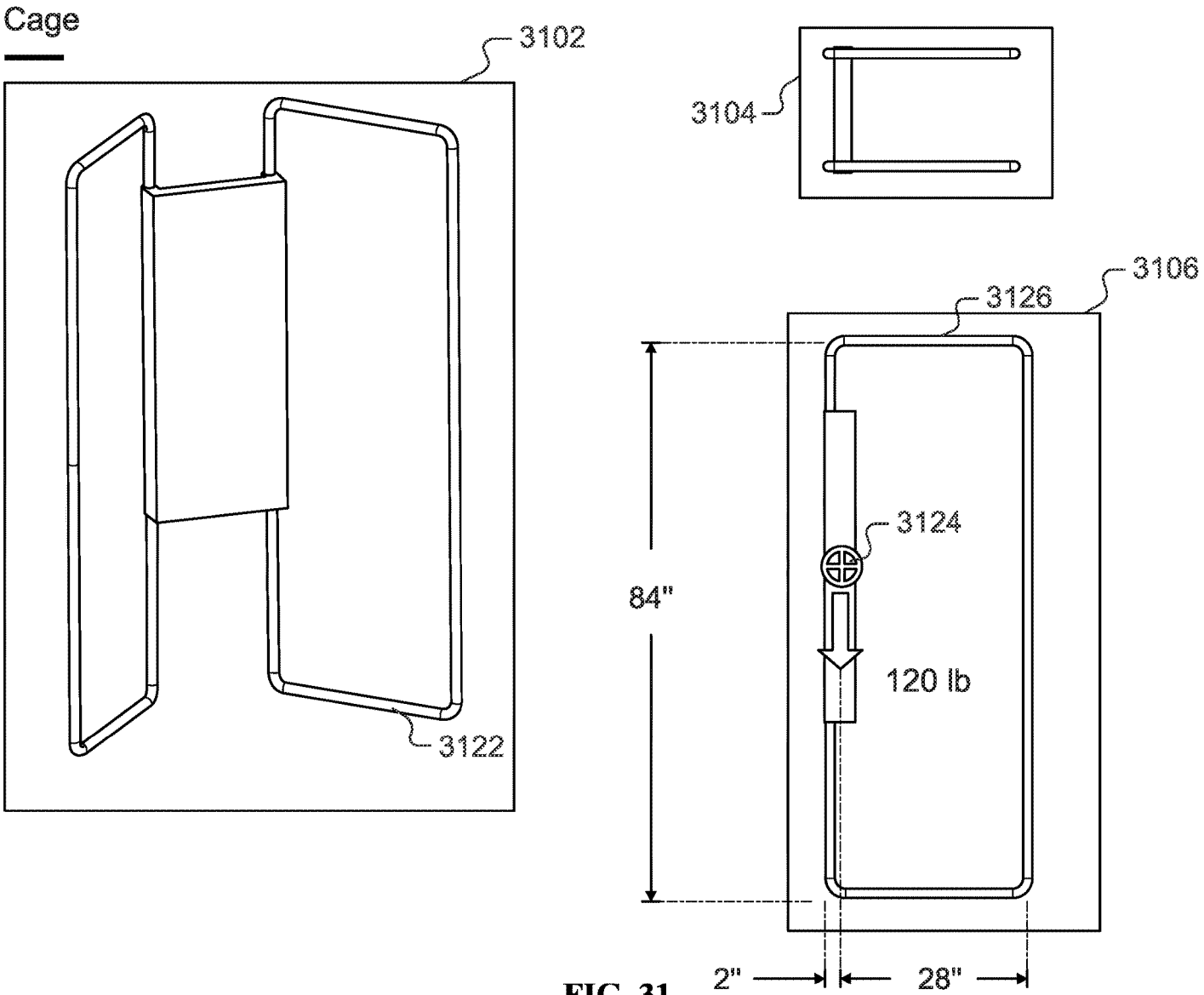
FIG. 31 is an illustration of a cage configuration of an exercise machine.

FIG. 31 is an illustration of a cage configuration of an exercise machine. FIG. 31 includes three rendered illustrations of the machine from three different perspectives, including a perspective with the cage sides splayed open (3102), a plan view from above with the cage sides perpendicular to the console unit (3104), and a side elevation from its right side when the cage sides are perpendicular to the console unit (3106).

In one embodiment, a cage and/or rack configuration is similar to that shown in earlier in FIGS. 15 and 16. In one embodiment, such a cage configuration is a freestanding configuration. Several assumptions are made in FIG. 31 for tipping calculations: that the cage has sufficient anti-slide surfacing on the bottom (3122) so that it does not slide on the floor, that the unit weight is 120 lbs, that the center of gravity is the center of console unit (3124), That the height of the cage is 84 inches, that the cage side (3126) length is 30 inches or 28 inches from the center of gravity, and that the cage sides are perpendicular to the unit, providing an optimistic case for forward tipping rather than splaying them outright (3102).

Figure 32:
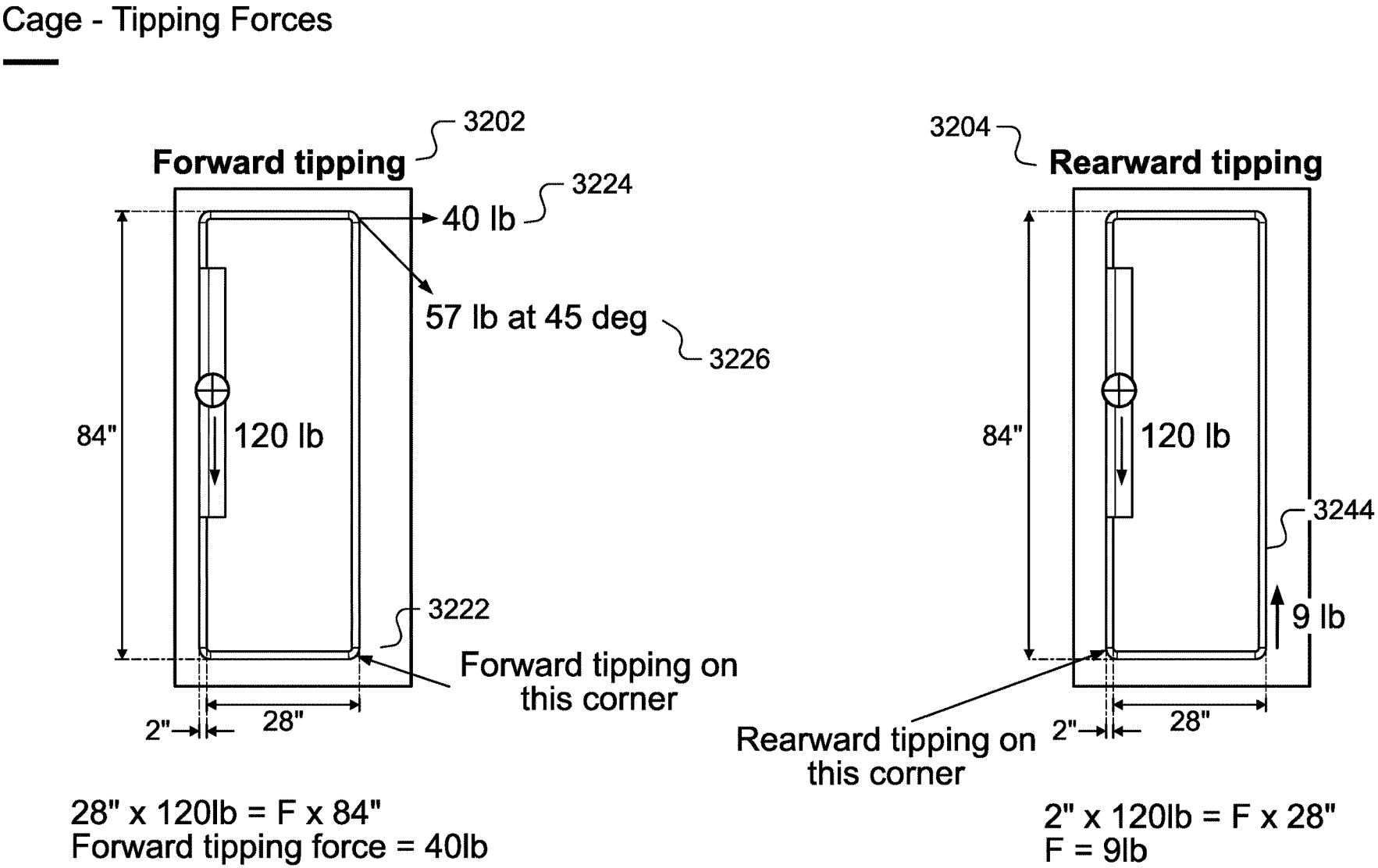
FIG. 32 is an illustration of a cage configuration detail of an exercise machine.

FIG. 32 is an illustration of a cage configuration detail of an exercise machine. FIG. 32 includes two rendered illustrations of the machine from a side elevation from its right side when the cage sides are perpendicular to the console unit, one describing forward tipping force calculations (3202) and one describing rearward tipping force calculations (3204).

Given the assumptions described with FIG. 31, forward tipping forces (3202) are described by a forward tip on the front corner of the cage sides (3222), where as shown in the event that a user pulls with 40 lb of force away from the machine at 84" of height (3224), this will tip the machine. Unless a user is extraordinarily tall, this is less likely than a user pulling 45 degrees down from the front corner of a cage side (3226), in which case the forward tipping force is 57 lb.

Given the assumptions described with FIG. 31, rearward tipping forces (3204) are described by a rear tip on the back corner of the cage sides (3242), where as shown in the event that a user pulls with 9 lb of force up from the machine at the front corner of the cage sides (3244), this will tip the machine.

Figure 33:
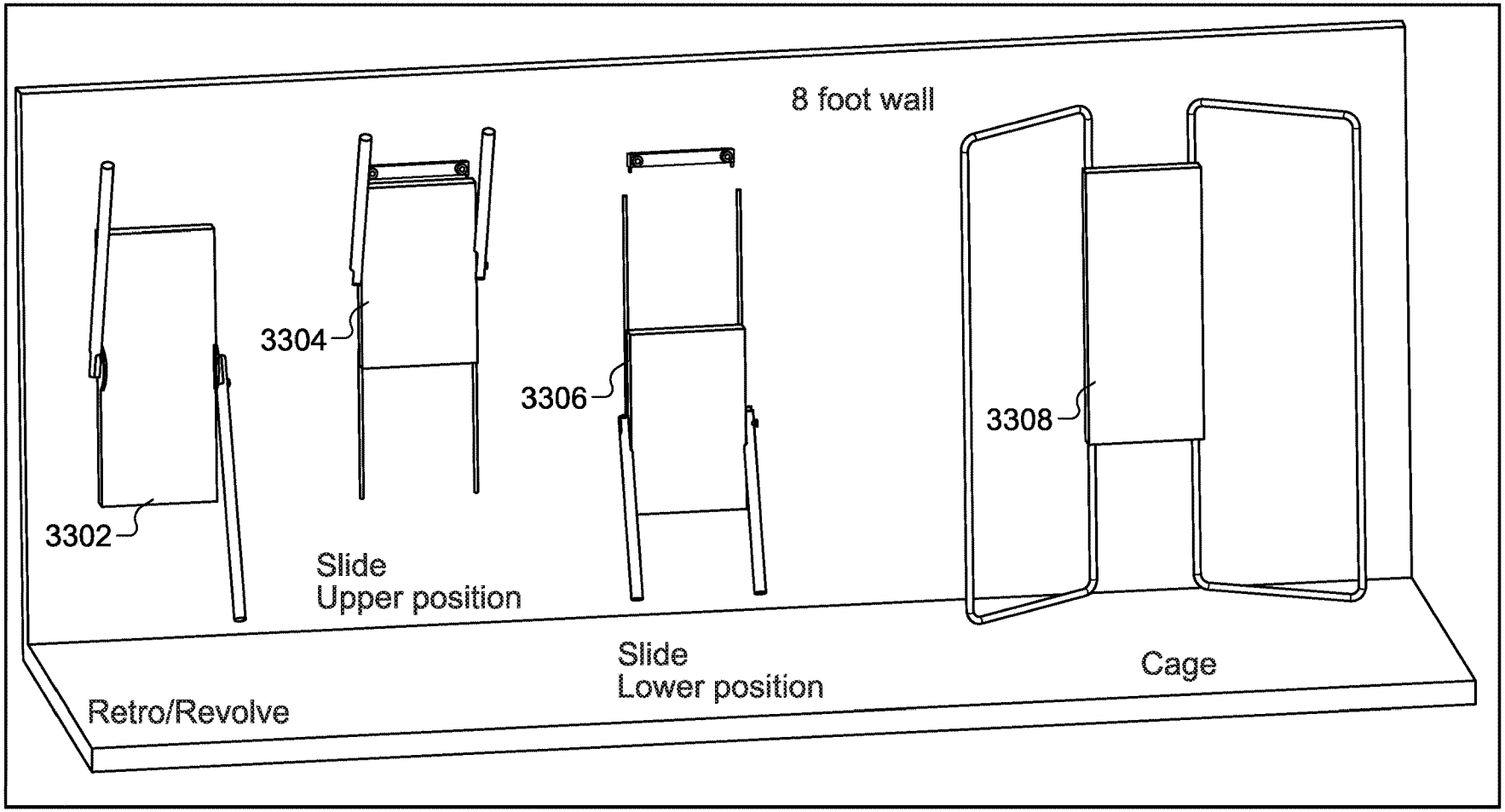
FIG. 33 is an illustration of a slide-rail or cage configuration of an exercise machine.

FIG. 33 is an illustration of a slide-rail or cage configuration of an exercise machine. FIG. 33 includes an illustration of four machines, including a simple retro/revolve without slide configuration (3302), two slide configurations showing the upper (3304) and lower (3306) positions possible with a slide or rail, and a freestanding cage configuration (3308) against an eight-foot wall.

Figure 34:
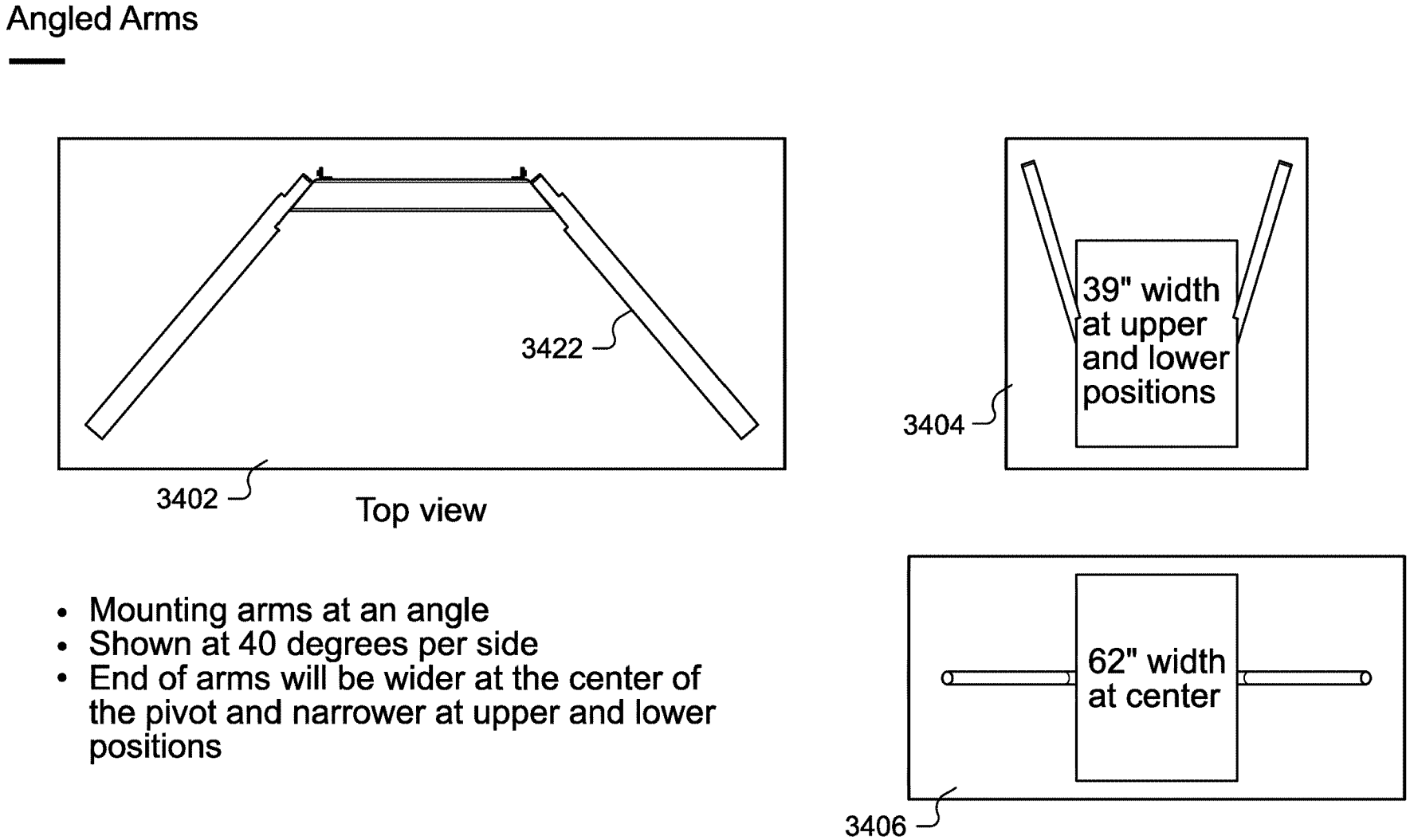
FIG. 34 is an illustration of an angled arm configuration of an exercise machine.

FIG. 34 is an illustration of an angled arm configuration of an exercise machine. FIG. 34 includes three rendered illustrations of the configuration from two different perspectives, a plan view from above the angled arms and console unit (3402), and two head-on elevation views with the arms at an upper position (3404) and a central position (3406).

In one embodiment, with the angled arms shown in FIG. 34, the arms (3422) are fixed at an angle, for example at an angle of 40 degrees. Such fixed arms give an improvement of greater robustness, ease of use, and/or higher simplicity over those fully-articulated arms in FIG. 4. In one embodiment, by virtue of their fixed angle, the end of the arms and thus the exertion point are wider when in the central position (3406) than in the upper or lower positions (3404). For example, if the arms are 45" long, there is a width of 39" between the arms at an upper position (3404) with arms angled at 40 degrees, and there is a width of 62" between the arms at a central position (3406).

Figure 35:
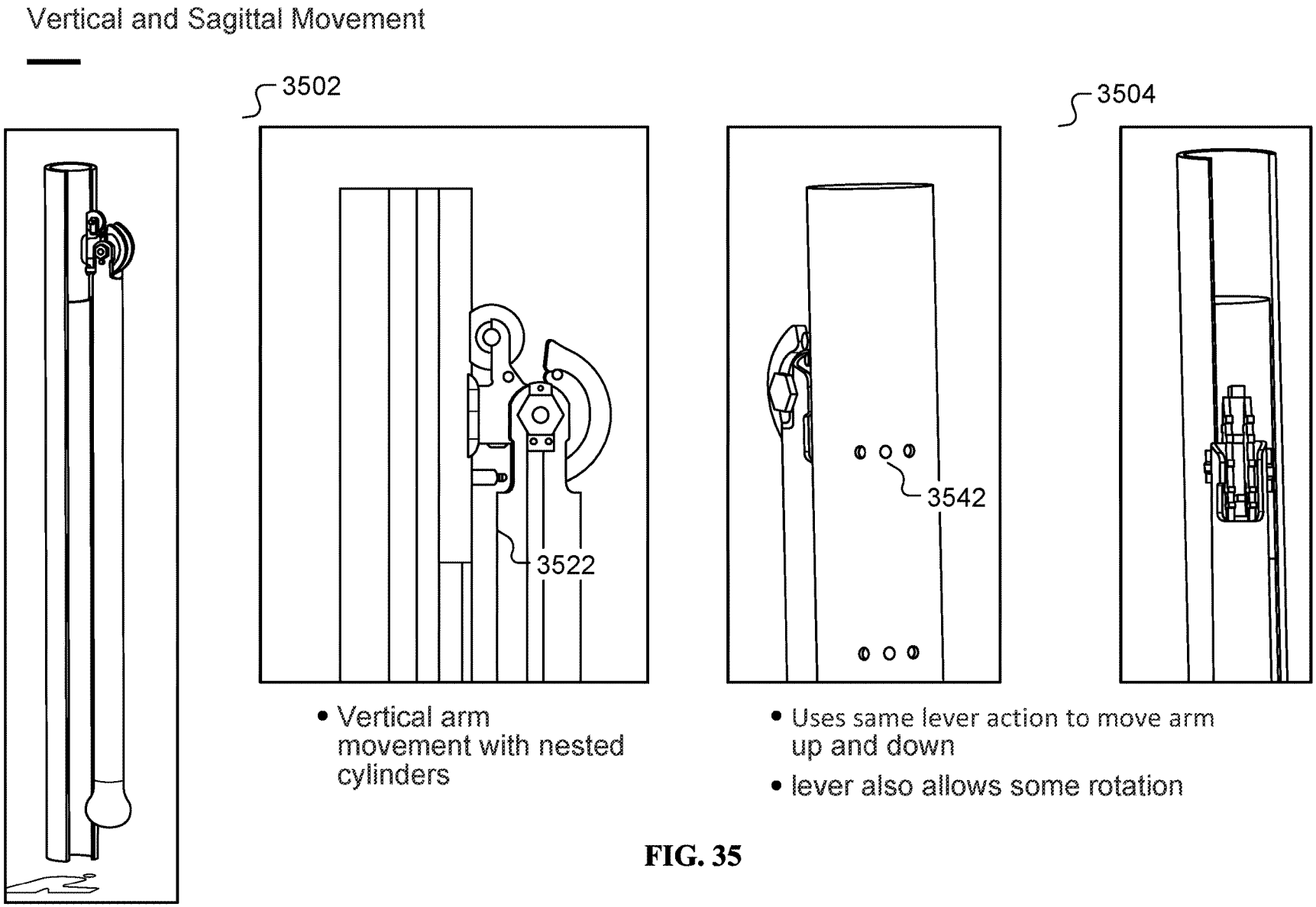
FIG. 35 is an illustration of an arm configuration of an exercise machine.

FIG. 35 is an illustration of an arm configuration of an exercise machine. FIG. 35 includes two rendered illustrations of the configuration each from two different perspectives, one of vertical movement (3502) within an arm, and one of sagittal movement (3504) for an arm, wherein the "sagittal" plane as referred to herein is the plane perpendicular to the surface of the exercise machine/resistance unit. For example, if an arm rotates from the side of the machine to directly in front of the machine, it rotates within the sagittal plane.

In one embodiment, a nested cylinder design is used for arms. Such a design gives an improvement of greater robustness, ease of use, and/or higher simplicity over those fully-articulated arms in FIG. 4. The nested cylinders may give an improvement of greater robustness, compact space requirements, ease of use, and/or higher simplicity over arms with a column lock as described in FIGS. 9A, 9B, and 9C. As shown in FIG. 35, a locking mechanism such as a pin (3522) may be used to lock the inner cylinder within the outer cylinder of the arm in, for example, three most used positions, for example covering 20 and/or 40 degrees of columnar rotation. In one embodiment, a lever such as that described herein with respects to the fully-articulated arms in FIG. 4 is used to move the inner cylinder, and hence the exertion point, up and down. The locking mechanism may use a plurality of pin holes (3542) that allow both up and down movement as well as some columnar rotation, as well as rotation in the sagittal plane.

Figure 36:
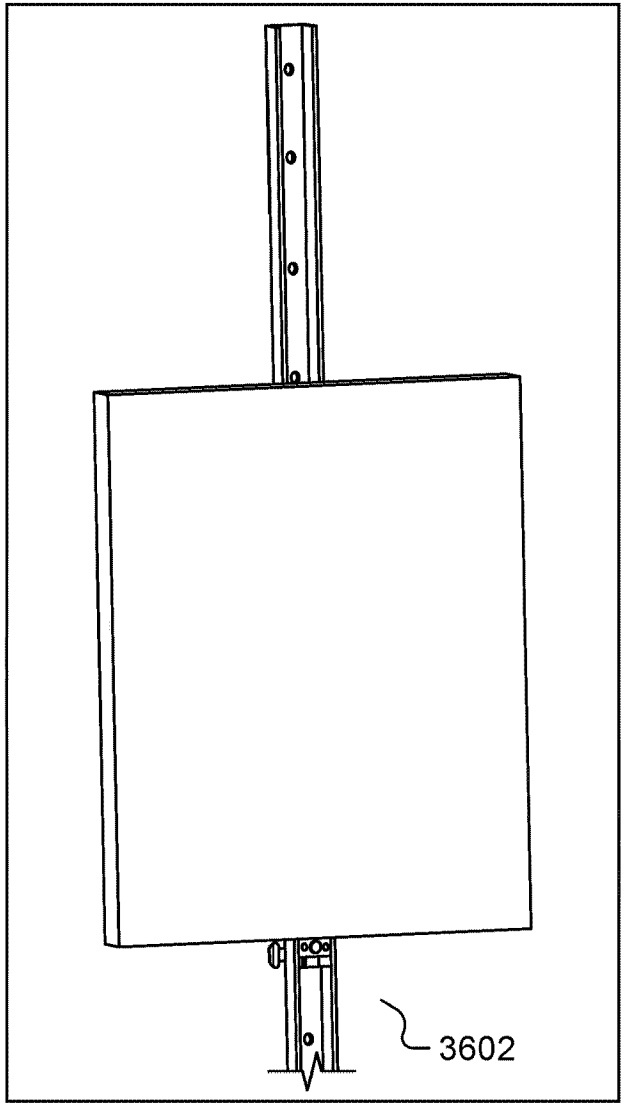
FIG. 36 is an illustration of a single rail configuration of an exercise machine.

FIG. 36 is an illustration of a single rail configuration of an exercise machine. FIG. 36 includes one rendered illustration. In one embodiment, as an alternate design to that of the dual rail configuration of FIG. 28, a single rail is used instead. Such a design gives an improvement of less misalignment over that shown in FIG. 28. As shown in FIG. 36, a larger centered single rail may be used, with a locking mechanism such as a pin (3602) and/or a spring-loaded pin at the bottom of the console unit may be used to lock the vertical position of the console unit and associated exertion points.

Figure 37:
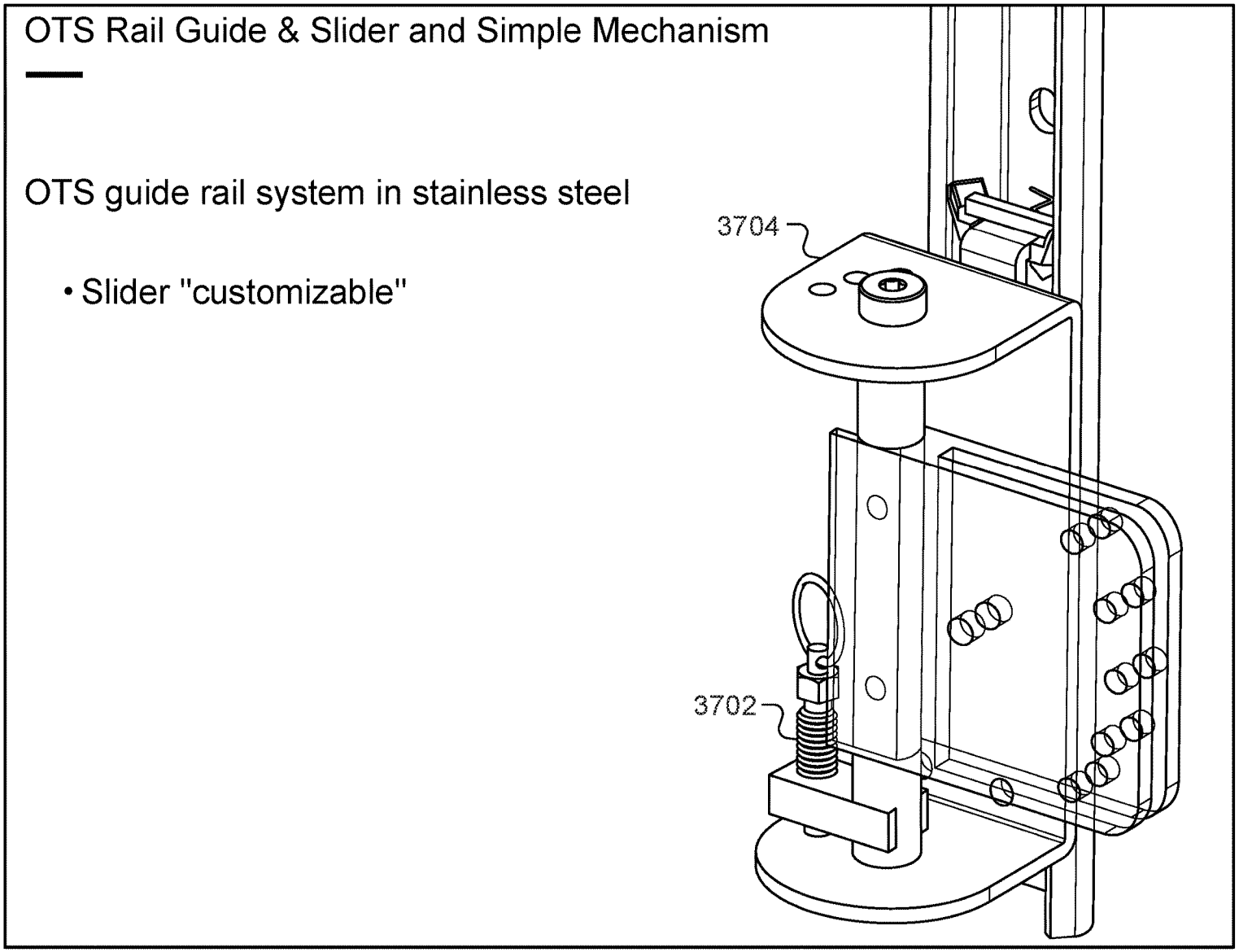
FIG. 37 is an illustration of a rail guide configuration of an exercise machine.

FIG. 37 is an illustration of a rail guide configuration of an exercise machine. FIG. 37 includes one rendered illustration. In one embodiment, the rail guide is used in conjunction with the dual rail configuration of FIG. 28 or the single rail configuration of FIG. 36. In one embodiment, an open-like theme/source guide rail system is constructed out of a sturdy material, for example stainless steel, and may be customizable for various purposes. Such a design gives an improvement of simplicity of design and/or may be integrable with other third-party machines. As shown in FIG. 37, one or more locking mechanism such as a pin (3702) may be used to lock the position of the rail guide with different pin hole positions (3704) associated with different exertion points.

Figure 38:
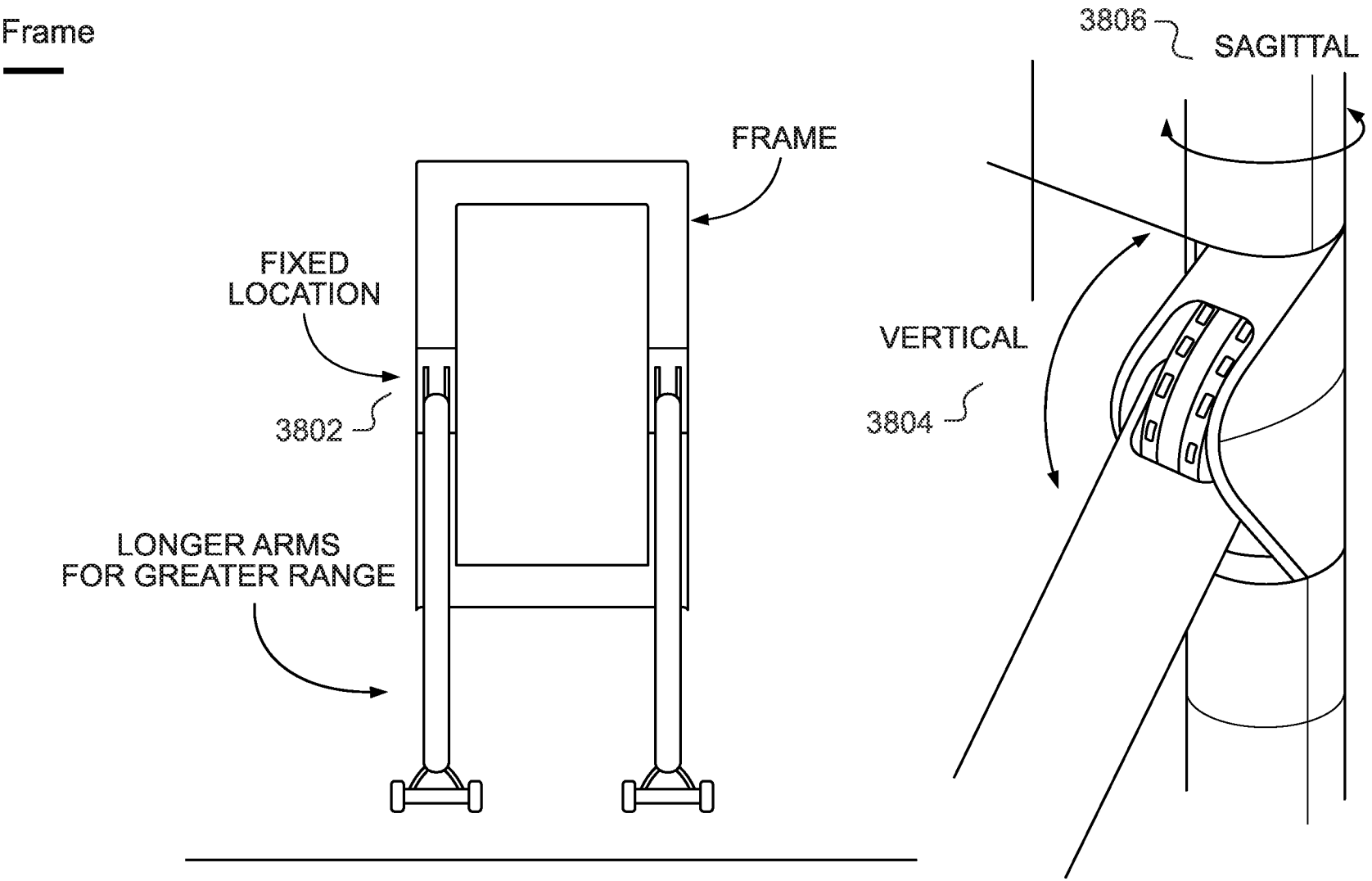
FIG. 38 is an illustration of a fixed arm height configuration of an exercise machine.

FIG. 38 is an illustration of a fixed arm height configuration of an exercise machine. FIG. 38 includes two rendered illustrations, one head-on elevation and one close-up perspective. In one embodiment, arm height is fixed (3802). Such fixed arms give an improvement of greater robustness, ease of use, and/or higher simplicity over those fully-articulated arms in FIG. 4. The fixed arms may longer for greater range of setting exertion points, and retain a similar vertical rotation (3804) and sagittal rotation (3806) as the fully-articulated arms of FIG. 4.

Figure 39:
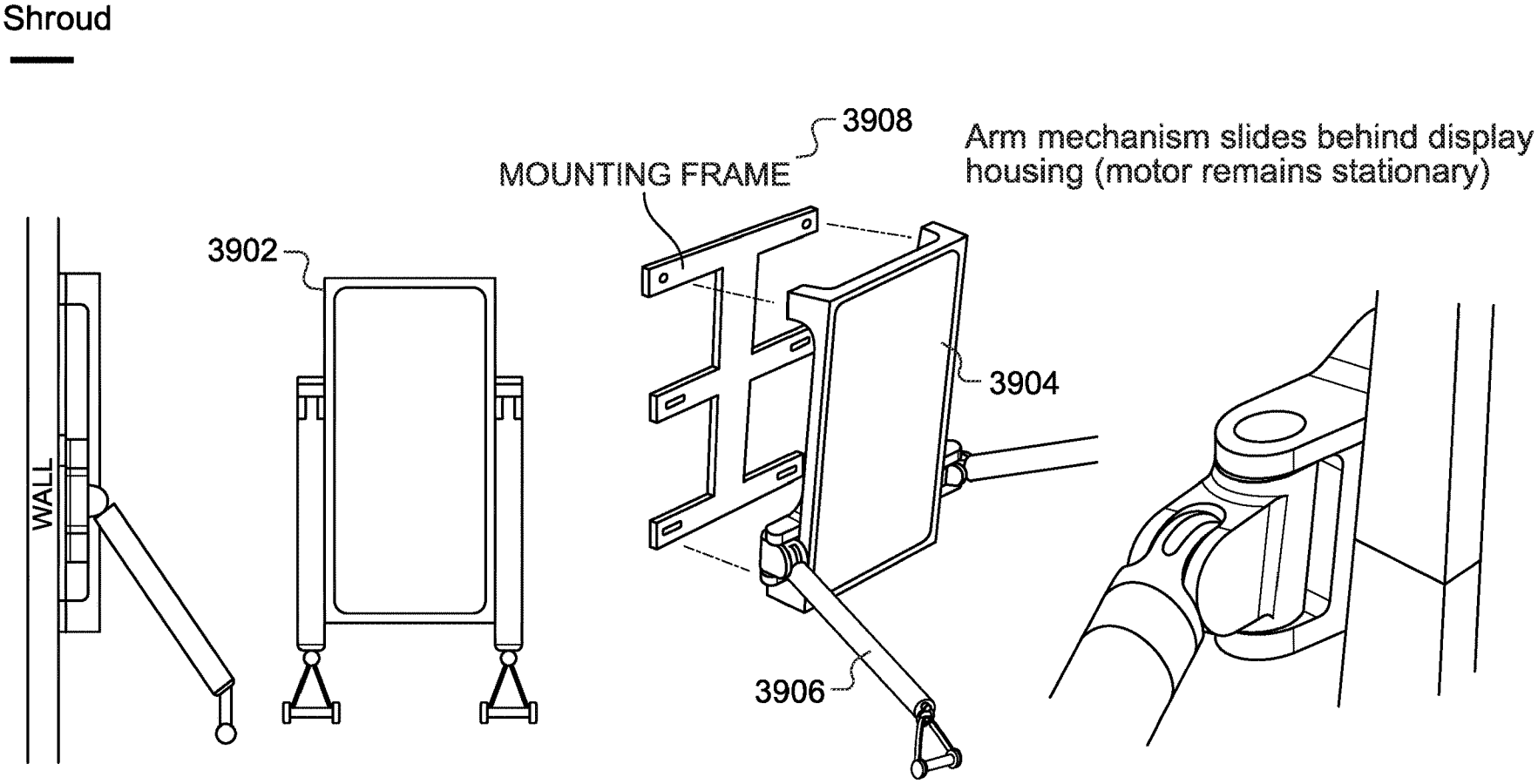
FIG. 39 is an illustration of a modular configuration of an exercise machine.

FIG. 39 is an illustration of a modular configuration of an exercise machine. FIG. 39 includes four rendered illustrations, including one head-on elevation, one side elevation, one perspective, and one close-up perspective. In one embodiment, a shroud (3902) or other module is used as part of the console unit, wherein the shroud has lighter duty elements such as the display (3904) and arms (3906) for exertion point positioning. A mounting frame (3908) is used to secure the shroud to the wall and/or provide a structural guide for the arms. As shown in FIG. 39, the arm mechanism may slide behind the display housing. In one embodiment, the motor unit remains stationary and may be part of the shroud or part of the mounting frame. In one embodiment, the arms are part of the mounting frame, and the display and/or cosmetic systems are modular for changes and/or upgrades. Such a modular design may give an improvement of greater robustness, ease of use, and/or higher simplicity over those fully-articulated arms in FIG. 4.

Figure 40A:
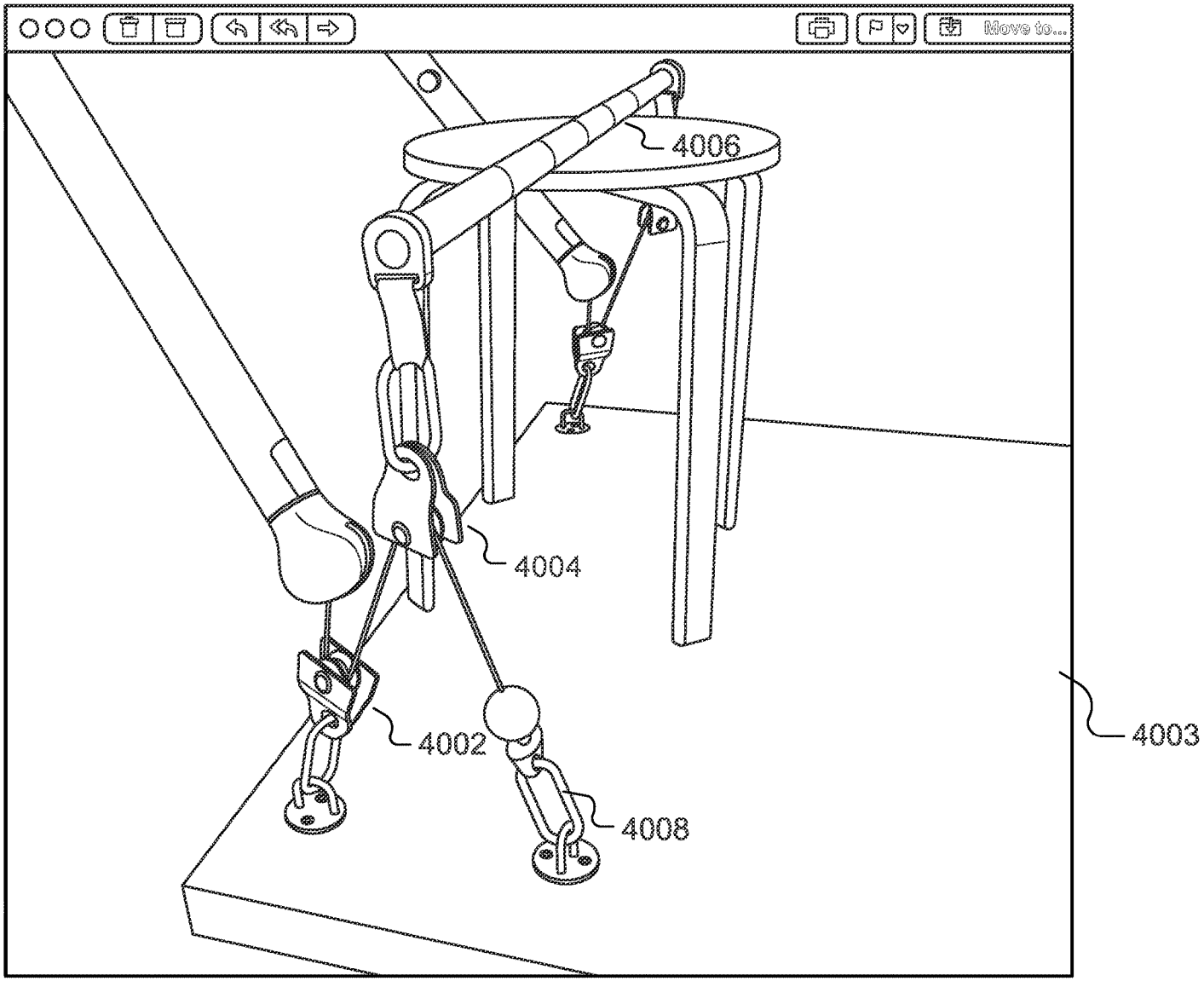
FIG. 40A is an illustration of a mechanical advantage adjustment configuration of an exercise machine.

FIG. 40A is an illustration of a mechanical advantage adjustment configuration of an exercise machine. FIG. 40A includes a photographic illustration. In one embodiment, a cable is routed through an auxiliary pulley (4002) attached to a plate (4003) and a second auxiliary pulley (4004), and the second auxiliary pulley (4004) is coupled with an exertion point (4006) for a user actuator. A mechanical advantage is adjusted when the terminal end of the cable is connected to a connector (4008) of the plate, using block and tackle mechanics, and in the example of FIG. 40A, actuator force is doubled while actuator velocity is halved. This may correspond to a resistance unit force doubling and/or resistance velocity halving if along the resistance unit's force-velocity curve for a given electrical power to the system including any system losses. In one embodiment, the system accepts a lower maximum velocity or lower maximum force, for example to 300 lb instead of 400 lb, and/or increase electrical power to the overall system. Using other block and tackle configurations and/or pulley configurations, other force and velocity tradeoffs may be established to, for example, increase actuator force by 300% while reducing actuator velocity to 33%. Such a design may give an improvement of greater range of exercises being made available to a user over those described with the machine of FIG. 1, for example if the machine of FIG. 1 has a motor limitation with a maximum force of 200 lb, this may not be enough to cover a user who wishes to practice a slow deadlift movement from the plate of 300 lb.

Figure 40B:
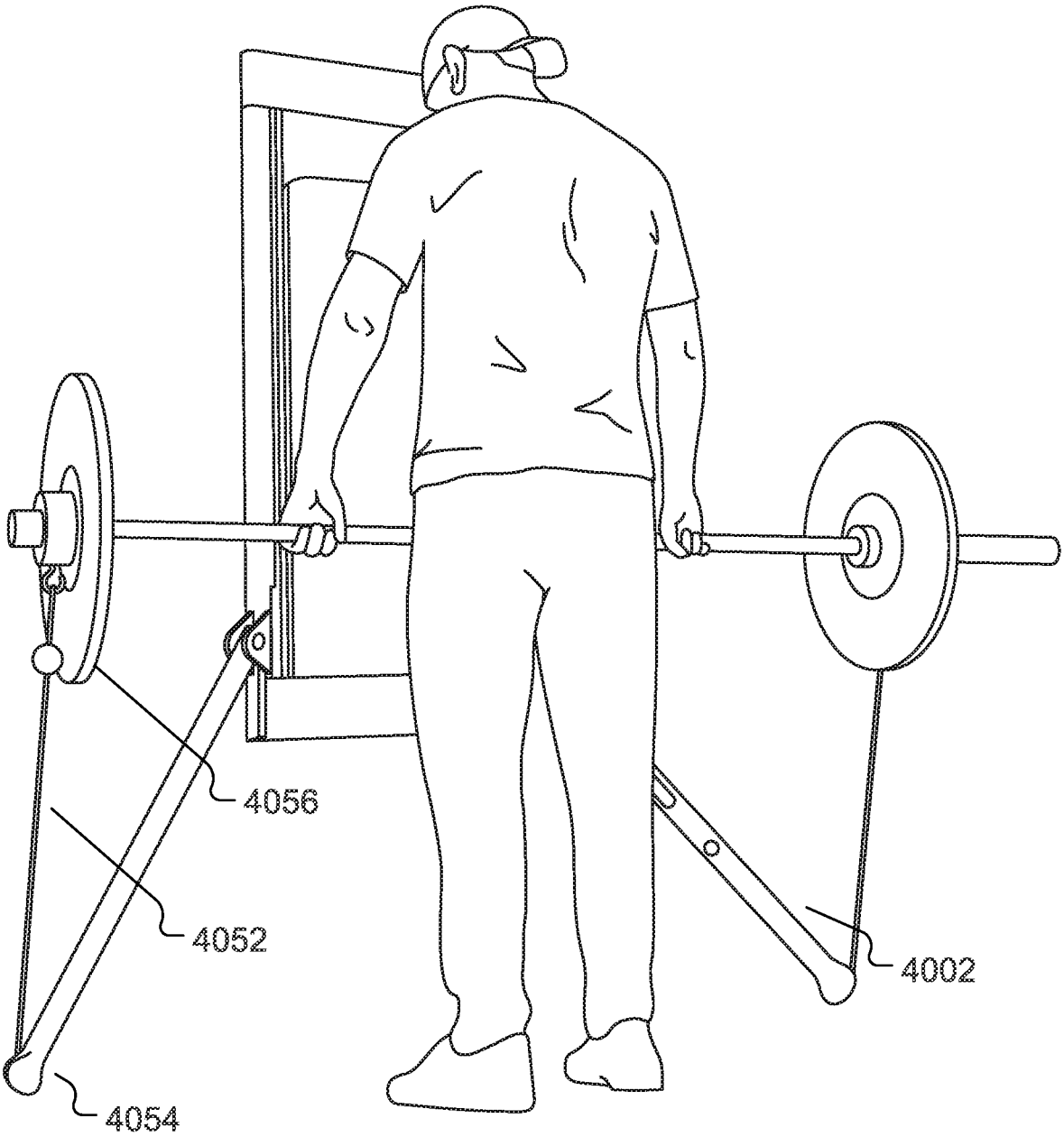
FIG. 40B is an illustration of a heavy bar configuration of an exercise machine.

FIG. 40B is an illustration of a heavy bar configuration of an exercise machine. FIG. 40B includes a photographic illustration. In one embodiment, one or more cables (4052) from the exercise machine is routed through a pulley (4054) and attached to a weighted bar (4056). Such a configuration may give an improvement of greater range of exercises being made available to a user over those described with the machine of FIG. 1, at least in part by:

increasing the maximum weight for lifting movements without any extra load on the exercise machine itself;

enabling free weights to become "smart" since an exercise machine with digital weight can add eccentric weights, chains, and/or spotter mechanisms;

autodetecting weight via camera and/or sensors (not shown in FIG. 40B); and/or enabling Olympic style movements like a "clean and jerk", at least in part because the bar (4056) has inertia which improves these types of movements. By contrast, the exercise machine of FIG. 1 without a heavy bar (4056) may not have as much inertia and may be assisted by digital weight simulation of excess inertia to improve these movements, which would require computation and/or memory resources.

Figure 41:
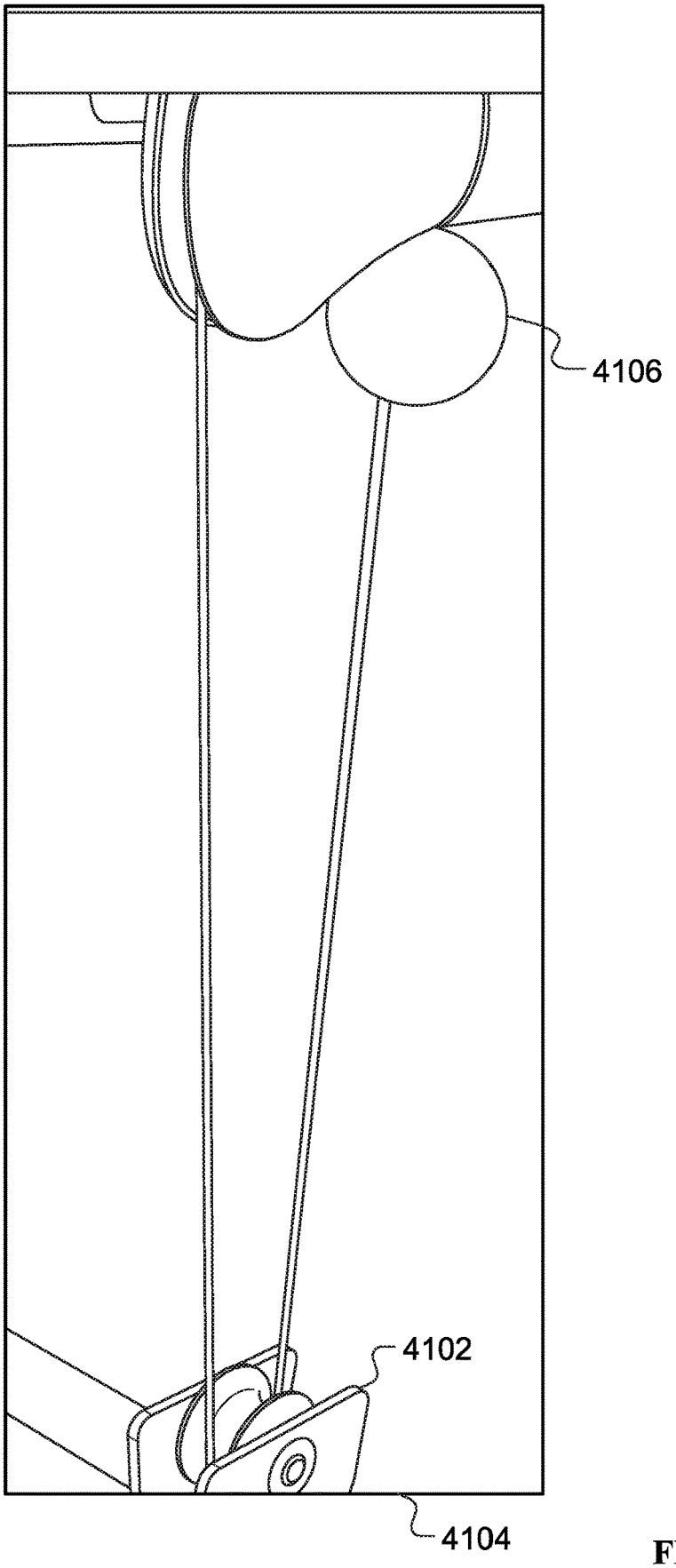
FIG. 41 is an illustration of a mechanical advantage arm adjustment configuration of an exercise machine.

FIG. 41 is an illustration of a mechanical advantage arm adjustment configuration of an exercise machine. FIG. 41 includes a photographic illustration. In one embodiment, a cable associated with an arm is routed through an auxiliary pulley (4102) coupled with an exertion point (4104) for a user actuator, and then routed to a connector (4106) on the same arm. A mechanical advantage using block and tackle mechanics, and in the example of FIG. 41, actuator force is doubled while actuator velocity is halved.

As opposed to using a plate in FIG. 40A, this configuration uses the arm of the machine itself. Using a plate with FIG. 40A exerts extra force on the plate, while using an arm with FIG. 41 exerts extra force on the arm and machine mount. Using other block and tackle configurations and/or pulley configurations, other force and velocity tradeoffs may be established to, for example, increase actuator force by 300% while reducing actuator velocity to 33%. Such a design may give an improvement of greater range of exercises being made available to a user over those described with the machine of FIG. 1, for example if the machine of FIG. 1 has a motor limitation with a maximum force of 200 lb, this may not be enough to cover a user who wishes to practice a slow curl movement of 300 lb.

Figure 42:
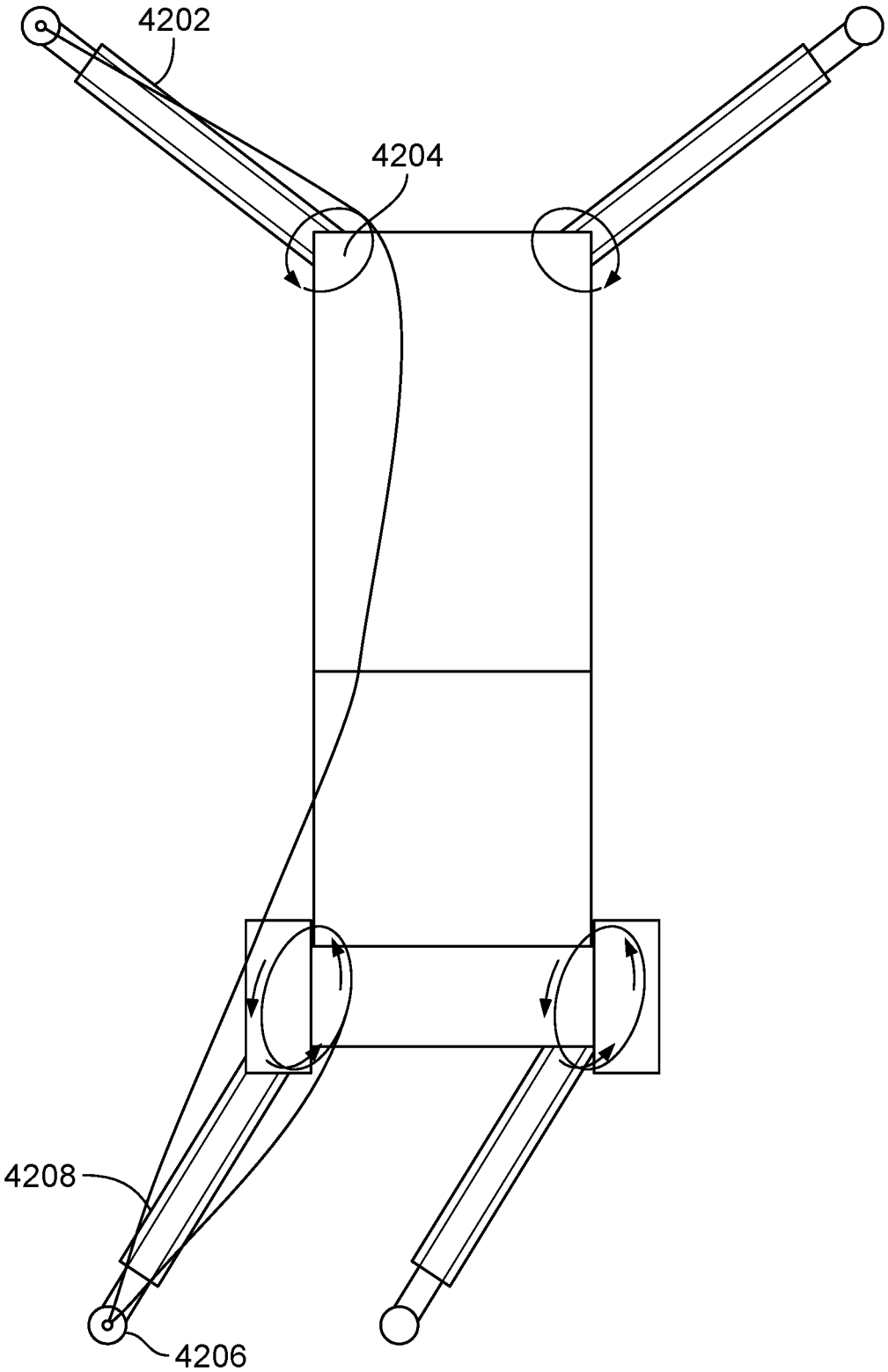
FIG. 42 is an illustration of a force combiner arm adjustment configuration of an exercise machine.

FIG. 42 is an illustration of a force combiner arm adjustment configuration of an exercise machine. FIG. 42 includes an illustration. In one embodiment, an exercise machine with two motors each have a maximum actuator force to exert. Using a cable associated with a first arm/motor (4202) and routing the cable through an auxiliary pulley (4204) coupled with an exertion point (4206) for a user actuator associated with a second arm/motor (4208). The maximum force of both the first motor and second motor are combined.

Such a design may give an improvement of greater range of exercises being made available to a user over those described with the machine of FIG. 1, for example if the machine of FIG. 1 has two motors, each with a motor limitation with a maximum force of 200 lb, this may not be enough to cover a user who wishes to practice a slow curl movement of 300 lb.

Figure 43:
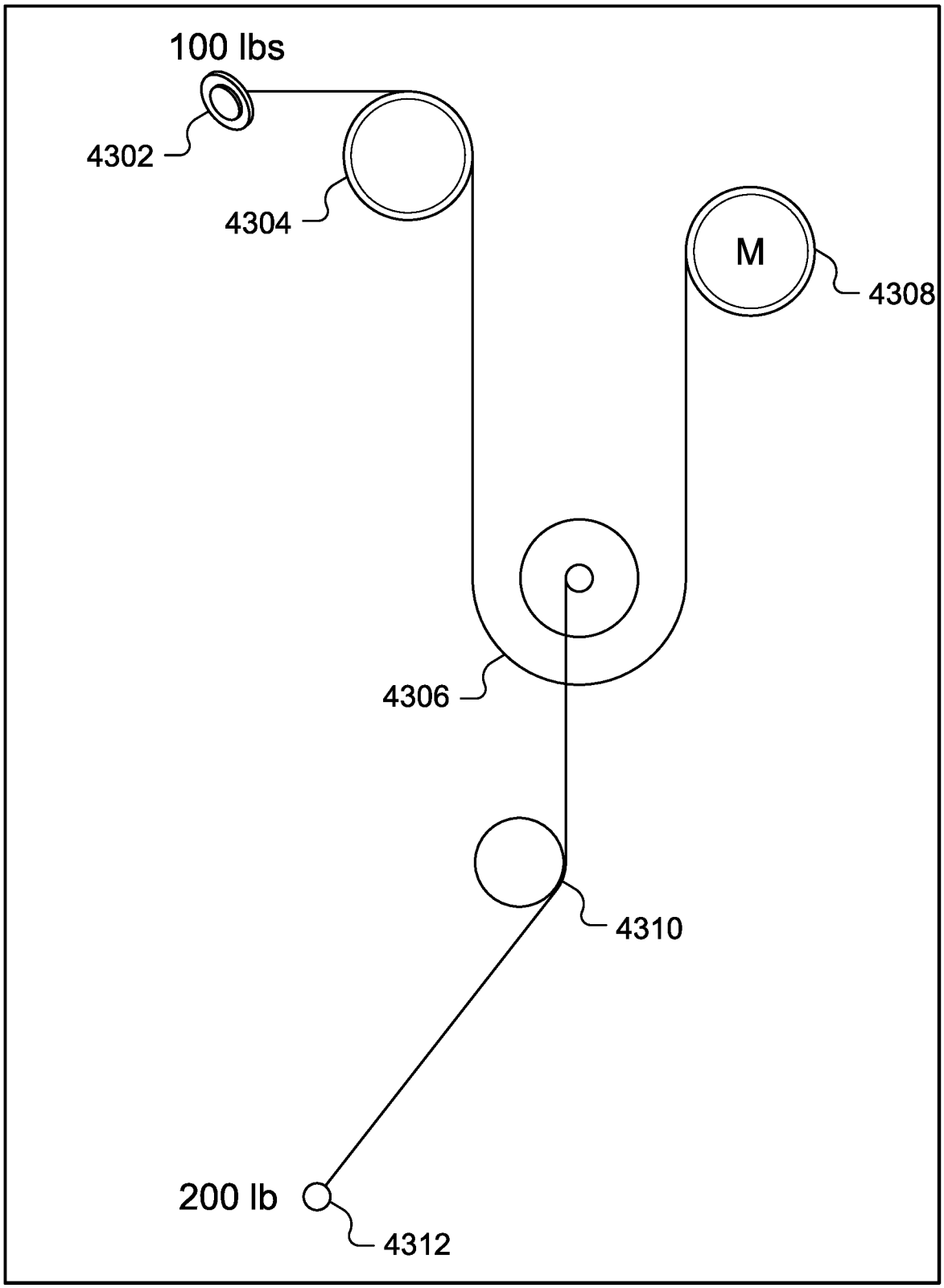
FIG. 43 is an illustration of a mechanical advantage configuration of an exercise machine.

FIG. 43 is an illustration of a mechanical advantage configuration of an exercise machine. FIG. 43 includes a simplified illustration. In one embodiment, a cable (4302) with 100 lb of maximum force is routed through an auxiliary pulley (4304) and a second auxiliary pulley (4306) to a terminal end (4308), and the second auxiliary pulley (4306) is coupled with an exertion point (4312) for a user actuator, which may go through an optional pulley (4310).

A mechanical advantage is adjusted when the terminal end of the cable is connected to some fixed item whether a plate (as shown in FIG. 40A) or an arm (as shown in FIG. 41), using block and tackle mechanics, and in the example of FIG. 43, actuator force is doubled to 200 lb while actuator velocity is halved. Using other block and tackle configurations and/or pulley configurations, other force and velocity tradeoffs may be established to, for example, increase actuator force by 300% while reducing actuator velocity to 33%. Such a design may give an improvement of greater range of exercises being made available to a user over those described with the machine of FIG. 1, for example if the machine of FIG. 1 has a motor limitation with a maximum force of 100 lb, this may not be enough to cover a user who wishes to practice a slow movement of 200 lb.

Figure 44:
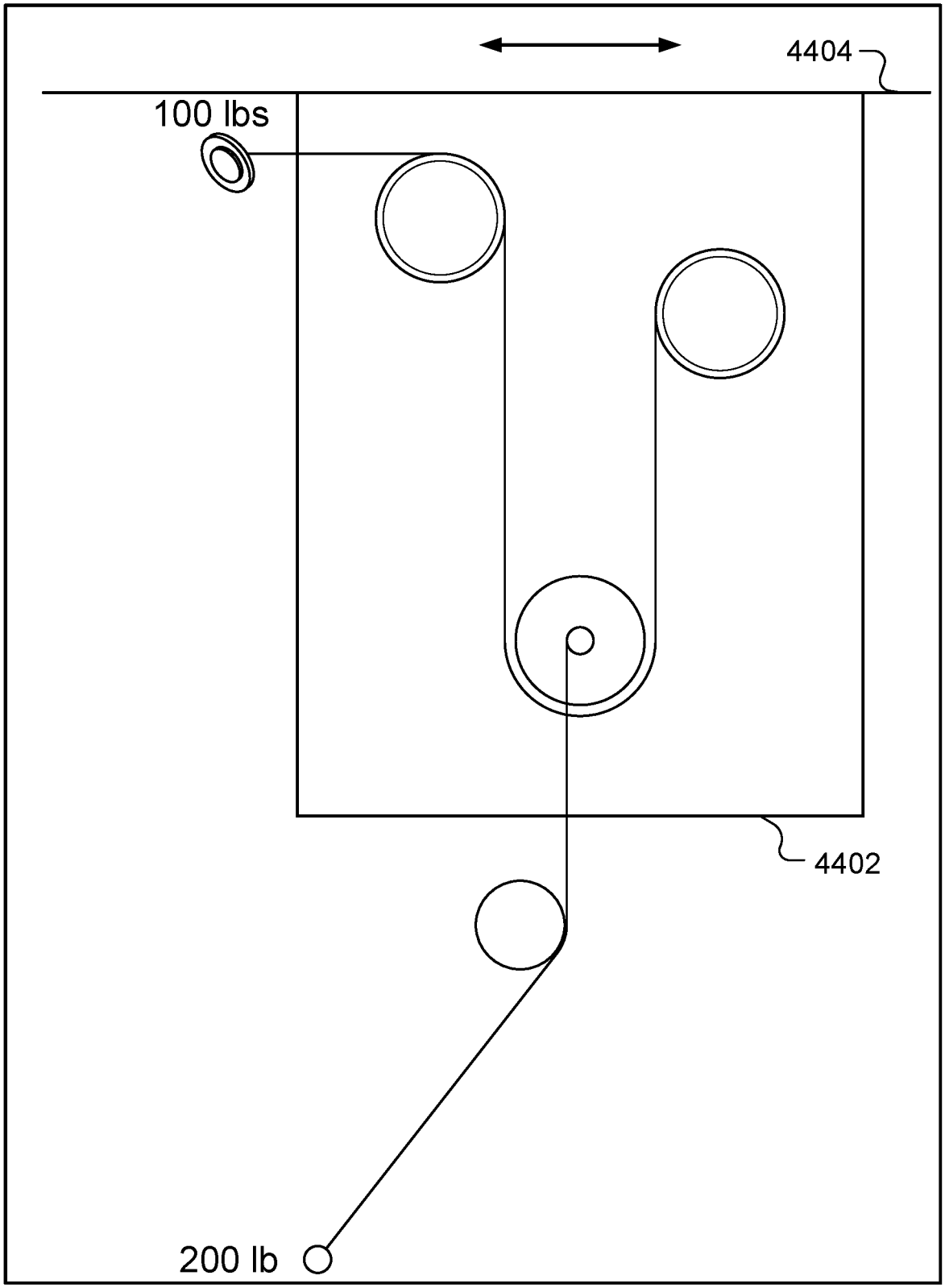
FIG. 44 is an illustration of a traveler configuration of an exercise machine.

FIG. 44 is an illustration of a traveler configuration of an exercise machine. FIG. 44 includes a simplified illustration. In the example shown in FIG. 44, the force doubler mechanism is mounted to a traveler subunit (4402), which allows motion along one or more directions, in the example shown a rail (4404). The traveler subunit may have no mechanical advantage and may simply be a single pulley to dynamically move/reposition the exertion point.

In one embodiment, such a movable exertion point provides a passive, damped, unstable and/or active regulation of the exertion point in relation to the user's position, user's motion, and/or user's exercise. The traveler subunit may be passive by allowing the traveler subunit (4402) to freely move on near-frictionless pulleys on the rail (4404), as the traveler subunit naturally follows the position of least resistance. For example, a user doing an upright row with a traveler subunit along a plate may passively maintain a strictly vertical force for the user. The traveler subunit (4402) may include an active brake along the rail (4404) to dampen the natural passive response for certain movements requiring a dampened travel for the exertion point. The traveler subunit (4402) may include an active motor along the rail (4404) to invert or otherwise make unstable the natural passive response for certain movements requiring an unstable or active dynamic travel for the exertion point.

Figure 45:
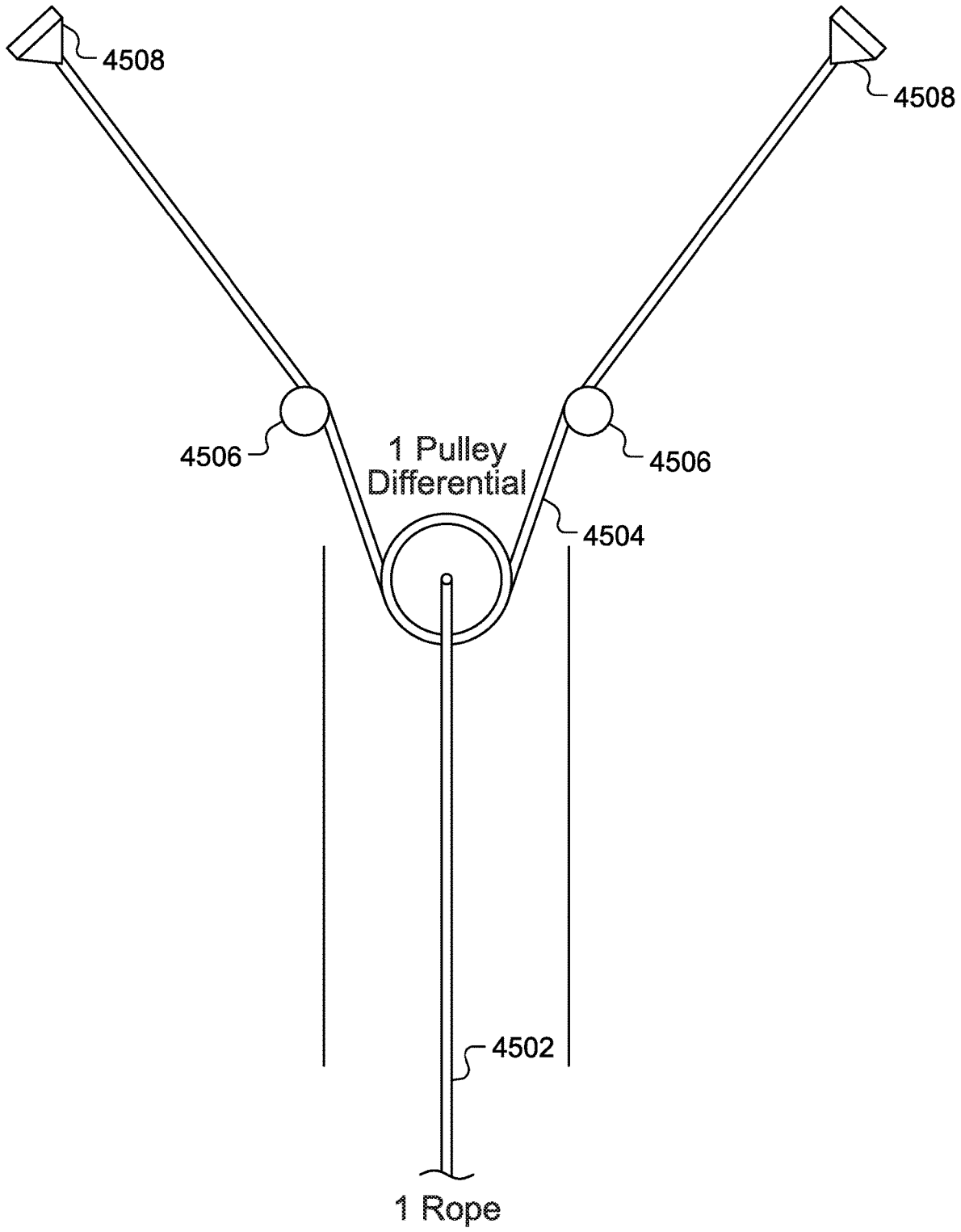
FIG. 45 is an illustration of a rope differential configuration of an exercise machine.

FIG. 45 is an illustration of a rope differential configuration of an exercise machine. FIG. 45 includes a simplified illustration. The rope differential configuration may be used in any aspect of the exercise machine for a differential, for example in the example shown in FIG. 45, the differential illustrated in FIGS. 12A-12I is replaced by a rope differential, comprising the cable from the motor (4502) coupled to a pulley differential (4504). The cable for the user actuators is thus routed between handles (4508) through zero or more pulleys (4506) and around the pulley differential (4504). Such a design may give an improvement of a simpler mechanism and/or less parts to fix over those described with the machine of FIG. 1.

Figure 46:
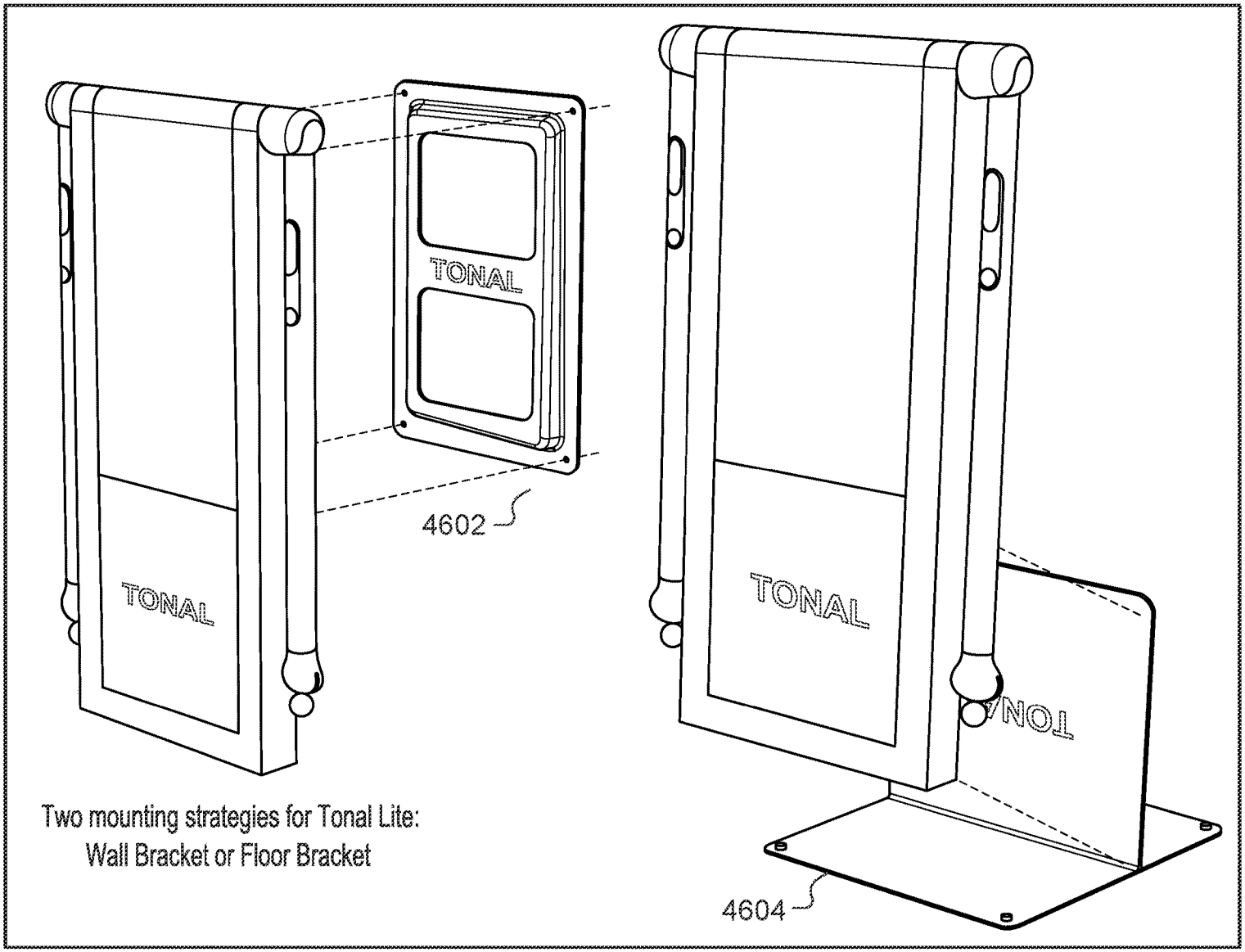
FIG. 46 is an illustration of mounting configuration of a floor-standing exercise machine.

FIG. 46 is an illustration of mounting configuration of a floor-standing exercise machine. FIG. 46 includes a rendered illustration comprising two exercise machines. In one embodiment, the two exercise machines may be of the same design and adaptable. In one embodiment, a wall mounted bracket (4602) is used to provide stability for the floor-standing machine. In one embodiment, a floor mounted bracket (4604) is used to provide a freestanding mount for the machine, for example a bracket made from ¼" steel. A floor-standing machine such as those shown in FIG. 46 may provide lower stress on a wall mount for the machine in FIG. 1, and lower the chance of the machine coming off the wall and/or endangering a user.

Figure 47:
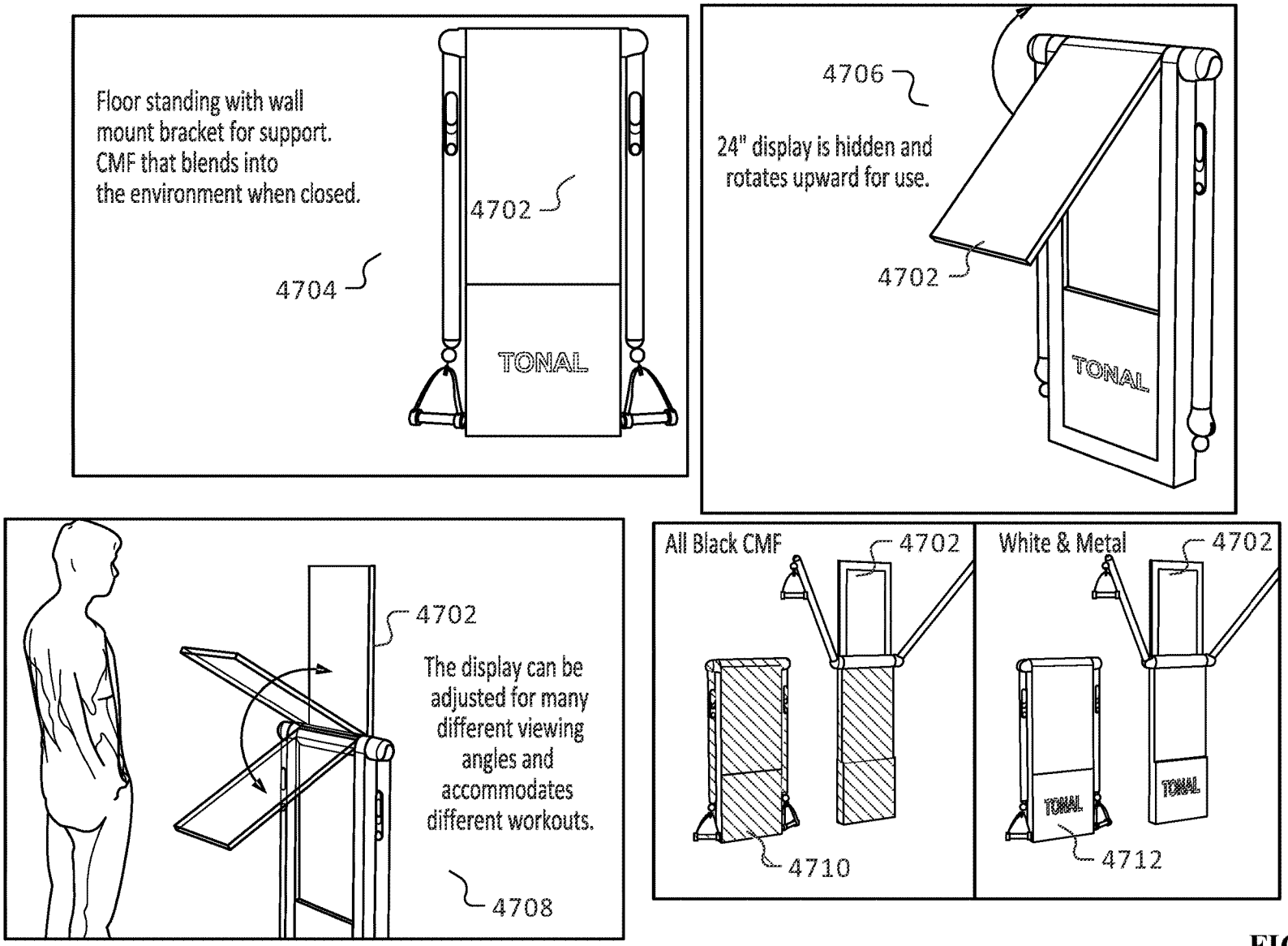
FIG. 47 is an illustration of an adjustable and stowable display unit configuration of an exercise machine.

FIG. 47 is an illustration of an adjustable and stowable display unit configuration of an exercise machine. FIG. 47 includes five rendered illustrations of a machine with display unit (4702). In a stowed position (4704), a colors materials finish (CMF) may be aesthetically improved by blending into the premises/environment when closed. When a user is ready for exercise (4706), a display unit (4702) may be tilted/rotated or otherwise translated for use. The display unit (4702) rendered in FIG. 47 is 24 inches diagonally but may be of any size without limitation. The display unit (4702) may be fully upright (4708) and may additionally be adjusted for different viewing angles to accommodate different users and/or user movements. As shown in FIG. 47, the example display (4702) may thus swing up for use and hide away or stow for storage. For a black CMF (4710), the unit may be made available in an exterior black with black arms, and for a white and metal CMF (4712), the unit may be made available in an exterior white with metallic finish arms.

Figure 48:
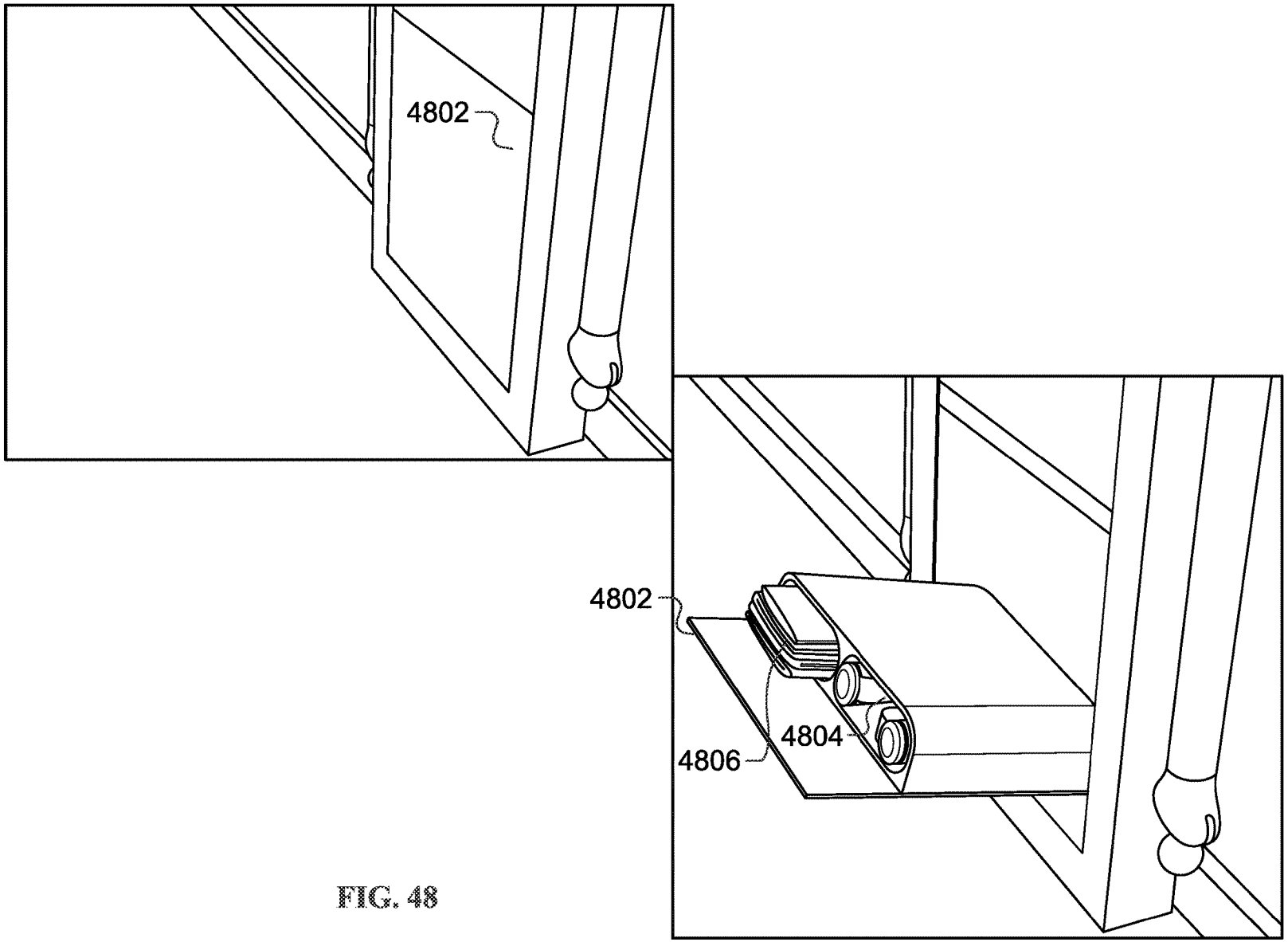
FIG. 48 is an illustration of an adjustable and stowable compartment configuration of an exercise machine.

FIG. 48 is an illustration of an adjustable and stowable compartment configuration of an exercise machine. FIG. 48 includes two rendered illustrations of a machine with user compartment (4802). In a stowed position (4802), a CMF may be aesthetically improved by blending into the premises/environment when closed. In comparison to the stowed diagram (4704) of FIG. 47, even the user actuators and/or handles (4804) may be stowed in compartment (4802) to be further aesthetically improved when closed. As shown the compartment (4802) may be adjustable in a tiltable way, or any other mechanical way.

Figure 49:
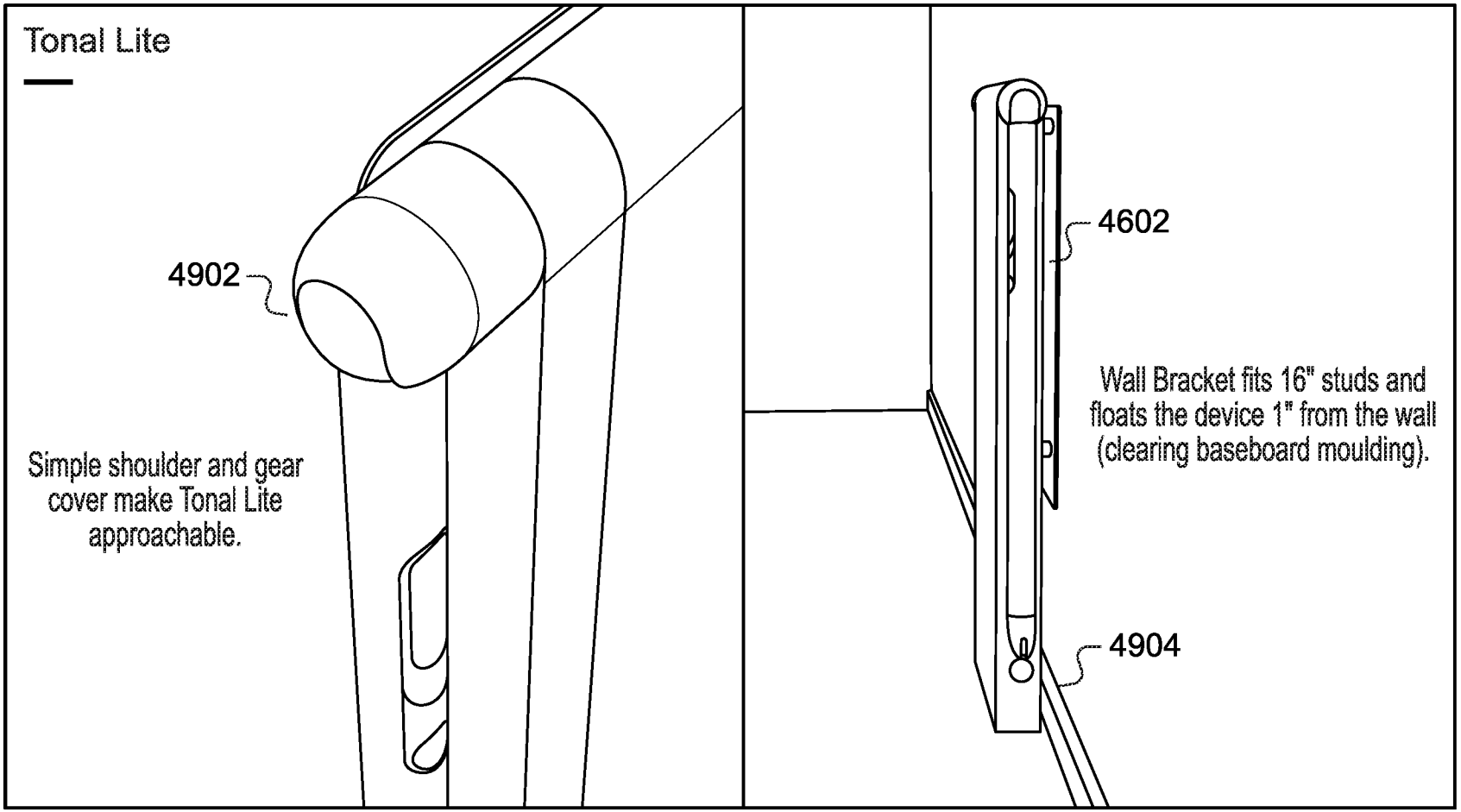
FIG. 49 is an illustration of a detailed configuration of a floor-standing exercise machine.

FIG. 49 is an illustration of a detailed configuration of a floor-standing exercise machine. FIG. 49 includes two rendered illustrations of a machine. As shown in close-up of the shoulder (4902), a simple shoulder gives an improvement of greater robustness, ease of use, and/or higher simplicity over those fully-articulated arms in FIG. 4. A gear cover may aesthetically improve the unit in comparison to an exposed gear. The wall bracket (4602) may be designed for traditional wall stud spacing, for example 16" in width, and may float the exercise machine from the wall to clear wall mouldings such as 1" for baseboards (4904).

Figure 50:
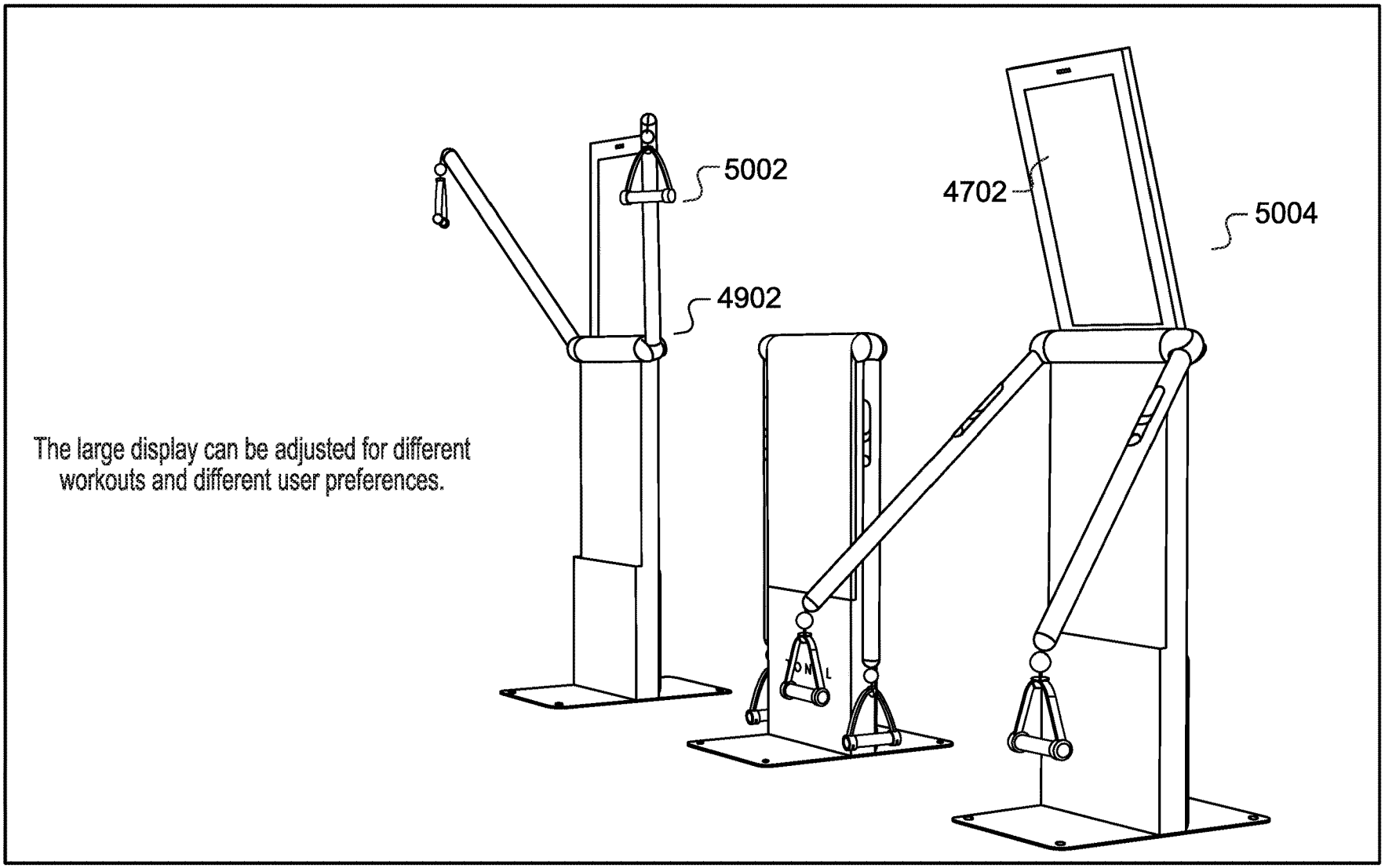
FIG. 50 is an illustration of an arm configuration of a floor-standing exercise machine.

FIG. 50 is an illustration of an arm configuration of a floor-standing exercise machine. FIG. 50 includes one rendered illustration of three arranged exercise machines, as one may find in a gym setting. As shown in FIG. 50, a simple shoulder (4902) gives an improvement of greater robustness, ease of use, and/or higher simplicity over those fully-articulated arms in FIG. 4, yet still allows for a range of exertion point placement, for example for a high exertion point placement (5002) for example for a lat pulldown movement, or for a low exertion point placement (5004) for example for a bench press movement. Additionally, the display unit (4702) may be tilted downwards to still roughly face a user who is on a bench.

Figure 51:
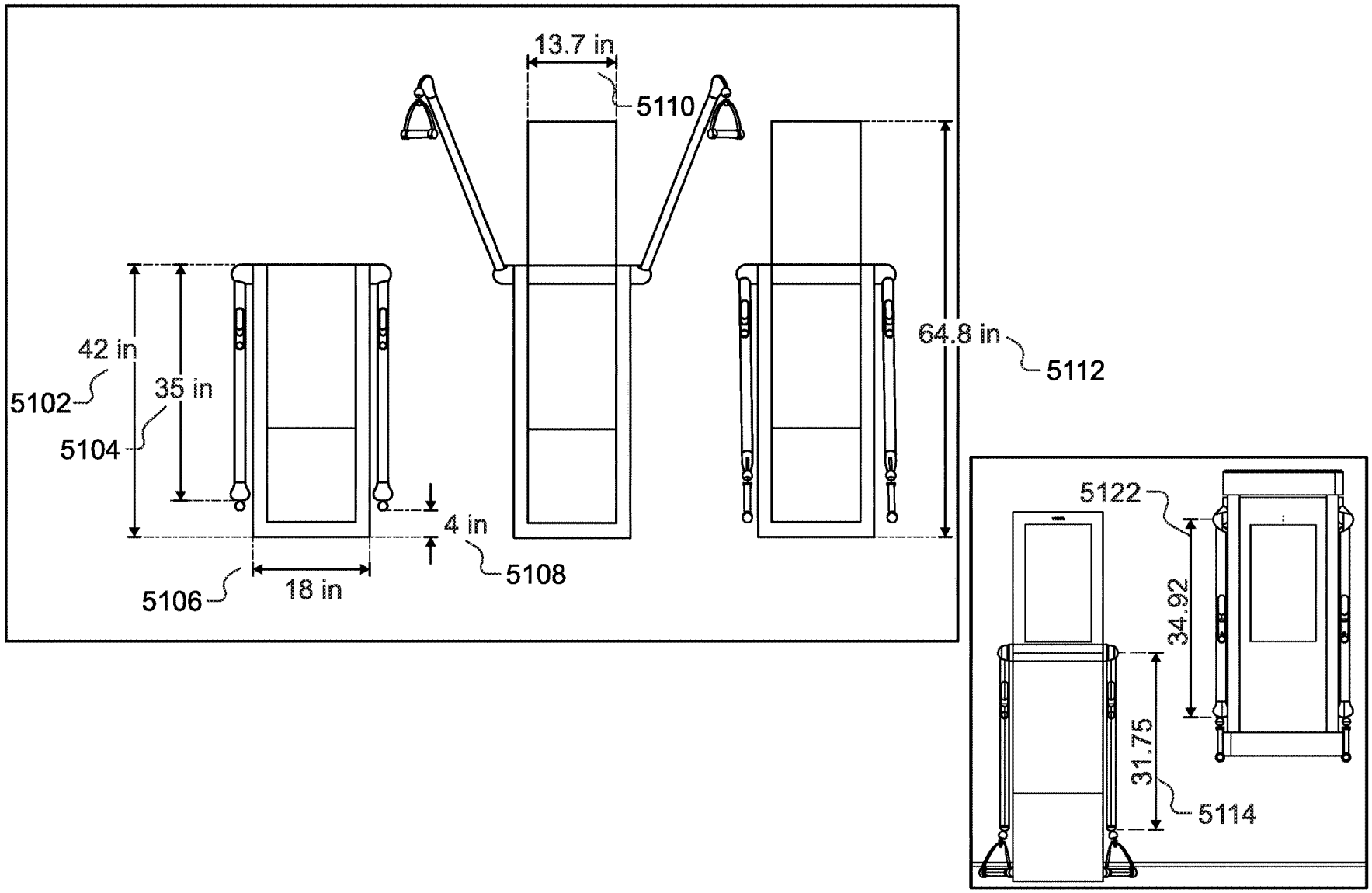
FIG. 51 is an illustration of dimensions for a floor-standing configuration of an exercise machine.

FIG. 51 is an illustration of dimensions for a floor-standing configuration of an exercise machine. FIG. 51 includes four rendered head-on elevations of a floor-standing exercise machine and one rendered head-on elevation of a wall-mounted exercise machine. The dimensions shown are without limitation shown as an example of dimensions aesthetically compatible with home and/or professional use.

As shown in FIG. 51, a stowed height (5102) of the machine may be between 36 in and 60 in, for example 42 in. A shoulder and arm length (5104) of the machine may be between 24 in and 60 in, for example 35 in. A machine width (5106) of the machine may be between 16 in and 48 in, for example 18 in. A wrist clearance (5108) of the machine may be between 1 in and 12 in, for example 4 in. A display unit width (5110) of the machine may be between 8 in and 46 in, for example 13.7 in. An extended height (5112) of the machine may be between 42 in and 96 in, for example 64.8 in. As shown in FIG. 51, arm length (5114) is comparable to that of fully-articulated arms (5122) in FIG. 4, for example 31.75 in for (5114) and 34.92 in for (5122).

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An exercise machine including:

a vertically oriented console unit comprising:

a first cable;

a screen;

an actuator coupled to the first cable;

a motor coupled to the first cable;

an encoder, wherein the encoder determines a position, wherein the position is at least one of position of the motor and position of the actuator; and wherein the motor provides a controllable tension force on the first cable based at least in part on the position; and an auxiliary pulley that is remote from the console unit, wherein the first cable is routable over the auxiliary pulley that is remote from the console unit, and being remote includes being in a physical space other than within the console unit or being directly attached to the console unit.

2. The exercise machine of claim 1, further comprising a plate, wherein the auxiliary pulley is attached to the plate.

3. The exercise machine of claim 2, wherein the plate further comprises a connector, and wherein a terminal end of the first cable is adapted to attach to the connector of the plate.

4. The exercise machine of claim 3, wherein the first cable is routable through a second auxiliary pulley coupled with an exertion point, wherein an actuator is coupled to the second auxiliary pulley, and wherein a mechanical advantage between an actuator force and an actuator velocity is adjusted when:

the first cable is routed through the auxiliary pulley attached to the plate and the second pulley; and the terminal end of the first cable is connected to the connector of the plate.

5. The exercise machine of claim 2, wherein the plate is coupled to the vertically oriented console unit.

6. The exercise machine of claim 5, wherein the vertically oriented console unit is coupled to the plate via one or more stands, and wherein the exercise machine is freestanding.

7. The exercise machine of claim 2, wherein the exercise machine is stowed at least in part by folding the console unit down or by folding the plate up.

8. The exercise machine of claim 1, wherein the vertically oriented console unit is mountable to a wall.

9. The exercise machine of claim 8, wherein the console unit comprises a sensor, and wherein the sensor is configured to detect a distance between the console unit and the wall.

10. The exercise machine of claim 1, further comprising a bench, wherein the auxiliary pulley is attached to the bench.

11. The exercise machine of claim 1, wherein the console unit further comprises a first arm, wherein the first arm routes the first cable.

12. The exercise machine of claim 11, wherein the auxiliary pulley is attached to the first arm.

13. The exercise machine of claim 1, wherein the exercise machine is mountable using a corner mount.

* * * * *